US006280920B1

(12) United States Patent
Maruyama et al.

(10) Patent No.: US 6,280,920 B1
(45) Date of Patent: Aug. 28, 2001

(54) SILVER HALIDE PHOTOGRAPHIC EMULSION AND SILVER HALIDE PHOTOSENSITIVE MATERIAL USING THE SAME

(75) Inventors: Yoichi Maruyama; Makoto Kikuchi; Masaaki Miki; Tadanobu Sato, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/628,009

(22) Filed: Jul. 28, 2000

(30) Foreign Application Priority Data

| | | |
|---|---|---|
| Jul. 30, 1999 | (JP) | 11-216972 |
| Aug. 17, 1999 | (JP) | 11-230895 |
| Aug. 31, 1999 | (JP) | 11-246491 |
| Jun. 27, 2000 | (JP) | 12-193162 |

(51) Int. Cl.[7] ..... G03C 1/005
(52) U.S. Cl. ..... 430/567
(58) Field of Search ..... 430/567

(56) References Cited

U.S. PATENT DOCUMENTS

| | | | |
|---|---|---|---|
| 5,219,720 | 6/1993 | Black et al. | 430/567 |
| 5,496,694 | 3/1996 | Kikuchi et al. | 430/567 |
| 5,498,516 | 3/1996 | Kikuchi et al. | 430/567 |

FOREIGN PATENT DOCUMENTS

| | | |
|---|---|---|
| A2298935 | 12/1990 | (JP) . |
| A8334850 | 12/1996 | (JP) . |

*Primary Examiner*—Hoa Van Le
(74) *Attorney, Agent, or Firm*—Birch, Stewart, Kolasch & Birch, LLP

(57) ABSTRACT

A silver halide photographic emulsion and a silver halide photosensitive material containing the emulsion are disclosed. The grains contained in the emulsion have a variation coefficient of distribution of an equivalent-circle diameter of all the grains of 40% or less, and 50% or more in number of all the grains in the emulsion satisfy requirements (i) to (iii) below:

(i) silver iodobromide or silver bromochloroiodide tabular grains having (111) faces as major surfaces, (ii) the equivalent-circle diameter is 3.5 $\mu$m or more and a thickness is 0.25 $\mu$m or less, and (iii) a distance between twin planes of the tabular grain is 0.016 $\mu$m or less.

20 Claims, No Drawings

SILVER HALIDE PHOTOGRAPHIC EMULSION AND SILVER HALIDE PHOTOSENSITIVE MATERIAL USING THE SAME

CROSS-REFERENCE TO RELATED APPLICATIONS

This application is based upon and claims the benefit of priority from the prior Japanese Patent Applications No. 11-216972, filed Jul. 30, 1999; No. 11-230895, filed Aug. 17, 1999; No. 11-246491, filed Aug. 31, 1999; and No. 2000-193162, filed Jun. 27, 2000, the entire contents of which are incorporated herein by reference.

BACKGROUND OF THE INVENTION

The present invention relates to a silver halide emulsion having a high sensitivity and an improved pressure property, and a silver halide photographic material using the same.

Manufacturing methods and use techniques of tabular silver halide grains are disclosed in U.S. Pat. Nos. 4,434,226, 4,439,520, 4,414,310, 4,433,048, 4,414,306, and 4,459,353. Known advantages of tabular grains are, e.g., improvements of the sensitivity/graininess relationship, including improvements of the color sensitization efficiency obtained by spectral sensitizing dyes.

Various studies have been made to improve the properties of tabular grains having such advantages.

U.S. Pat. No. 5,219,720 has disclosed a technique of improving the sensitivity/graininess ratio by decreasing the distance between twin planes of a tabular grain having (111) faces as major surfaces.

Jpn. Pat. Appln. KOKAI Publication No. (hereafter referred to as JP-A-)6-273869 has disclosed a technique of improving the manufacturing stability by using low-molecular-weight gelatin in a nucleation step in the formation of tabular grains.

On the other hand, demands for resistance to pressure of a silver halide emulsion is becoming stronger than before as the silver halide emulsion becomes to have a higher sensitivity. Generally, it is known that as various pressures are imposed to a silver halide photosensitive material, the photographic property thereof changes. For example, when a pressure is imposed to a silver halide photosensitive material during the manufacture thereof or during conveyance thereof in a camera, or the photographic material is bended, fogging arises or sensitivity decreases, which is a problem of a practical use. Especially, when a photosensitive material is bended, the bigger the equivalent-circle diameter and thinner the thickness of a tabular grain, the easier to occur fogging and reduced sensitivity. Accordingly, it was desired for such grains to both heighten the sensitivity and improve the pressure resistance.

Techniques to introduce dislocation lines with high density and to limit the position of the dislocation lines, and making distribution of silver iodide content between grains uniformly, are disclosed, for example, JP-A-6-27564 and JP-6-258745. Further, a technique to control the (100) surface area ratio to all the surface area of a tabular grain is disclosed, for example, in JP-A's-2-298935 and 8-334850.

However, there is no description in these patent applications of the use of an emulsion containing grains having a large equivalent-circle diameter and a thinner grain thickness, having a high (100) surface ratio to all the surface areas, and having high density dislocation lines introduced at a fringe portion of the grains, and in addition, the distribution of the silver iodide content between the grains is uniform.

Also, JP-A-8-95181 has disclosed a technique of increasing the sensitivity in a small-size region. However, a technique of increasing the sensitivity of tabular silver halide grains in a large-size region, which aims to achieve high sensitivity that is important in the competition with digital cameras in the future, is still immature. Hence, a technique of increasing the sensitivity has been desired.

BRIEF SUMMARY OF THE INVENTION

It is an object of the present invention to provide a silver halide photographic emulsion containing tabular grains in a large-size region, having high photographic sensitivity, and having a greatly improved resistance to pressure, and a silver halide photosensitive material using the same.

DETAILED DESCRIPTION OF THE INVENTION

The object of the present invention is achieved by a silver halide photographic emulsion and a silver halide photosensitive material using the same, described in Embodiment 1 to Embodiment 20 below:

(Embodiment 1) A silver halide photographic emulsion containing grains wherein a variation coefficient of distribution of an equivalent-circle diameter of all the grains is 40% or less, and 50% or more in number of all the grains satisfy requirements (i) to (iii) below:

(i) silver iodobromide or silver bromochloroiodide tabular grains having (111) faces as major surfaces, (ii) the equivalent-circle diameter is 3.5 $\mu$m or more and a thickness is 0.25 $\mu$m or less, and (iii) a distance between twin planes of the tabular grain is 0.016 $\mu$m or less;

(Embodiment 2) The emulsion described in Embodiment 1, wherein a variation coefficient of distribution of the thickness of all the grains is 40% or less, and a variation coefficient of distribution of the distance between twin planes of all the grains is 40% or less;

(Embodiment 3) The emulsion described in Embodiment 1, wherein the tabular grains further satisfy, in addition to the requirements (i) to (iii), requirements (iv) and (v) below:

(iv) a silver iodide content is in a range from 0.7 I to 1.3 I, wherein I represents a specific silver iodide content (mol %) and $0.3<I<20$, and (v) ten or more dislocation lines per grain are present at a fringe portion;

(Embodiment 4) The emulsion described in Embodiment 3, wherein the range of the requirement (iv) is 0.8 I to 1.2 I;

(Embodiment 5) The emulsion described in Embodiment 3, wherein the tabular grains further satisfies, in addition to requirements (i) to (v), requirements (vi) below:

(vi) the dislocation lines are substantially localized only at a fringe portion of the grain;

(Embodiment 6) The emulsion described in Embodiment 5, wherein the tabular grains further satisfies, in addition to the requirements (i) to (vi), requirement (vii) below:

(vii) an electron-capturing zone is present;

(Embodiment 7) The emulsion described in Embodiment 6, wherein an average surface iodide content of all the grains is 5 mol % or less;

(Embodiment 8) The emulsion described in Embodiments 6 or 7, wherein the tabular grains have 10 or more dislocation lines, each having a length of 0.05 D or more, per grain, wherein D represents the equivalent-circle diameter;

(Embodiment 9) The emulsion described in Embodiment 1, wherein a coefficient of distribution of the distance between twin planes of all the grains is 40% or less, and the emulsion was prepared by using a low molecular, oxidated gelatin during a step of nucleation;

(Embodiment 10) The emulsion described in Embodiment 3, wherein the emulsion further satisfy requirement (viii) below:

(viii) an average value of long edge/short edge ratios of all the grains is 1.4 or less;

(Embodiment 11) The emulsion described in Embodiment 3, wherein the number of the dislocation lines of the requirement (v) is 30 or more per grain, and 80% or more in number of all the grains are occupied by tabular grains having dislocation lines substantially localized only at a fringe portion thereof, and a ratio of (100) surface area to the side surface area is 40% or more;

(Embodiment 12) The emulsion described in Embodiment 3, wherein the tabular gains further satisfies, in addition to the requirements (i) to (v), requirement (ix) below:

(ix) an average silver iodide content of the fringe portion is higher by 2 mol % or more than an average silver iodide content of the central portion;

(Embodiment 13) The emulsion described in any one of Embodiments 1 to 12, wherein the emulsion was prepared by using at least three kinds of gelatin at a time of grain formation;

(Embodiment 14) The emulsion described in any one of Embodiments 1 to 13, wherein the emulsion was prepared by adding a crystal habit-controlling agent during grain formation;

(Embodiment 15) The emulsion described in any one of Embodiments 1 to 14, wherein the coefficient of distribution of the equivalent-circle diameter of all the grains is 25% or less;

(Embodiment 16) The emulsion described in any one of Embodiments 1 to 15, wherein the equivalent-circle diameter and thickness of the requirement (ii) are 3.5 μm or more and 0.15 μm or less, respectively;

(Embodiment 17) The emulsion described in any one of Embodiments 1 to 15, wherein the equivalent-circle diameter and thickness of the requirement (ii) are 4.0 μm or more and 0.15 μm or less, respectively;

(Embodiment 18) The emulsion described in any one of Embodiments 1 to 15, wherein the equivalent-circle diameter and thickness of the requirement (ii) are 4.0 μm or more and 0.10 μm or less, respectively;

(Embodiment 19) A silver halide photosensitive material having a photosensitive emulsion layer containing the silver halide photosensitive emulsion described in any one of Embodiments 1 to 18, on a support; and (Embodiment 20) The material described in Embodiment 19, wherein the material contains at least one blue-sensitive silver halide emulsion layer, at least one green-sensitive silver halide emulsion layer and at least one red-sensitive silver halide emulsion layer on a support, and at least one of the at least one red-sensitive silver halide emulsion layer is arranged further from the support than at least one of the at least one green-sensitive silver halide emulsion layer.

The emulsion of the present invention will be described below.

In the present invention, a tabular grain is a silver halide grain having two opposing, parallel (111) major surfaces. A tabular grain of the present invention has one twin plane or two or more parallel twin planes. The twin plane is a (111) plane on the two sides of which ions at all lattice points have a mirror image relationship.

When this tabular grain is viewed in a direction perpendicular to the major surfaces of the grain, it has any of triangular, square, hexagonal, and intermediate truncated triangular shapes, each having parallel outer surfaces.

The equivalent-circle diameter and thickness of a tabular grain are obtained by taking a transmission electron micrograph by the replica method. That is, the equivalent-circle diameter is calculated as the diameter (equivalent-circle diameter) of a circle having an area equal to the projected area of each individual grain. The thickness is calculated from the length of the shadow of a replica.

The equivalent-circle diameter of all the grains and the coefficient of the distribution thereof, and the thickness of all the grains and the coefficient of the distribution thereof are determined by using each of the values obtained by the above methods with regard to 1000 or more grains.

In the tabular grains of the present invention, 50% or more of the total projected area are accounted for by grains having an equivalent-circle diameter of 3.5 μm or more, and preferably, 4.0 to 10 μm. If the diameter is less than 3.5 μm, no high sensitivity can be achieved. If the diameter exceeds 10 μm, increasing the sensitivity by increasing the size reaches the uppermost limit.

In tabular grains of the present invention, 50% or more in number of all the grain are accounted for by grains having a thickness of 0.25 μm or less, preferably, 0.15 μm or less, and more preferably, 0.1 μm or less.

If the thickness exceeds 0.25 μm, it is difficult to achieve the merit of increasing the sensitivity by tabular grains.

In an emulsion of the present invention, 50% or more in number of all the grains are accounted for by tabular grains having an aspect ratio of 14 or more, more preferably, 23 or more, and most preferably, 26 or more. An aspect ratio is the value obtained by dividing the equivalent-circle diameter by the thickness.

An emulsion of the present invention is preferably monodisperse. In the present invention, the variation coefficient of the distribution of the equivalent-circle diameters of the projected areas of all silver halide grains is preferably 40% or less, more preferably, 30% or less, and most preferably, 25% or less. The variation coefficient of equivalent-circle diameters is the value obtained by dividing the standard deviation of the distribution of the equivalent-circle diameters of individual silver halide grains by the average equivalent-circle diameter.

When silver halide grains are chemically sensitized, the grains are difficult to optimally sensitize if non-uniformity exists between these grains. This reduces the photographic sensitivity. From this point of view, the thickness of tabular grains is preferably monodisperse.

Also, as the aspect ratio of a tabular grain increases, the absolute value of its thickness decreases. Side faces of a grain having a small absolute value of thickness readily dissolve. In the formation of fringe dislocation type tabular grains, the density of dislocation lines decreases in grains whose side faces are dissolving. Tabular grains having a polydisperse thickness are unpreferable because the frequency of grains having readily dissolvable side faces increases. From this viewpoint, the grain thickness is preferably monodisperse. The thickness variation coefficient is preferably 40% or less, more preferably 30% or less, and most preferably, 20% or less.

The distance between twin planes of the tabular grains used in the invention is, preferably, 50% or more in number of all the grains are 0.016 μm or less, more preferably, 0.014 μm or less, and most preferably, 0.012 μm or less. In a tabular grain having three or more twin planes, the distance between most separated two twin planes is the distance between the twin planes.

The distance between twin planes can be obtained by observing an ultra-thin segment of a grain through a transmission electron microscope. In the specification, 50% or more in number of all the grains have a distance between twin planes of 0.016 μm or less means the case where the distances of 1000 or more grains are measured, 500 grains of more have the distance of 0.016 μm or less. The coefficient of the distance between twin planes can also be obtained by measuring the distances of 1000 or more grains.

The distribution of the distances between the twin plans of tabular grains are also preferably monodisperse in respect of the uniformity between the grains. This further facilitates optimum chemical sensitization of grains.

In the formation of fringe dislocation type grains, the uniformity of side faces is important since it directly connects to the uniformity of fringe dislocations. The variation coefficient of the distance between twin planes of tabular grains is preferably 40% or less, and more preferably, 30% or less.

Tabular silver halide grains having (111) faces as major surfaces generally has a hexagonal, triangular, or intermediate truncated triangular shape, and has triple symmetry. Of these six edges, the ratio of the sum of the lengths of edges from the longest edge to the third longest edge to the sum of the lengths of edges from the shortest edge to the third shortest edge is the long edge/short edge ratio.

The long edge/short edge ratios of tabular grains are also preferably approached to 1 in respect of the uniformity between the grains. This further facilitates optimum chemical sensitization of grains.

In the formation of fringe dislocation type grains, the density of dislocation lines in fringe portions of grains having a shape close to a triangle was much lower than that in grains having a shape close to a hexagon. From this point of view, the long edge/short edge ratio of a tabular grain is preferably approached to 1. The average values of the long edge/short edge ratios of tabular grains is preferably 1.4 or less.

The preparation of tabular grains of the present invention is basically the combination of three steps: nucleation, ripening, and growth. Although the methods described in U.S. Pat. No. 4,797,354 and JP-A-2-838, the disclosures of which are incorporated herein by reference, can be referred to in the preparation of tabular grains of the present invention, the various conditions of the methods must be changed.

In the nucleation step of the core of the present invention, it is effective to use gelatin with a small methionine content described in U.S. Pat. Nos. 4,713,320 and 4,942,120, perform nucleation with a high pBr as described in U.S. Pat. No. 4,914,014, and perform nucleation within a short time period as described in JP-A-2-222940, all the disclosures of which are incorporated herein by reference. In the ripening step of a core tabular grain emulsion of the present invention, it is sometimes effective to perform ripening in the presence of a low-concentration base as described in U.S. Pat. No. 5,254,453 or at a high pH as described in U.S. Pat. No. 5,013,641, the disclosures of which are incorporated herein by reference.

Gelatin whose molecular weight is reduced by enzyme decomposition has low protective colloid capability for silver halide grains. If the protective colloid capability further lowers by oxidation treatment, it is apprehended that the adsorptivity to a silver halide becomes too low and the twinned crystal generation probability cannot be well controlled if this gelatin is used in nucleation. However, it was experimentally confirmed that necessary protective colloid capability was held even when oxidation treatment was performed until the methionine content became 3.4 μmol/g by using low-molecular-weight gelatin having a molecular weight of 15,000.

The use of this gelatin allows triple addition nucleation using oxidized gelatin, and this further facilitates the formation of monodisperse thin grains. The period for addition of the gelatin during triple addition nucleation can range over the period of nucleation by adding an aqueous silver salt solution and an aqueous halide solution.

The molecular weight of low-molecular-weight oxidized gelatin is preferably 40,000 or less, more preferably, 30,000 or less, and most preferably, 20,000 or less.

The methionine content of the gelatin is preferably 10 μmol/g or less, and more preferably, 4 μmol/g or less.

Tabular grain formation methods using polyalkyleneoxide compounds described in U.S. Pat. Nos. 5,147,771, 5,147,772, 5,147,773, 5,171,659, 5,210,013, and 5,252,453, the disclosures of which are incorporated herein by reference, are preferably used in the preparation of tabular grains of the present invention.

In the present invention, the silver bromide content of an emulsion grain is preferably 80 mol % or more, and more preferably, 90 mol % or more.

Also, the silver iodide content of an emulsion grain in the present invention is preferably 1 to 20 mol %, more preferably, 2 to 15 mol %, and most preferably, 3 to 10 mol %. A silver iodide content of less than 1 mol % is unpreferable because it is difficult to obtain the effects of enhancing dye adsorption and increasing the intrinsic sensitivity. A silver iodide content exceeding 20 mol % is also unpreferable because the developing speed generally lowers.

In the present invention, the silver chloride content is preferably 0 to 20 mol %, more preferably, 0 to 15 mol %, and most preferably, 0 to 7 mol %, and can be selected in accordance with the intended use.

In an emulsion of the present invention, assuming the specific silver iodide content is I mol % ($0.3<I<20$), silver halide grains having a silver iodide content of 0.7 I to 1.3 I account for preferably 100 to 50%, more preferably, 100 to 80%, and most preferably, 100 to 90% of the total number of grains. If the percentage fall outside this range, the effect of the present invention is difficult to obtain.

Furthermore, in an emulsion of the present invention, silver halide grains having a silver iodide content of 0.8 I to 1.2 I account for 100 to 50%, more preferably, 100 to 80%, and most preferably, 100 to 90% of the total number of grains.

The value of the specific silver iodide content I can be an arbitrary value within the range of ($0.3<I<20$), e.g., the average value when the silver iodide contents of individual grains are measured.

This "specific silver iodide content (I mol %)" concerning an emulsion of the present invention is a specific silver iodide content taking a value close to the average silver iodide content calculated on the formulation of the emulsion. I is a specific value exceeding 0.3 mol % and less than 20 mol %. It is possible to specify this value, by measuring the silver iodide contents of a group of specific emulsion grains separated from a specific emulsion layer of a silver halide photosensitive material, such that as many grains as possible fall within the range of 0.7 I to 1.3 I. Generally, the value is close to the arithmetic average value of the silver iodide contents of the group of the specific emulsion grains. It is practical to set the I value to the average silver iodide content on the formulation or to the measured average silver iodide content.

The silver iodide contents of individual emulsion grains can be measured by analyzing the composition of each individual grain by using an X-ray microanalyzer.

The measurement method is described in, e.g., European Patent 147,868.

The surface iodide content of an emulsion of the present invention is preferably 5 mol % or less, more preferably, 4 mol % or less, and most preferably, 3 mol % or less. A surface iodide content exceeding 5 mol % is unpreferable because development inhibition or chemical sensitization inhibition occurs. The surface iodide content can be measured by the ESCA (also called XPS) method (by which X-rays are emitted and photoelectrons emerging from the grain surface are spectrally measured).

An emulsion grain of the present invention consists primarily of (111) faces and (100) faces. The ratio which (111) faces occupy on the entire surface of an emulsion grain of the present invention is at least 70%.

In an emulsion grain of the present invention, portions where (100) faces appear are side faces of a tabular grain. The ratio of the area which (111) faces occupy on the surface of an emulsion grain to the area which (100) faces occupy on the grain surface is at least 3%, more preferably, 4% or more, and most preferably, 5% or more. If the ratio falls outside this range, the advantages of the present invention are difficult to obtain. The ratio of (100) faces can be controlled by referring to JP-A-2-298935 or JP-A-8-334850, the disclosures of which are incorporated herein by reference. The (100) face ratio can be calculated by a method using the difference in adsorption dependence between (111) and (100) faces in the adsorption of a sensitizing dye, e.g., a method described in T. Tani, J. Imaginig Sci., 29, 165 (1985).

In emulsion grains of the present invention, 80% or more of the total number of grains are accounted for by tabular grains in which the area ratio of (100) faces in side faces of the grains is preferably 25% or more, more preferably, 40% or more, and most preferably, 50% or more. The area ratio of (100) faces in side faces of tabular grains can be calculated by a method described in, e.g., JP-A-8-334850.

That is, letting Cub be the ratio of the area which (111) faces occupy on the surface of an emulsion grain to the area which (100) faces occupy on the grain surface, an area ratio ECud of (100) faces in side faces of a tabular grain is $$Cub\times(ECD+2t)/2t$$

where

ECD: average equivalent-circle diameter ($\mu$m)

t: average grain thickness ($\mu$m)

More specifically, the (100) face ratio is controlled by controlling the pAg, halogen composition, silver halide solvent concentration, and pH during the formation of silver halide grains, or by using a compound represented by formula (I) below.

$$YO(CH_2CH_2O)_m(CH(CH_3)CH_2O)_p(CH_2CH_2O)_nY \qquad \text{Formula (I)}$$

In formula (I), Y represents a hydrogen atom, —$SO_3M$, or —COBCOOM, M represents a hydrogen atom, an alkali metal atom, an ammonium group, or an alkyl-substituted ammonium group having 5 or less carbon atoms, B represents a chainlike or cyclic group for forming an organic dibasic acid, each of m and n represents an integer of 0 to 50, and p represents an integer of 1 to 100.

A tabular grain of the present invention preferably has dislocation lines inside the grain. Introduction of dislocation lines into a tabular grain will be described below.

A dislocation line is a linear lattice defect at the boundary between a region already slipped and a region not slipped yet on a slip plane of crystal. Dislocation lines in a silver halide crystal are described in, e.g., 1) C. R. Berry. J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Photo. Sci. Jap., 34, 16 (1971); and 5) T. Shiozawa, J. Soc. Phot. Sci. Jap., 35, 213 (1972). Dislocation lines can be analyzed by an X-ray diffraction method or a direct observation method using a low-temperature transmission electron microscope. In direct observation of dislocation lines using a transmission electron microscope, silver halide grains, extracted carefully from an emulsion so as not to apply a pressure by which dislocation lines are produced in the grains, are placed on a mesh for electron microscopic observation. While the sample is cooled in order to prevent damage (e.g., print out) due to electron rays, the observation is performed by a transmission method.

In this case, as the thickness of a grain increases, it becomes more difficult to transmit electron rays through it. Therefore, grains can be observed more clearly by using an electron microscope of high voltage type (200 kV or more for a thickness of 0.25 $\mu$m).

Effects that dislocation lines have on photographic properties are described in G. C. Farnell, R. B. Flint, J. B. Chanter, J. Phot. Sci., 13, 25 (1965). This literature demonstrates that in a large tabular silver halide grain with a high aspect ratio, a location at which a latent image nucleus is formed is closely related to a defect in the grain. For example, U.S. Pat. Nos. 4,806,461, 5,498,516, 5,496,694, 5,476,760, and 5,567,580, and JP-A's-4-149541 and 4-149737, the disclosures of which are incorporated herein by reference, describe techniques to introduce dislocation lines into silver halide grains by controlling the introduction. Compared to tabular grains having no dislocation lines, tabular grains into which dislocation lines are introduced by these patents have superior photographic characteristics such as sensitivity and resistance to pressure. In the present invention, the use of emulsions described in these patents and the like is preferable.

In the present invention, dislocation lines are preferably introduced into a tabular grain as follows. That is, dislocation lines are introduced by the epitaxial growth of a silver halide phase containing silver iodide to a tabular grain (also called a host grain) as a substrate and the formation of a silver halide shell after that.

The silver iodide content of the host grain is preferably 0 to 15 mol %, more preferably, 0 to 12 mol %, and most preferably, 0 to 10 mol %. However, this silver iodide content can be selected in accordance with the intended use. A silver iodide content exceeding 15 mol % is unpreferable because the developing speed generally lowers.

The silver iodide content in the composition of the silver halide phase epitaxially grown on the host grain is preferably as high as possible. Although this silver halide phase to be epitaxially grown can be any of silver iodide, silver iodobromide, silver bromochloroiodide, and silver iodochloride, it is preferably silver iodide or silver iodobromide, and more preferably, silver iodide. When the silver halide phase is silver iodobromide, the silver iodide (iodide ion) content is preferably 1 to 45 mol %, more preferably, 5 to 45 mol %, and most preferably, 10 to 45 mol %. This silver iodide content is preferably as high as possible to form a misfit necessary to introduce dislocation lines. However, 45 mol % is the solid solution limit of silver iodobromide.

The amount of halogen added to form this high-silver-iodide-content phase to be epitaxially grown on the host grain is preferably 2 to 15 mol %, more preferably, 2 to 10 mol %, and most preferably, 2 to 5 mol % of the silver amount of the host grain. If the halogen amount is less than 2 mol %, dislocation lines are difficult to introduce. If the halogen amount exceeds 15 mol %, the developing speed lowers.

This high-silver-iodide-content phase is preferably 5 to 60 mol %, more preferably, 10 to 50 mol %, and most preferably, 20 to 40 mol %, of the silver amount of the whole grain after the grain is formed. An amount less than 5 mol % or exceeding 60 mol % is unpreferable because it is difficult to increase the sensitivity by the introduction of dislocation lines.

Also, this high-silver-iodide-content phase can be formed in any portion on the host grain, i.e., it can cover the host grain or can be formed only in a particular portion. It is preferable to control the positions of dislocation lines in a grain by selecting a particular portion and epitaxially growing the phase.

In the present invention, the high-silver-iodide-content phase is most preferably formed on side faces and/or corners of a host tabular grain. In this formation, it is possible to freely choose the composition and addition method of a halide to be added and the temperature, pAg, solvent concen- tration, gelatin concentration, and ionic strength of a reaction solution. The high-silver-iodide-content phase in a grain can be measured by an analytical electron microscope described in, e.g., JP-A-7-219102.

When this high-silver-iodide-content phase is formed on the host grain in the present invention, it is possible to preferably use, e.g., a method of adding a water-soluble iodide solution, such ad potassium iodide, singly or together with a water-soluble silver salt solution such as silver nitrate, a method of adding a silver halide containing silver iodide in the form of fine grains, or a method described in U.S. Pat. Nos. 5,498,516 or 5,527,664, the disclosers of which are incorporated herein by reference, by which iodide ions are released from an iodide ion-releasing agent by the reaction with alkali or a nucleophilic agent.

After this high-silver-iodide-content phase is epitaxially grown on the host grain, dislocation lines are introduced when a silver halide shell is formed outside the host tabular grain. Although the composition of this silver halide shell can be any of silver bromide, silver iodobromide, and silver bromochloroiodide, it is preferably silver bromide or silver iodobromide.

When the silver halide shell is silver iodobromide, the silver iodide content is preferably 0.1 to 12 mol %, more preferably, 0.1 to 10 mol %, and most preferably, 0.1 to 3 mol %.

If this silver iodide content is less than 0.1 mol %, it is difficult to obtain the advantages of enhancing dye adsorption and promoting development. If the silver iodide content exceeds 12 mol %, the developing speed generally lowers.

A silver amount used in the growth of this silver halide shell is preferably 10 to 50 mol %, and more preferably, 20 to 40 mol % of the total grain silver amount.

In the process of introducing dislocation lines described above, the temperature is preferably 30 to 80° C., more preferably, 35 to 75° C., and most preferably, 35 to 60° C. Temperature control at low temperatures less than 30° C. or at high temperatures exceeding 80° C. requires a high performance manufacturing apparatus, and this is unfavorable for the manufacture. In the above dislocation line introducing process, the pAg is preferably 6.4 to 10.5.

In the case of tabular grains, the positions and the number of dislocation lines of each grain viewed in a direction perpendicular to its major surfaces can be obtained from a photograph of the grain taken by using an electron microscope. Dislocation lines are preferably introduced into a tabular grain of the present invention as limitedly as possible to a fringe portion of the grain. In the present invention, the fringe portion is the peripheral region of a tabular grain. More specifically, in the distribution of silver iodide from the edge to the center of a tabular grain, the fringe portion is a region outside a certain point at which the silver iodide content exceeds or becomes lower than the average silver iodide content of the whole grain for the first time when viewed from the edge.

In the present invention, it is preferable to introduce dislocation lines at high density into the fringe portion of a tabular grain. The fringe portion of a tabular grain has preferably 10 or more dislocation lines, more preferably, 30 or more dislocation lines, and most preferably, 50 or more dislocation lines. When dislocation lines are densely present or cross each other, it is sometimes impossible to accurately count the dislocation lines per grain. Even in these situations, however, dislocation lines can be roughly counted to such an extent as in units of 10 lines such as 10, 20, or 30 dislocation lines.

The distribution of dislocation line amounts between tabular grains of the present invention is preferably uniform in respect of the homogeneity between the grains. In an emulsion of the present invention, tabular grains containing 10 or more dislocation lines per grain in their fringe portions account for preferably 50% or more, and more preferably, 80% or more of the total number of grains. If the ratio is less than 50%, high sensitivity is difficult to obtain.

Also, in the present invention tabular silver halide grains containing 30 or more dislocation lines per grain account for preferably 50% or more, and more preferably, 80% or more of the total number of grains.

Furthermore, in tabular silver grains of the present invention, the positions where dislocation lines are introduced are desirably uniform. In an emulsion of the present invention, tabular silver halide grains in which dislocation lines localize only to substantially fringe portions of the grains account for preferably 50% or more, more preferably, 60% or more, and most preferably, 80% or more of the total number of grains.

In this specification, "only to substantially grain fringe portions" means that a portion other than the grain fringe portion, i.e., a grain central portion, does not contain 5 or more dislocation lines. The grain central portion is an inside region surrounded by the fringe region when a grain is viewed in a direction perpendicular to its major surfaces.

To obtain the ratio of grains containing dislocation lines and the number of dislocation lines in the present invention, it is preferable to directly observe dislocation lines of at least 100 grains, more preferably, 200 grains, and most preferably, 300 grains.

In an emulsion of the present invention, 50% or more of the total number of grains are accounted for by tabular grains in which the average silver iodide content of the grain fringe portion is higher by preferably 2 mol % or more, more preferably, 4 mol % or more, and most preferably, 5 mol % or more than the average silver iodide content of the grain central portion.

The silver iodide content in a tabular grain can be obtained by, e.g., the method described in JP-A-7-219102 by using an analytical electron microscope.

Furthermore, a tabular grain of the present invention has an electron-capturing zone. The electron-capturing zone is a portion in which the concentration of an electron-capturing center compound (to be simply referred to as an "electron-capturing center" or a "metal complex" hereinafter) is $1\times10^{-5}$ to $1\times10^{-3}$ mol/mol local silver and which accounts for 5% to 40% of the grain volume. The concentration of the electron-capturing center is more preferably $5\times10^{-5}$ to $5\times10^{-4}$ mol/mol local silver. "Mol/mol local silver" used to define the concentration of an electron-capturing center is the concentration of an electron-capturing center with respect to a silver amount added simultaneously with the compound serving as the electron-capturing center.

The electron-capturing center concentration in the electron-capturing zone must be uniform. Uniform means that the electron-capturing center is introduced into a grain by a fixed amount per unit silver amount and that the electron-capturing center is introduced into a reaction vessel for grain formation at the same time silver nitrate used in grain formation is added. A halogen solution can also be simultaneously added. A compound serving as the electron-capturing center can be added as an aqueous solution. Alternatively, fine grains in which a compound serving as the electron-capturing center is doped or adsorbed can be prepared and added.

The electron-capturing zone can exist in any portion in a grain. Also, two or more electron-capturing zones can exist in a grain.

The electron-capturing center required to form the electron-capturing zone is represented by the following formulas:

$$\{M(CN)_{x1}L_{(6-x1)}\}^{n+} \quad \text{Formula (I)}$$

$$\{M(CN)_{x2}L_{(4-x2)}\}^{n+} \quad \text{Formula (II)}$$

$$\{ML1_{x2}X_{(6-2x3)}\}^{n+} \quad \text{Formula (III)}$$

$$\{ML1_{(6-3i)\times1/3}L2_iX_{(6-3i)\times1/3}\}^{n+} \quad \text{Formula (IV)}$$

wherein M represents an arbitrary metal or metal ion, and L represents a compound having chainlike or cyclic hydrocarbon as a parent body or a compound in which some carbon or hydrogen atoms of this parent structure are replaced by other atoms or atomic groups. L can be the same compound or different compounds. L1 represents an organic compound which bidentate-coordinates to a metal or metal ion, and L2 represents an organic compound which tridentate-coordinates to a metal or metal ion. x represents an arbitrary chemical species. x1 represents an integer of 0 to 6, x2 represents an integer of 0 to 4, x3 represents 2 or 3, and i represents 1 or 2.

$$\{L'_nM(L(ML'_m)_j)_k\}^p \quad \text{Formula (V)}$$

wherein M represents an arbitrary metal or metal ion. M can be the same metal species or different metal species. L is a crosslinking ligand and represents an organic compound capable of crosslinking two or more metals or metal ions. L' represents a non-charge small molecule which is $H_2O$, $NH_3$, CO, $N_2$, $NO_2$, $CO_2$, $SO_2$, $SO_3$, $N_2H_4$, $O_2$, or $PH_3$, an arbitrary organic compound, or an arbitrary inorganic anion, all of which can be the same chemical species or different chemical species. N represents an integer of 1 to 5, m represents an integer of 0 to 5, j represents an integer of 1 to 4, k represents an integer of 1 or more, and p represents the electric charge of the whole complex.

When a six-coordinate octahedral complex is incorporated as a dopant in a silver halide grain, a portion of the silver halide grain is presumably replaced with the dopant by using $[AgX_6]^{5-}$($X^{31}$ =halogen ion) in the grain as one unit, as described in many references such as J. Phys.: Condens. Matter 9 (1997) 3227–3240 and patent publications. Accordingly, if the molecular size of a complex to be doped is too large, this complex is probably unsuitable for a dopant. Also, as the electric charge of a complex to be doped deviates from −5, the complex presumably becomes disadvantageous for this replacement. From the consideration using a molecular model, when a complex to be doped has a 5- or 6-membered cyclic compound as a ligand, this complex presumably exceeds the size of a replacement unit in a silver halide grain, in the case of a silver chloride grain. However, it is considered that the complex is probably capable of being incorporated into a silver bromide grain because slight strain occurs in a lattice or in a complex molecule.

Preferable examples of a ligand are compounds such as pyrrole, pyrazole, imidazole, triazole, and tetrazole capable of having negative charge by removing $H^+$. The use of a derivative of such a compound as a ligand is also preferable. Examples of a substituent in the derivative are, preferably, a hydrogen atom, a substituted or nonsubstituted alkyl group (e.g., methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl, and methanesulfonylaminomethyl), an alkenyl group, an alkinyl group, an aralkyl group, a cycloalkyl group (e.g., cyclohexyl and 4-t-butylcyclohexyl), a substituted or nonsubstituted aryl group (phenyl, p-tolyl, p-anisyl, p-chlorophenyl, 4-t-butylphenyl, and 2,4-di-t-aminophenyl), halogen (fluorine, chlorine, bromine, and iodine), a cyano group, a nitro group, a mercapto group, a hydroxy group, an alkoxy group (e.g., methoxy, butoxy, methoxyethoxy, dodecyloxy, and 2-ethylhexyloxy), an aryloxy group (e.g., phenoxy, p-tolyloxy, p-chlorophenoxy, and 4-t-butylphenoxy), an alkylthio group, an arylthio group, an acyloxy group, a sulfonyloxy group, a substituted or nonsubstituted amino group (e.g., amino, methylamino, dimethylamino, anilino, and N-methylanilino), an ammonio group, a carbonamide group, a sulfonamide group, an oxycarbonylamino group, an oxysulfonylamino group, a substituted ureido group (e.g., 3-methylureido, 3-phenylureido, and 3,3-dibutylureido), a thioureido group, an acyl group (e.g., formyl and acetyl), an oxycarbonyl group, a substituted or nonsubstituted carbamoyl group (e.g., ethylcarbamoyl, dibutylcarbamoyl, dodecyloxypropylcarbamoyl, 3-(2,4-di-t-aminophenoxy) propylcarbamoyl, piperidinocarbonyl, and morpholinocarbonyl), a thiocarbonyl group, a thiocarbamoyl group, a sulfonyl group, a sulfinyl group, an oxysulfonyl group, a sulfamoyl group, a sulfino group, a sulfano group, carboxylic acid or its salt, sulfonic acid or its salt, and phosphonic acid or its salt.

A central metal of the electron-capturing center of the present invention is not particularly restricted. However, a metal having a four-coordinate structure or a six-coordinate structure as a coordination structure around the metal is preferable. Also, a metal or metal ion having no unpaired electron or a metal all stabilized orbits of which are filled with electrons when the d orbit of the metal causes ligand field fission, is preferable. Plus divalent (+2) metal ions are preferred among other metal ions. It is particular preferable to use metal ions of alkali earth metals, iron(II), ruthenium (II), osmium(II), zinc, cadmium, and mercury. The use of metal ions of magnesium, iron(II), ruthenium(II), and zinc is most preferred.

Practical examples of a metal complex of the present invention will be presented below. However, compounds of the invention are not limited to these examples.

| | |
|---|---|
| $\{Fe(CN)_6\}^{3-}$ | $\{Fe(CN)_5F\}^{3-}$ |
| $\{Fe(CN)_4F_2\}^{3-}$ | $\{Fe(CN)_5Cl\}^{3-}$ |
| $\{Fe(CN)_4Cl_2\}^{3-}$ | $\{Fe(CN)_5Br\}^{3-}$ |
| $\{Fe(CN)_4Br_2\}^{3-}$ | $\{Fe(CN)_5(SCN)\}^{3-}$ |
| $\{Fe(CN)_5(SCN)\}^{3-}$ | $\{Fe(CN)_5(NO)\}^{3-}$ |
| $\{Fe(CN)_5(H_2O)\}^{2-}$ | $\{Fe(CN)_6\}^{4-}$ |
| $\{Fe(CN)_5F\}^{4-}$ | $\{Fe(CN)_4F_2\}^{4-}$ |
| $\{Fe(CN)_5Cl\}^{4-}$ | $\{Fe(CN)_4Cl_2\}^{4-}$ |
| $\{Fe(CN)_5Br\}^{4-}$ | $\{Fe(CN)_4Br_2\}^{4-}$ |
| $\{Fe(CN)_5(SCN)\}^{4-}$ | $\{Fe(CN)_5(SCN)\}^{4-}$ |
| $\{Fe(CN)_5(NO)\}^{4-}$ | $\{Fe(CN)_5(H_2O)\}^{3-}$ |
| $\{Fe(CN)_5(PZ)\}^{3-}$ | $\{Fe(CN)_4(PZ)_2\}^{2-}$ |
| $\{Fe(CN)_5(Im)\}^{3-}$ | $\{Fe(CN)_4(Im)_2\}^{2-}$ |
| $\{Fe(CN)_5(trz)\}^{3-}$ | $\{Fe(CN)_4(trz)_2\}^{2-}$ |
| $\{Ru(CN)_6\}^{4-}$ | $\{Ru(CN)_5F\}^{4-}$ |
| $\{Ru(CN)_4F_2\}^{4-}$ | $\{Ru(CN)_5Cl\}^{4-}$ |
| $\{Ru(CN)_4Cl_2\}^{4-}$ | $\{Ru(CN)_5Br\}^{4-}$ |
| $\{Ru(CN)_4Br_2\}^{4-}$ | $\{Ru(CN)_5I\}^{4-}$ |
| $\{Ru(CN)_4I_2\}^{4-}$ | $\{Ru(CN)_5(SCN)\}^{4-}$ |
| $\{Ru(CN)_5(SCN)\}^{4-}$ | $\{Ru(CN)_5(NO)\}^{4-}$ |
| $\{Ru(CN)_5(H_2O)\}^{3-}$ | $\{Ru(CN)_4(PZ)_2\}^{2-}$ |
| $\{Ru(CN)_5(PZ)\}^{3-}$ | $\{Ru(CN)_4(Im)_2\}^{2-}$ |
| $\{Ru(CN)_5(Im)_2\}^{3-}$ | $\{Ru(CN)_4(trz)_2\}^{2-}$ |
| $\{Ru(CN)_5(trz)\}^{3-}$ | |
| $\{Re(CN)_5F\}^{4-}$ | $\{Re(CN)_6\}^{4-}$ |
| $\{Re(CN)_5Cl\}^{4-}$ | $\{Re(CN)_4F_2\}^{4-}$ |
| $\{Re(CN)_5Br\}^{4-}$ | $\{Re(CN)_4Cl_2\}^{4-}$ |
| $\{Re(CN)_5I\}^{4-}$ | $\{Re(CN)_4Br_2\}^{4-}$ |
| $\{Re(CN)_4I_2\}^{4-}$ | |
| $\{Os(CN)_6\}^{4-}$ | $\{Os(CN)_5F\}^{4-}$ |
| $\{Os(CN)_4F_2\}^{4-}$ | $\{Os(CN)_5Cl\}^{4-}$ |
| $\{Os(CN)_4Cl_2\}^{4-}$ | $\{Os(CN)_5Br\}^{4-}$ |
| $\{Os(CN)_4Br_2\}^{4-}$ | $\{Os(CN)_5I\}^{4-}$ |
| $\{Os(CN)_4I_2\}^{4-}$ | $\{Os(CN)_5(SCN)\}^{4-}$ |
| $\{Os(CN)_5(SCN)\}^{4-}$ | $\{Os(CN)_5(NO)\}^{4-}$ |
| $\{Os(CN)_5(H_2O)\}^{3-}$ | $\{Os(CN)_4(PZ)_2\}^{2-}$ |
| $\{Os(CN)_5(PZ)\}^{3-}$ | $\{Os(CN)_4(Im)_2\}^{3-}$ |
| $\{Os(CN)_5(Im)\}^{3-}$ | $\{Os(CN)_4(trz)\}^{2-}$ |
| $\{Os(CN)_5(trz)\}^{3-}$ | |
| $\{Ir(CN)_5Cl\}^{3-}$ | $\{Ir(CN)_6\}^{3-}$ |
| $\{Ir(CN)_5Br\}^{3-}$ | $\{Ir(CN)_4Cl_2\}^{3-}$ |
| $\{Ir(CN)_5I\}^{3-}$ | $\{Ir(CN)_4Br_2\}^{3-}$ |
| $\{Ir(CN)_5(NO)\}^{3-}$ | $\{Ir(CN)_4I_2\}^{3-}$ |
| $\{Ir(CN)_5(H_2O)\}^{2-}$ | |
| $\{Pt(CN)_4\}^{2-}$ | $\{Pt(CN)_4Cl_2\}^{2-}$ |
| $\{Pt(CN)_4Br_2\}^{2-}$ | $\{Pt(CN)_4I_2\}^{2-}$ |
| $\{Au(CN)_4\}^{-}$ | $\{Au(CN)_2Cl_2\}^{2-}$ |

In the above metal complexes, PZ=pyrazole, Im=imidazole, and trz=triazole.

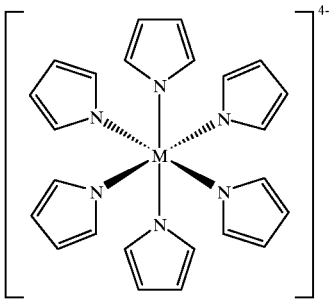

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

-continued

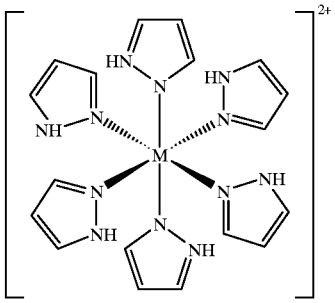

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

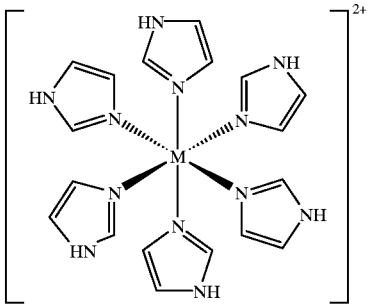

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

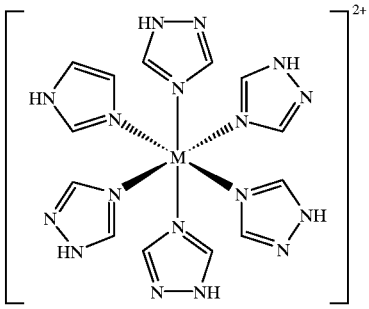

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

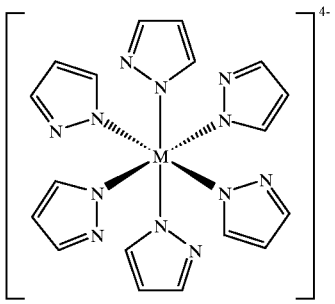

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

-continued

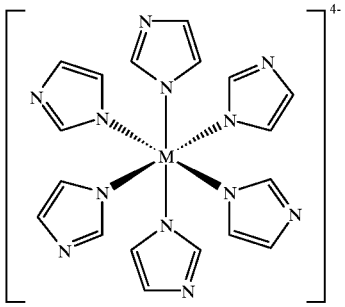

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

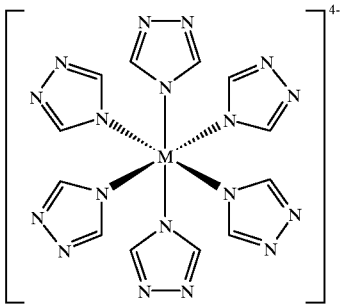

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

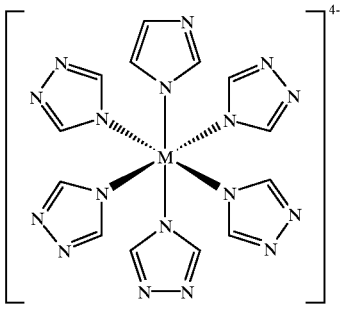

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

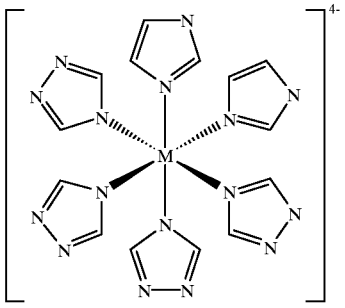

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

-continued

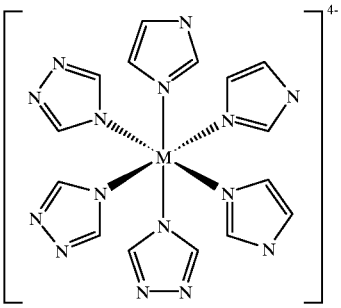

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

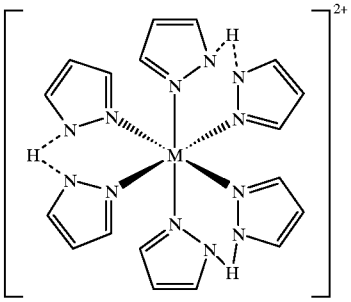

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

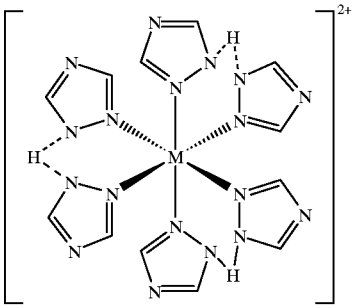

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

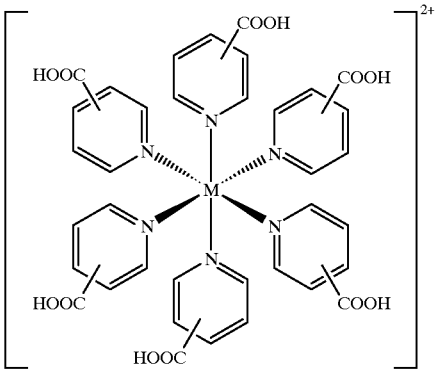

(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

-continued
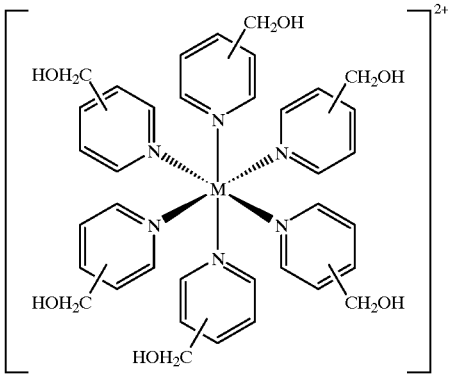
(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)
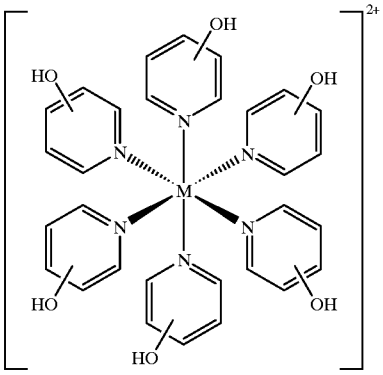
(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)
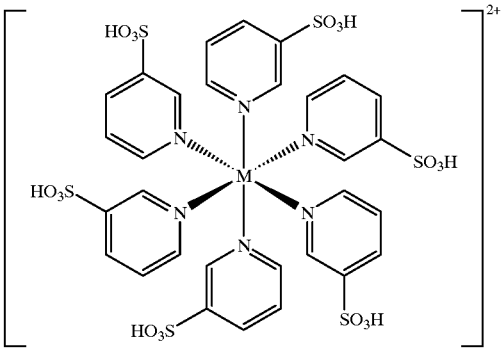
(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)
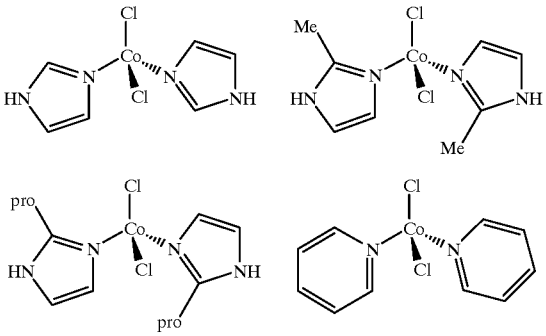
-continued
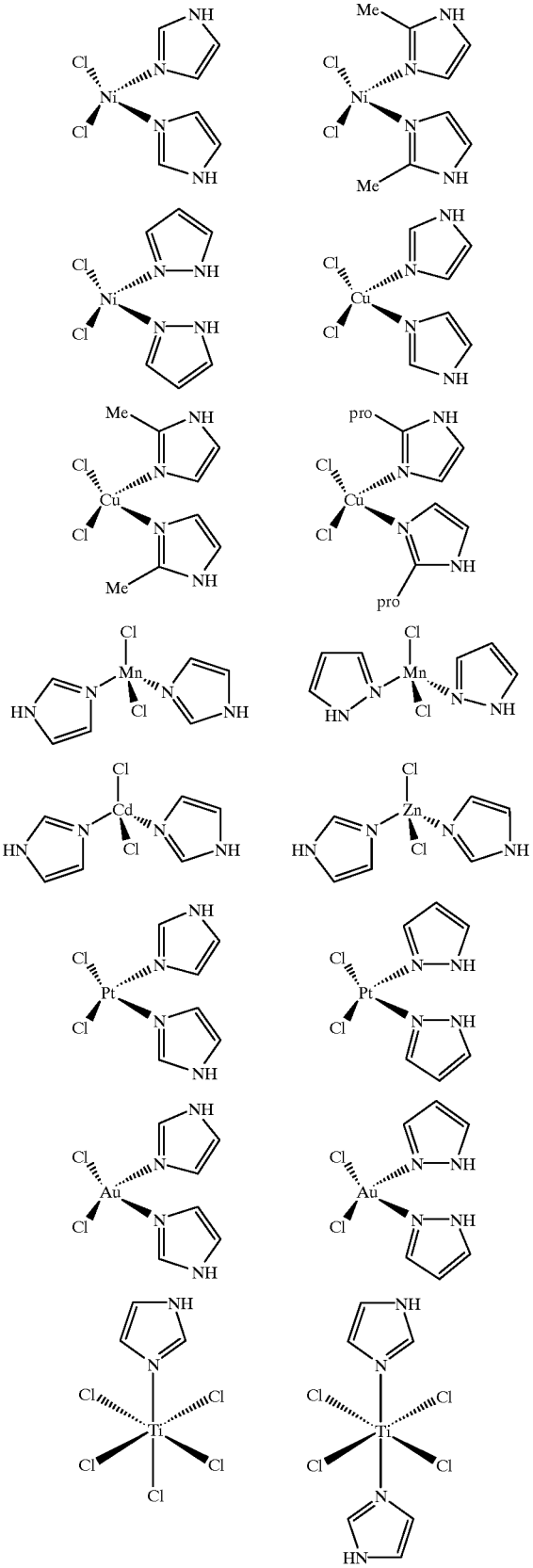

-continued
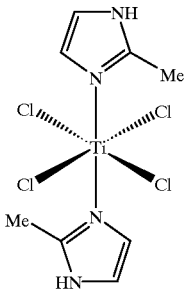
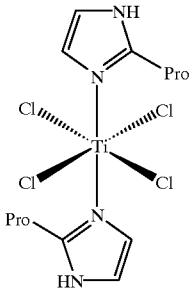
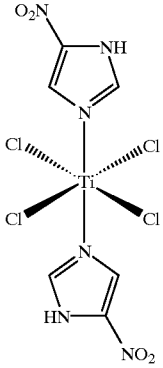
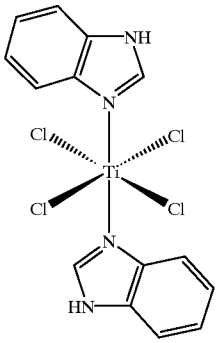
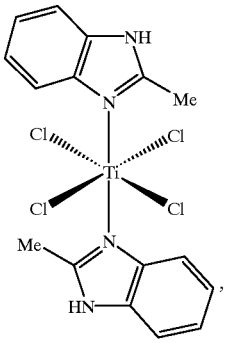
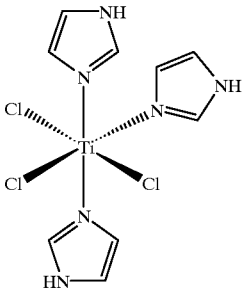
Me = methyl
Pro = propyl
(The same can be applied to below.)
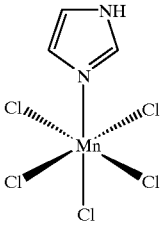
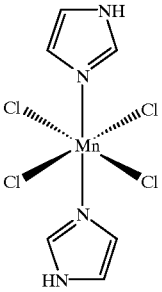
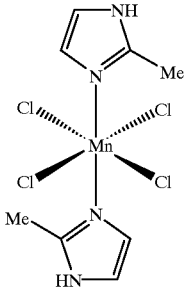
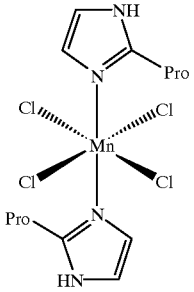
-continued
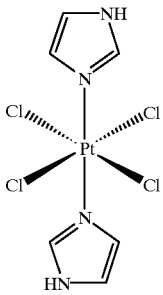
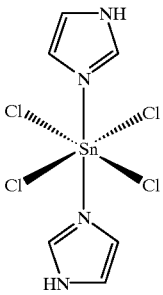
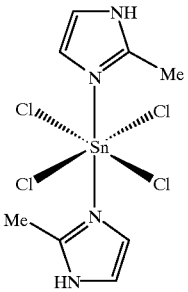
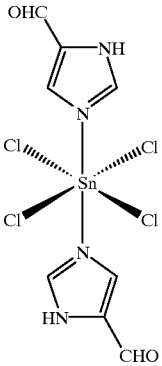
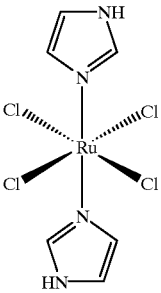
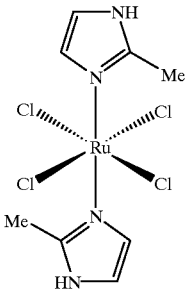
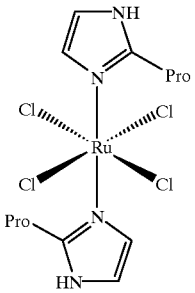
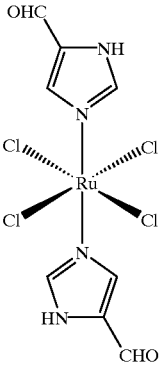
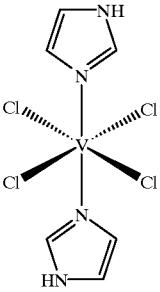
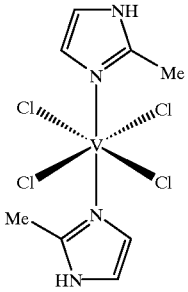

-continued

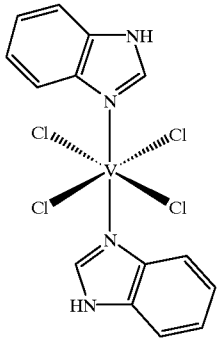

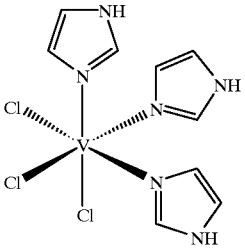

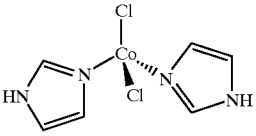

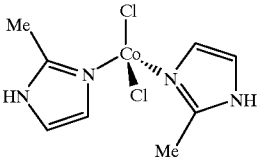

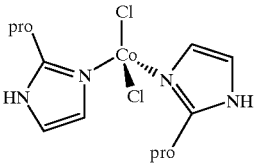

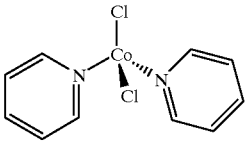

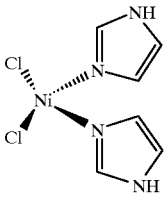

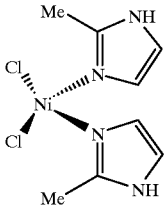

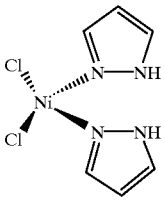

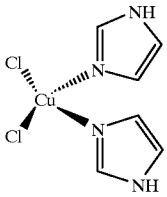

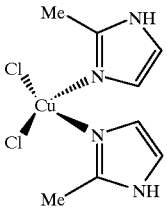

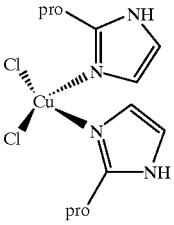

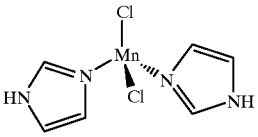

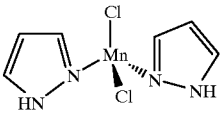

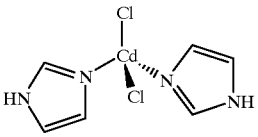

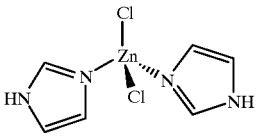

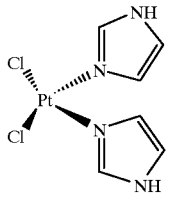

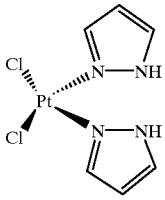

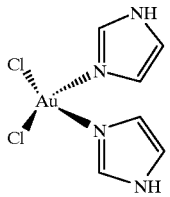

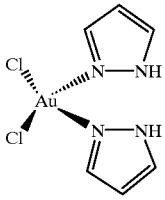

$[M(bpy)_3]^{2+}$
M = $Fe^{2+}$, $Ru^{2+}$, $Co^{2+}$
bpy = 2,2′-bipyridine $[M(phen)_3]^{2+}$
M = $Fe^{2+}$, $Ru^{2+}$, $Co^{2+}$
phen = 1, 10-phenanthroline $[M(py)_6]^{2+}$
M = $Fe^{2+}$, $Ru^{2+}$, $Co^{2+}$
py = pyridine $[M(trpy)_2]^{2+}$
M = $Fe^{2+}$, $Ru^{2+}$, $Co^{2+}$
trpy = 2,2′:5′,2-terpyridine $[M(bpy)_2L_2]^{n+}$
M = $Fe^{2+}$, $Ru^{2+}$, $Co^{2+}$
bpy = 2,2′-bipyridine
n = 2, 1, 0

$[M(bpy)_2LL']^{n+}$
M = $Fe^{2+}$, $Ru^{2+}$, $Co^{2+}$
bpy = 2,2′-bipyridine
n = 2, 1, 0

L = $Cl^-$, $CN^-$, $NH_3$, $H_2O$, CO, $H_2$, $CH_3CN$, 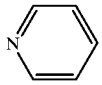

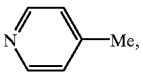

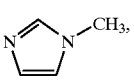

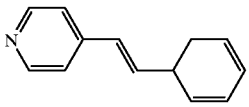

methyl-diphenyl-phosphine, butylamine

L, L′ = $Cl^-$, 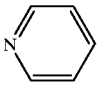

CN, 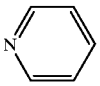

$CH_3CN$, $Cl^-$
CO, $Cl^-$
$H_2$, $Cl^-$ $[M(bpy)_2L]^{2+}$
M = $Fe^{2+}$, $Ru^{2+}$, $Co^{2+}$
bpy = 2,2′-bipyridine L = 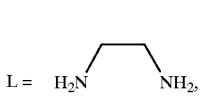

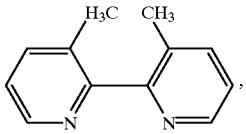

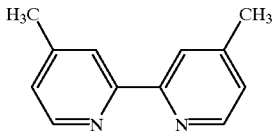

-continued
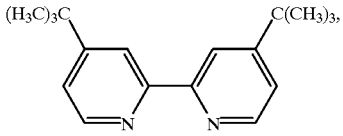
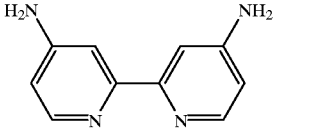
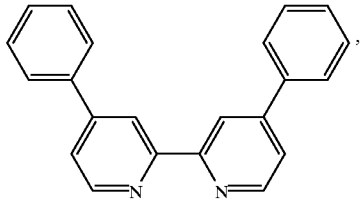
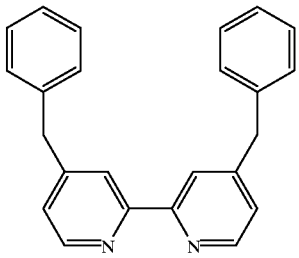
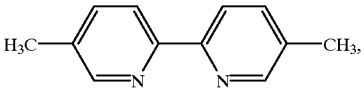
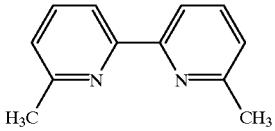
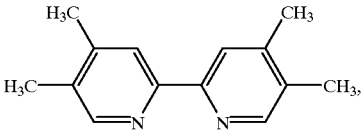
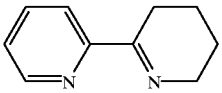
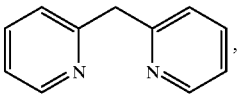
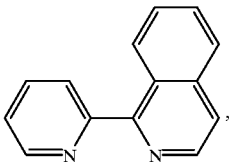
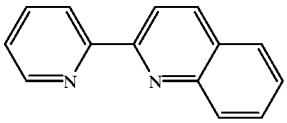
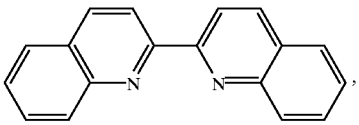
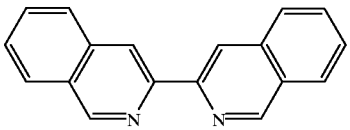
-continued
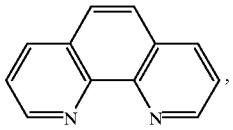
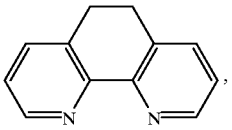
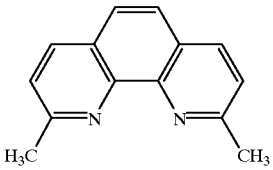
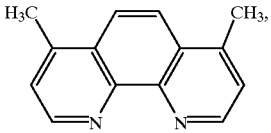
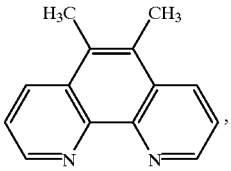
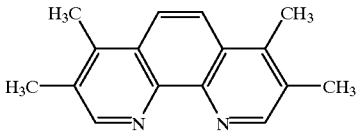
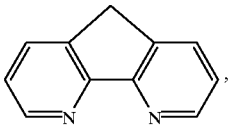
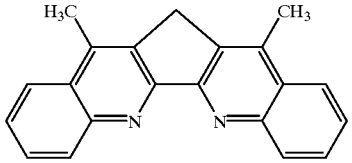
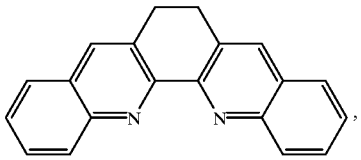
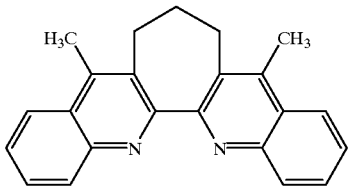
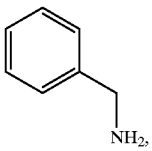
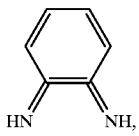
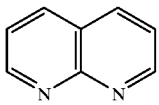
$[ML_2]^{2+}$
$M = Fe^{2+}, Ru^{2+}, Co^{2+}$ -continued

L =

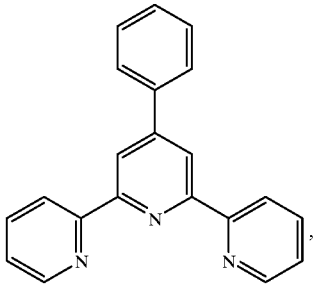

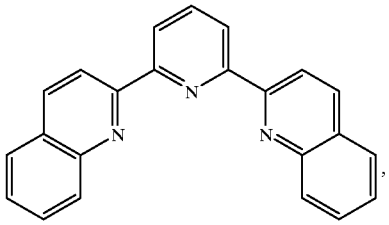

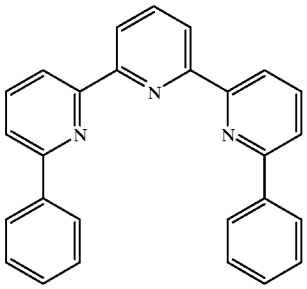

$[M(bpy)(phen)_2]^{2+}$
M = $Fe^{2+}$, $Ru^{2+}$, $Co^{2+}$
bpy = 2,2′-bipyridine
phen = 1,10-phenanthroline $[M(bpy)(phen)(py)]^{2+}$
M = $Fe^{2+}$, $Ru^{2+}$, $Co^{2+}$
bpy = 2,2′-bipyridine
phen = 1,10-phenanthroline
py = pyridine $[M(bpy)(py)(en)]^{2+}$
M = $Fe^{2+}$, $Ru^{2+}$, $Co^{2+}$
bpy = 2,2′-bipyridine
py = pyridine
en = ethylenediamine $[M(bpy)(py)(NH_3)]^{2+}$
M = $Fe^{2+}$, $Ru^{2+}$, $Co^{2+}$
bpy = 2,2′-bipyridine
py = pyridine $[M(bpy)(trpy)L]^{2+}$
M = $Fe^{2+}$, $Ru^{2+}$, $Co^{2+}$
bpy = 2,2′-bipyridine
trpy = 2,2′:5′2″-terpyridine
L = $Cl^-$, $CN^-$, $NH_3$

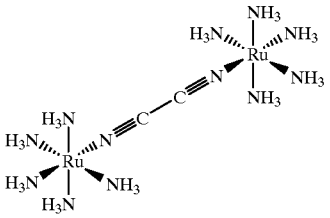

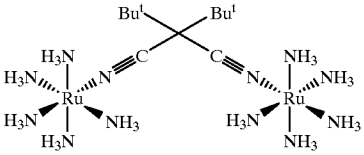

-continued

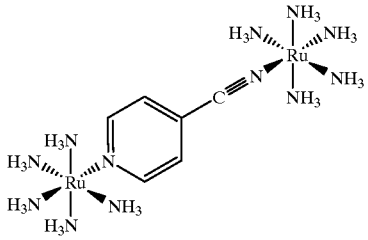

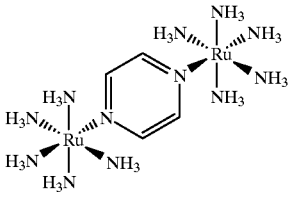

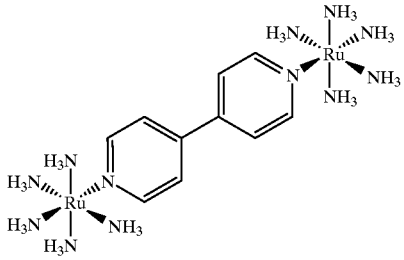

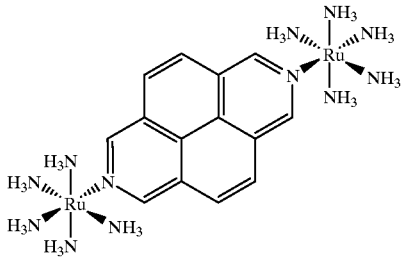

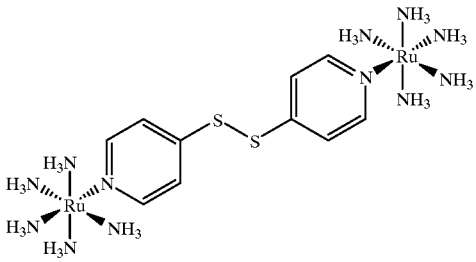

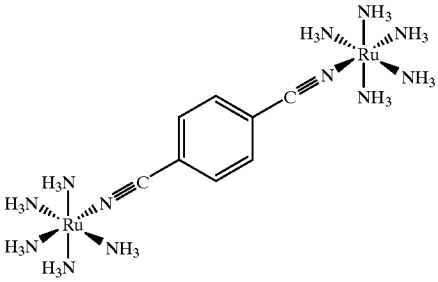

-continued
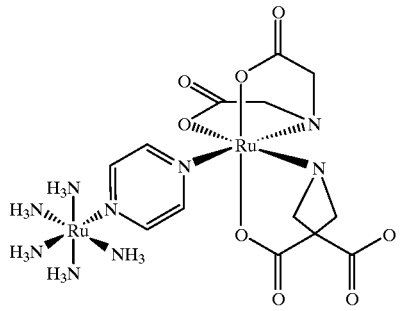
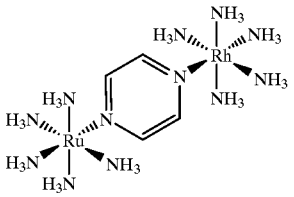
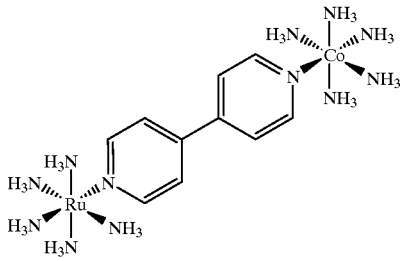
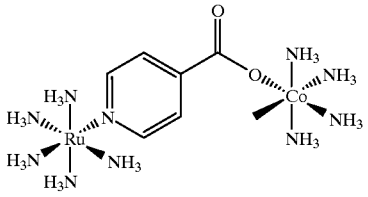
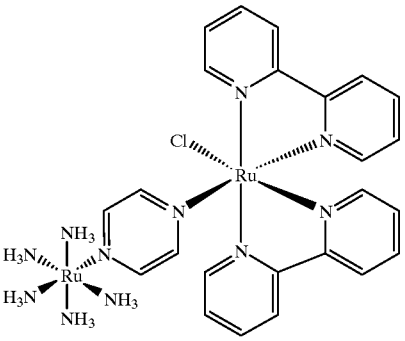
-continued
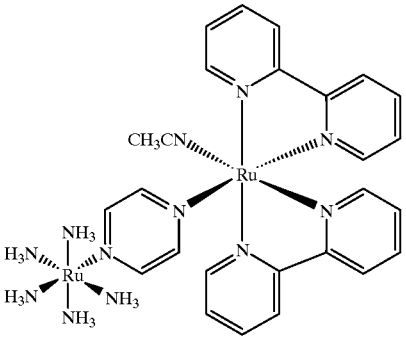
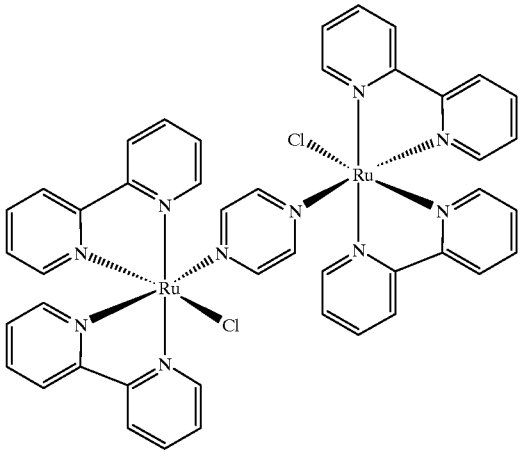
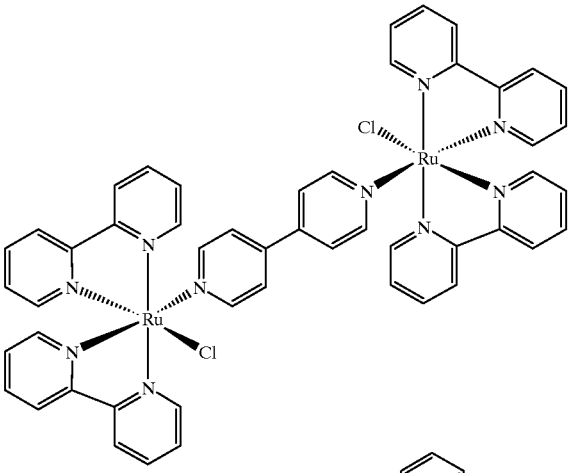
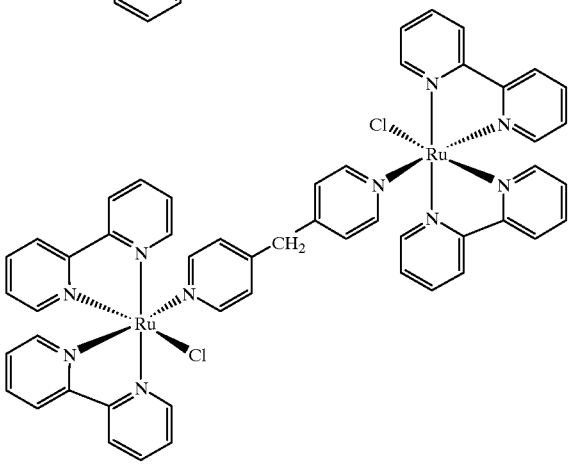

-continued
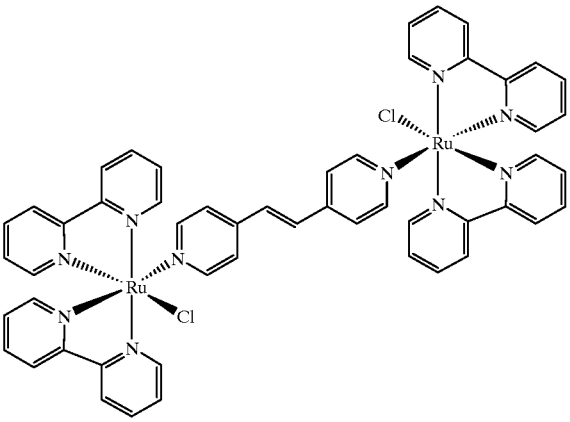
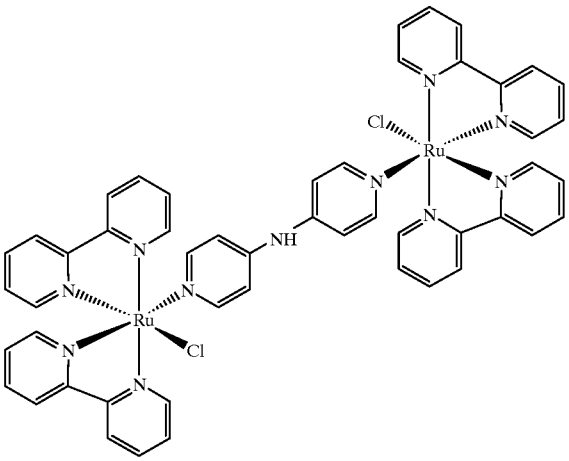
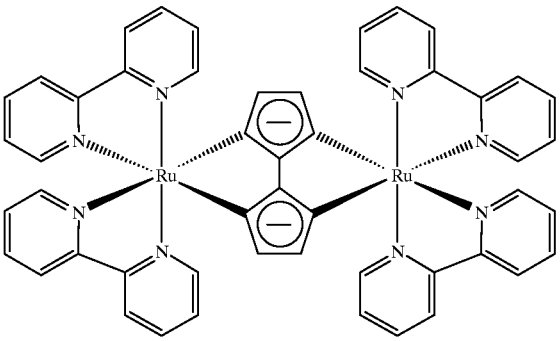
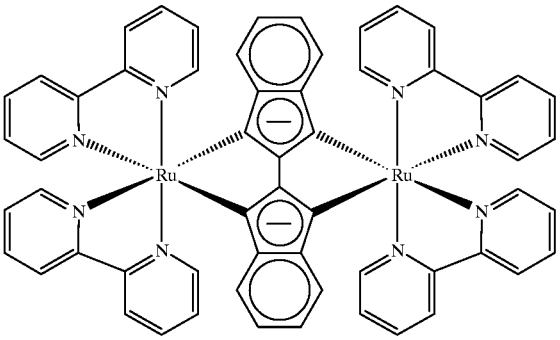
-continued
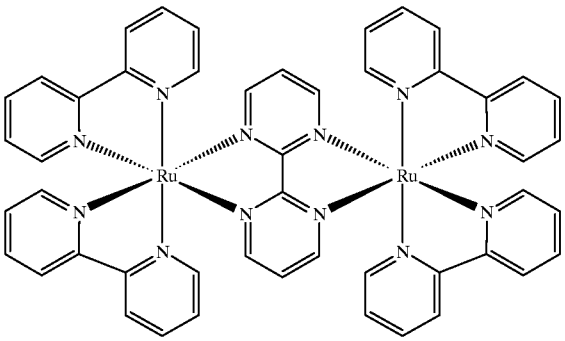
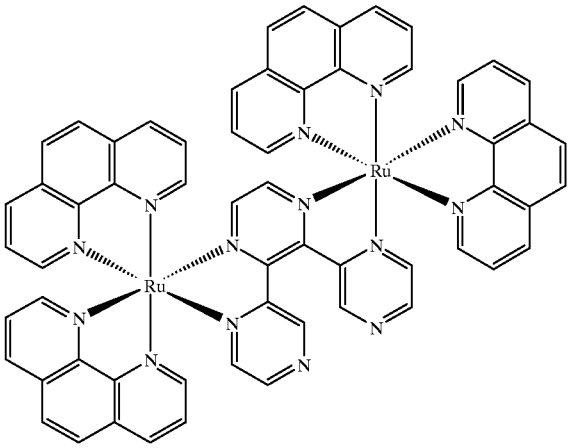
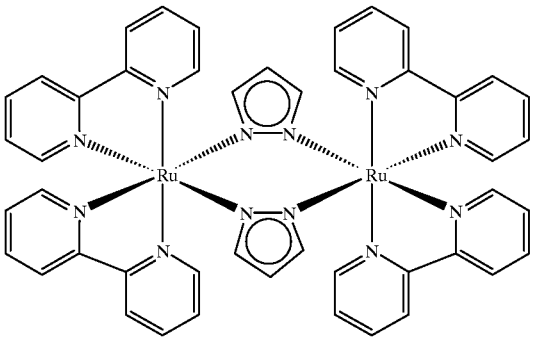
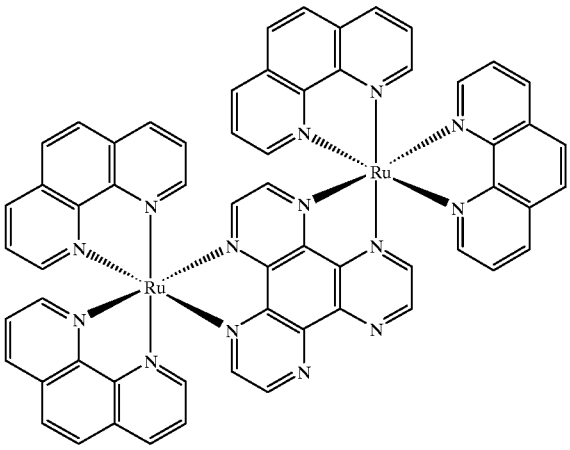

-continued
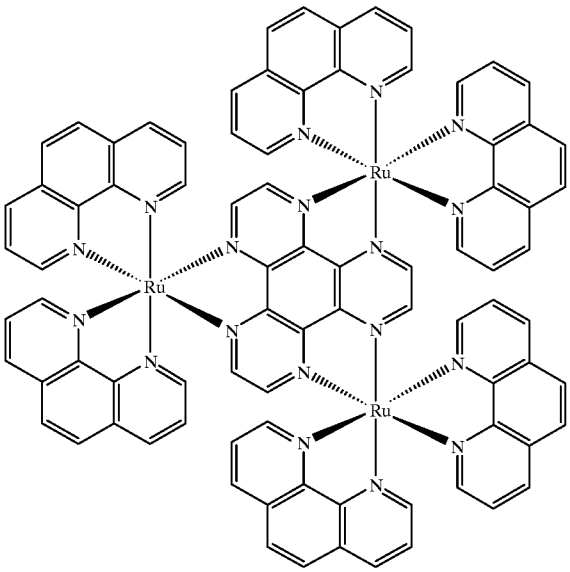
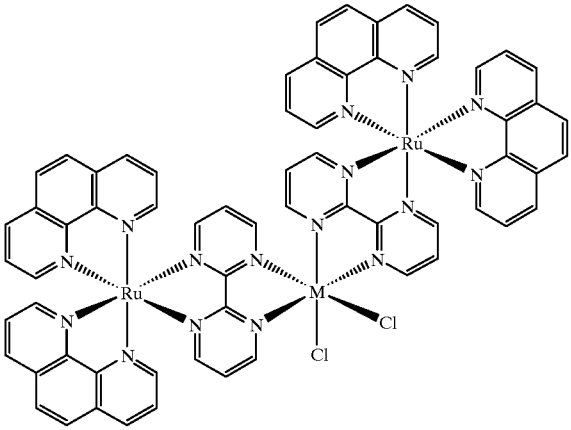
M = $Rh^{3+}$, $Ir^{3+}$
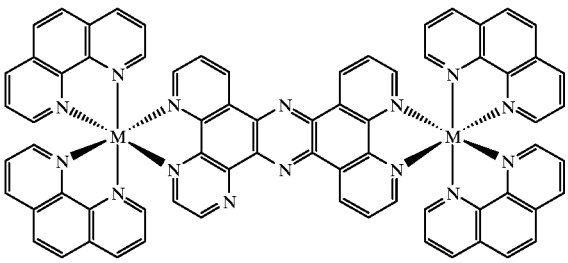
M′, M″ = Ru, Ru
Os, Os
Ru, Os
-continued
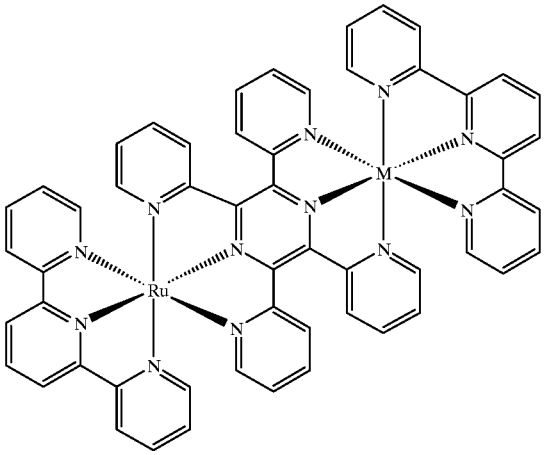
M = $Ru^{2+}$, $Os^{2+}$
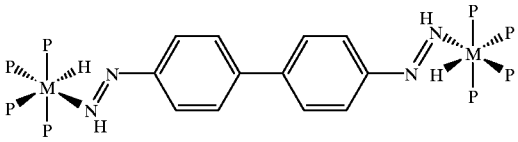
M = $Fe^{2+}$, $Ru^{2+}$; P = $P(OMe)_3$, $P(OEt)_3$
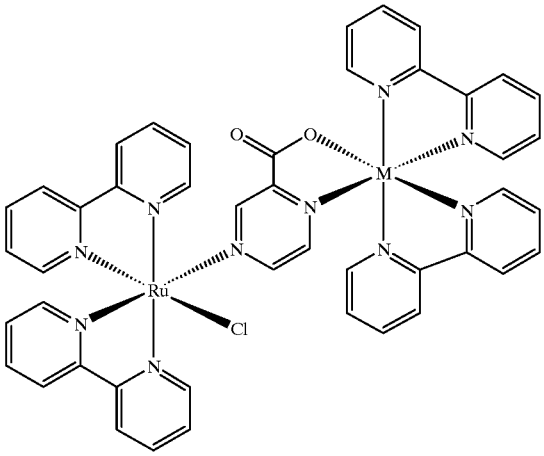
M = $Ru^{2+}$, $Os^{2+}$
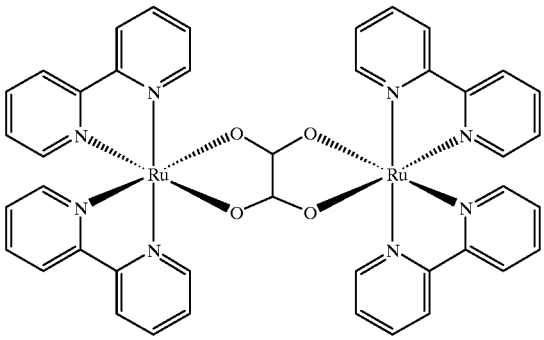
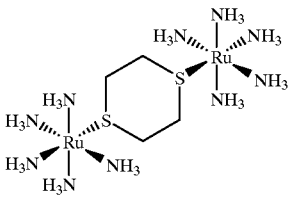

-continued
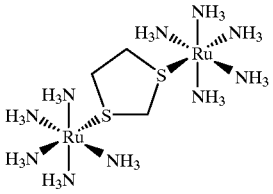
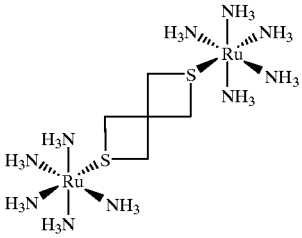
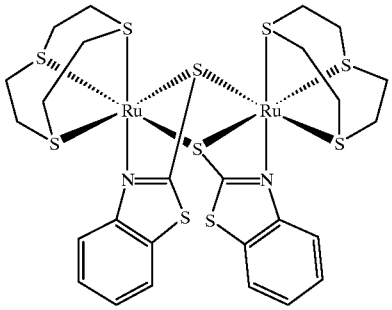
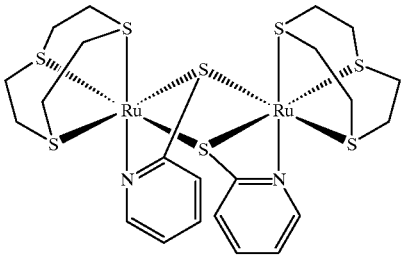
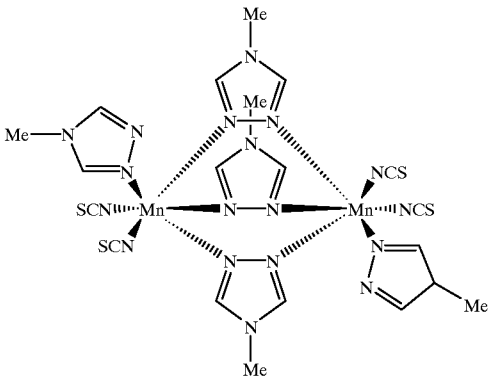
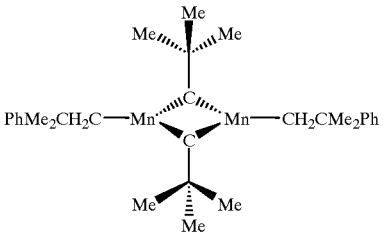
-continued
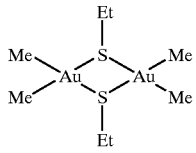
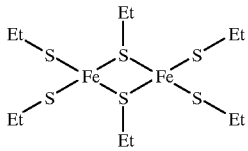
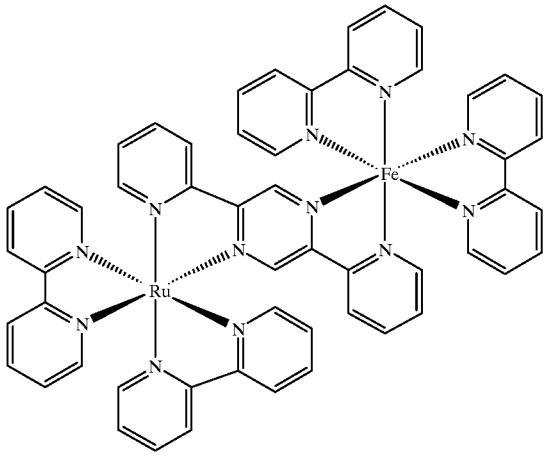
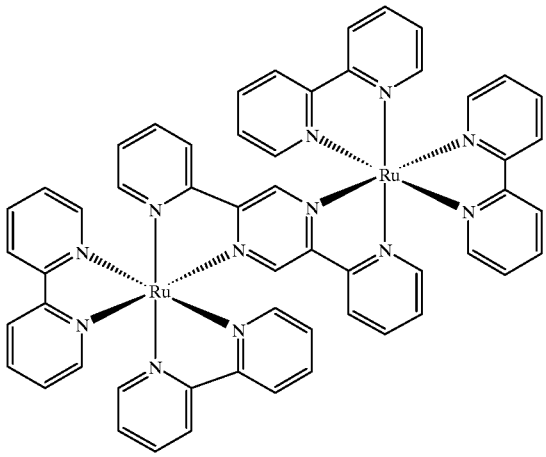
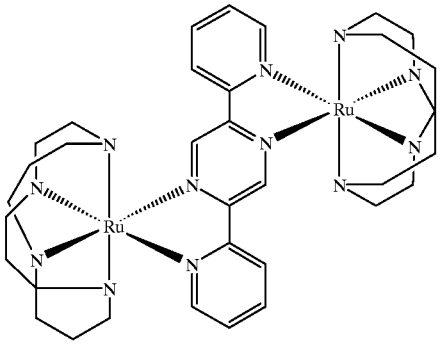
$H^+$ can be added to or removed from each ligand preferably used in the present invention.
In the present invention, a complex molecule completely dissociates from a counter ion and exists in the form of an anion or cation in an aqueous solution. Hence, a counter ion is not important for photographic properties. When a complex molecule becomes an anion and forms a salt together with a cation, this counter cation is preferably an alkali metal ion, such as sodium ion, potassium ion, rubidium ion, or cesium ion, ammonium ion, or alkyl ammonium ion represented by formula VI below, each of which easily dissolves in water and is suited to precipitation of a silver halide emulsion.

$$\{NR_1R_2R_3R_4\}^+ \qquad \text{Formula (VI)}$$

wherein each of $R_1$, $R_2$, $R_3$, and $R_4$ represents an arbitrary substituent selected from a methyl group, ethyl group, propyl group, iso-propyl group, and n-butyl group. In particular, tetramethylammonium ion, tetraethylammonium ion, tetrapropylammonium ion, and tetra(n-butyl) ammonium ion in which $R_1$, $R_2$, $R_3$, and $R_4$ are equal substituents are preferable. It is also preferable to use pyrazolium cation or imidazolium cation in which $H^+$ ion is added to a nitrogen atom not coordinated in a ligand as a counter cation.

When a complex molecule becomes a cation and forms a salt together with an anion, this counter anion is preferably a halogen ion, nitric acid ion, perchloric acid ion, tetrafluoroboric acid ion, hexafluorophosphoric acid ion, tetraphenylboric acid ion, hexafluorosilicic acid, or trifluoromethanesulfonic acid ion, suited to precipitation of a silver halide emulsion. If a strongly coordinating anion such as cyano ion, thiocyano ion, nitrous acid ion, or oxalic acid ion is used as a counter anion, it is highly likely that this counter anion causes a ligand exchange reaction with a halogen ion used as a ligand of a complex to make it impossible to hold the composition and structure of a complex of the present invention. Hence, the use of these anions is unpreferable.

A metal complex of the present invention can be synthesized by several methods. For example, a magnesium complex, an iron complex, and a zinc complex having pyrazole or imidazole as a ligand can be obtained by reacting the pyrazole or imidazole as a ligand with perchlorate or tetrafluoroborate of each metal in a dehydrated solvent. As practical synthesis examples, synthesizing methods of these complexes are described in Rec. Trav. Chim., 1969, 88, 1451. Also, a ruthenium-triazole complex can be synthesized by referring to the reaction of a ruthenium-triazole complex described in Inorg. Chim. Acta 1983, 71, 155.

In an emulsion of the present invention, the average surface iodide content of all grains is preferably 5 mol % or less. The surface iodide content can be measured by the ESCA (also called XPS) method (by which X-rays are emitted and photoelectrons emerging from the grain surface are spectrally measured). In the present invention, the surface iodide content is more preferably 4 mol % or less, and most preferably, 3 mol % or less.

Furthermore, a tabular grain of the present invention has 10 or more dislocation lines having a length of preferably 0.05 D or more, and more preferably, 0.1 D or more with respect to an equivalent-circle diameter, D.

Dislocation lines can be introduced by referring to, e.g., the description of examples in JP-A-3-175440, the discloser of which is incorporated herein by reference. Dislocation lines can be introduced to a fringe portion or only to the vicinities of corners of a grain. It is also preferable to introduce dislocation lines by using an iodide-releasing agent described in JP-A-6-258745, the discloser of which is incorporated herein by reference.

To particularly increase the length of dislocation lines, the use of a crystal phase-controlling agent is preferable. When a portion of a tabular grain where no dislocation lines are introduced is called a core and a portion where dislocation lines are introduced is called a shell, the length of dislocation lines can be controlled by allowing a crystal phase-controlling agent indicated by formula (VII) or (VIII) below to exist in the shell portion.

(VII)

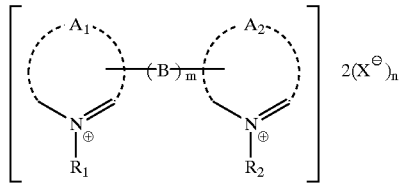

(VIII)

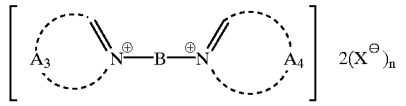

In formulas (VII) and (VIII), each of $A_1$, $A_2$, $A_3$, and $A_4$ represents a nonmetallic atomic group necessary to complete a nitrogen-containing heterocyclic ring, and these $A_1$, $A_2$, $A_3$, and $A_4$ can be the same or different. B represents a divalent coupling group. M represents 0 or 1. Each of $R_1$ and $R_2$ represents an alkyl group. $X^-$ represents an anion. n represents 0 or 1. In the case of an intramolecular salt, n is 0.

Formulas (VII) and (VIII) will be described in more detail below.

Each of $A_1$, $A_2$, $A_3$, and $A_4$ represents a nonmetallic atomic group for completing a nitrogen- containing heterocyclic ring and can contain an oxygen atom, nitrogen atom, or sulfur atom, and a benzene ring can be condensed. Heterocyclic rings formed by $A_1$, $A_2$, $A_3$, and $A_4$ can have substituents, and these substituents can be the same or different. Examples of the substituents are an alkyl group, aryl group, aralkyl group, alkenyl group, halogen atom, acyl group, alkoxycarbonyl group, aryloxycarbonyl group, sulfo group, carboxy group, hydroxy group, alkoxy group, aryloxy group, amide group, sulfamoyl group, carbamoyl group, ureido group, amino group, sulfonyl group, cyano group, nitro group, mercapto group, alkylthio group, and arylthio group. Preferable examples of $A_1$, $A_2$, $A_3$, and $A_4$ are 5- to 6-membered rings (e.g., a pyridine ring, imidazole ring, thiozole ring, oxazole ring, pyrazine ring, and pyrimidine ring). A more preferable example is a pyridine ring.

B represents a divalent coupling group. A divalent coupling group is one or the combination of alkylene, arylene, alkenylene, —$SO_2$—, —SO—, —O—, —S—, —CO—, and —N($R_3$)— ($R_3$ represents an alkyl group, aryl group, or hydrogen atom). B is preferably alkylene alkenylene.

Each of $R_1$ and $R_2$ represents a 1- to 20-carbon alkyl group. $R_1$ and $R_2$ can be the same or different. An alkyl group represents a substituted or nonsubstituted alkyl group, and substituents are similar to those enumerated above as the substituents of $A_1$, $A_2$, $A_3$, and $A_4$. Each of $R_1$ and $R_2$ represents preferably a 4- to 10-carbon alkyl group, and more preferably, a substituted or nonsubstituted aryl-substituted alkyl group.

$X^-$ represents an anion. Examples are chlorine ion, bromine ion, iodine ion, nitric acid ion, sulfuric acid ion, p-toluenesulfonate, and oxalato. N represents 0 or 1. In the case of an intramolecular salt, n is 0.

Practical examples of a compound represented by formula (VII) or (VIII) will be presented below, but the present invention is not limited to these compounds.

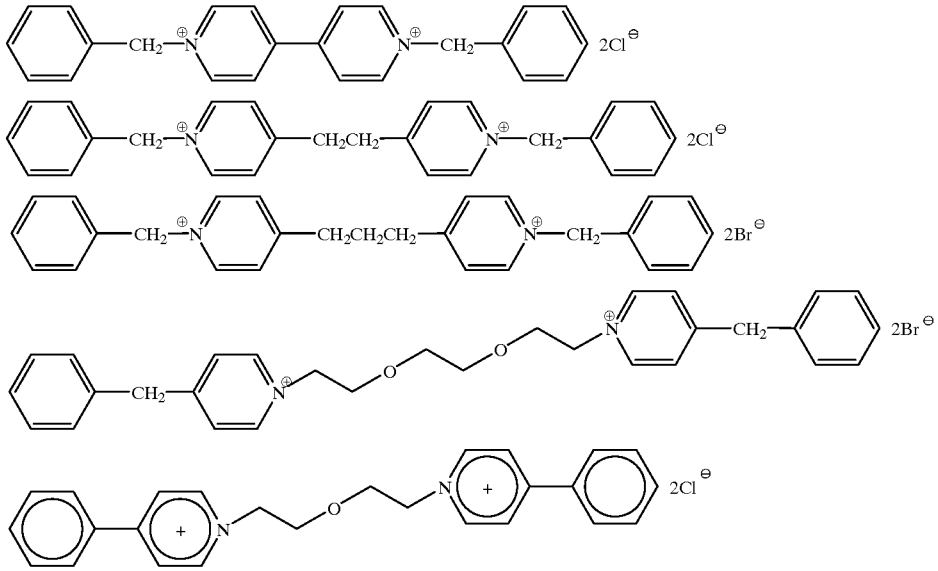

The description of JP-A-2-32, the disclosure of which is incorporated herein by reference, is a reference of compound examples represented by formula (VII) or (VIII).

In the present invention, the addition amount of a compound represented by formula (VII) or (VIII) can be $10^{-5}$ to $3\times10^{-1}$ mol and is most preferably $2\times10^{-4}$ to $1\times10^{-1}$ mol per mol of a silver halide.

It is also possible to use a crystal habit-controlling agent represented by formula (IX) below.

(IX)

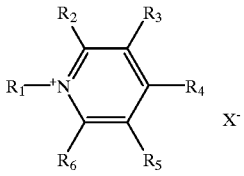

wherein $R_1$ represents an alkyl group, alkenyl group, or aralkyl group, and each of $R_2$, $R_3$, $R_4$, $R_5$, and $R_6$ represents a hydrogen atom or a group capable of substituting a hydrogen atom. $R_2$ and $R_3$, $R_3$ and $R_4$, $R_4$ and $R_5$, and $R_5$ and $R_6$ can be condensed. $X^-$ represents a counter anion.

Formula (IX) will be described in more detail below. In formula (IX), $R_1$ represents a 1- to 20-carbon straight-chain, branched, or cyclic alkyl group (e.g., methyl, ethyl, isopropyl, t-butyl, n-octyl, n-decyl, n-hexadecyl, cyclopropyl, cyclopentyl, or cyclohexyl), a 2- to 20-carbon alkenyl group (e.g., allyl, 2-butenyl, or 3-pentenyl), or a 7- to 20-carbon aralkyl group (e.g., benzyl or phenethyl). Each group represented by $R_1$ can be substituted. Examples of the substituent are groups capable of substitution represented by $R_2$ to $R_6$ below.

$R_2$, $R_3$, $R_4$, $R_5$, and $R_6$ can be the same or different, and each represents a hydrogen atom or a group capable of substituting a hydrogen atom.

Examples of the group capable of substitution are as follows.

A halogen atom (e.g., a fluorine atom, chlorine atom, and bromine atom), an alkyl group (e.g., methyl, ethyl, n-propyl, isopropyl, t-butyl, n-octyl, cyclopentyl, and cyclohexyl), an alkenyl group (e.g., allyl, 2-butenyl, and 3-pentenyl), an alkinyl group (e.g., propargyl and 3-pentinyl), an aralkyl group (e.g., benzyl and phenethyl), an aryl group (e.g., phenyl, naphthyl, and 4-methylphenyl), a heterocyclic group (e.g., pyridyl, furyl, imidazolyl, piperidyl, and morpholino), an alkoxy group (e.g., methoxy, ethoxy, and butoxy), an aryloxy group (e.g., phenoxy and 2-naphthyloxy), an amino group (e.g., nonsubstituted amino, dimethylamino, ethylamino, and anilino), an acylamino group (e.g., acetylamino and benzoylamino), an ureido group (e.g., nonsubstituted ureido, N-methylureido, and N-phenylureido), an urethane group (e.g., methoxycarbonylamino and phenoxycarbonylamino), a sulfonylamino group (e.g., methylsulfonylamino and phenylsulfonylamino), a sulfamoyl group (e.g., methylsulfonylamino and phenylsulfonylamino), a sulfamoyl group (e.g., nonsubstituted sulfamoyl, N,N-dimethylsulfamoyl, and N-phenylsulfamoyl), a carbamoyl group (e.g., nonsubstituted carbamoyl, N,N-diethylcarbamoyl, and N-phenylcarbamoyl), a sulfonyl group (e.g., mesyl and tosyl), a sulfinyl group (e.g., methylsulfinyl and phenylsulfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaloyl), an acyloxy group (e.g., acetoxy and benzoyloxy), an amide phosphate group (e.g., N,N-diethyl amide phosphate), an alkylthio group (e.g., methylthio and ethylthio), an arylthio group (e.g., phenylthio), a cyano group, a sulfo group, a carboxy group, a hydroxy group, a phosphono group, a nitro group, a sulfino group, an ammonio group (e.g., trimethylammonio), a phosphonio group, and a hydrazino group. These groups can be further substituted. If two or more substituents exist, these substituents can be the same or different.

$R_2$ and $R_3$, $R_3$ and $R_4$, $R_4$ and $R_5$, and $R_5$ and $R_6$ can be condensed to form a quinoline ring, isoquinoline ring, or acridine ring. $X^-$ represents a counter anion. Examples of this counter anion are a halogen ion (chloro ion and bromine ion), nitric acid ion, sulfuric acid ion, p-toluenesulfonic acid ion, and trifluoromethanesulfonic acid ion.

In formula (IX), $R_1$ preferably represents an aralkyl group, and at least one of $R_2$, $R_3$, $R_4$, $R_5$, and $R_6$ represents an aryl group. In formula (IX), $R_1$, $R_4$, and $X^-$ more preferably represent an aralkyl group, an aryl group, and a halogen ion, respectively.

Practical examples of a compound represented by formula (IX) will be presented below, but the present invention is not limited to these examples.

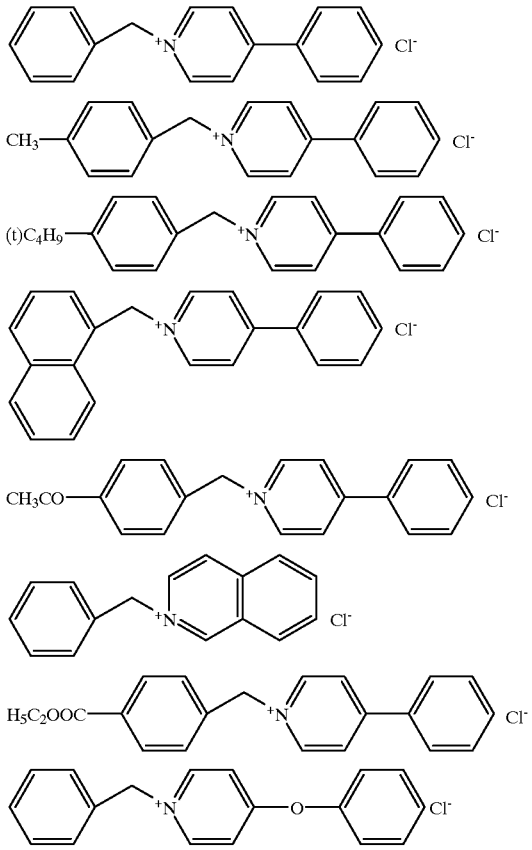

In the present invention, the addition amount of a compound represented by formula (IX) can be $10^{-5}$ to $10^{-1}$ mol and is particularly preferably $2\times10^{-4}$ to $1\times10^{-1}$ mol per mol of a silver halide.

Furthermore, a crystal habit-controlling agent represented by formula (X) below can be used.

(X)

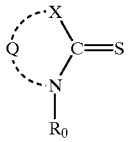

wherein x represents a sulfur atom or oxygen atom, preferably a sulfur atom. Q represents an atomic group necessary to complete a 5- or 6-membered heterocyclic ring. Examples are a thiazolidine-2-thione ring, 4-thiazoline-2-thione ring, 1,3,4-thiadiazoline-2-thione ring, benzthiazoline-2-tione ring, benzoxazoline-2-thione ring.

$R_0$ represents an alkyl group (e.g., methyl, ethyl, propyl, butyl, or octyl), an alkenyl group (e.g., allyl), an aralkyl group (e.g., benzyl or phenethyl), an aryl group (e.g., phenyl), or a heterocyclic moiety (e.g., pyridyl).

A heterocyclic ring represented by Q or $R_0$ can be nonsubstituted or further substituted. This substituent can be suitably selected from, e.g., a halogen atom, alkyl group, aryl group, alkoxy group, aryloxy group, sulfonyl group, sulfonamide group, amide group, acyl group, sulfamoyl group, carbamoyl group, ureido group, alkoxycarbonylamino group, aryloxycarbonylamino group, alkoxycarbonyl group, aryloxycarbonyl group, aminocarbonylthio group, alkylcarbonylthio group, arylcarbonylthio group, cyano group, hydroxy group, mercapto group, carboxyl group, sulfo group, nitro group, amino group, alkylthio group, arylthio group, and heterocyclic moiety.

Practical examples of a compound represented by formula (X) used in the present invention will be presented below. However, the scope of the present invention is not restricted to these examples.

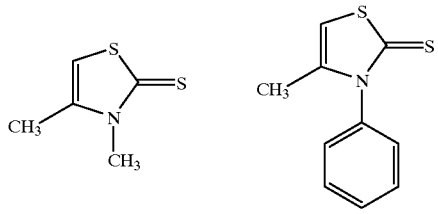

As a compound represented by formula (X), compounds described in JP-A-1-155332, the disclosure of which is incorporated herein by reference, can also be used.

In the present invention, the addition amount of a compound represented by formula (X) can be $2\times10^{-5}$ to $3\times10^{-1}$ mol and is particularly preferably $2\times10^{-4}$ to $3\times10^{-1}$ mol per mol of a silver halide.

Furthermore, a crystal habit-controlling agent represented by formula (XI) can be used.

(XI)

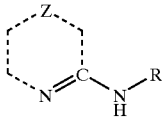

wherein z represents a group of atoms for forming a heterocyclic ring composed of six atoms together with C═N, which are selected from a carbon atom and a nitrogen atom. R is hydrogen, a monovalent amino substituent (e.g., hydrocarbon or a hydrocarbon group), or a 5- or 6-membered heterocyclic ring attached to the 6-membered heterocyclic ring composed of Z.

Examples of a compound represented by this formula (XI) are aminoazaindene disclosed in U.S. Pat. No. 4,400,463, 4-aminopyrazolo[3,4-d]pyrimidine disclosed in U.S. Pat. Nos. 4,713,323 and 4,804,621, xanthine disclosed in U.S. Pat. No. 5,178,998, and triaminopyrimidine disclosed in U.S. Pat. No. 5,185,239, all the disclosures of which are incorporated herein by refeence. In the present invention, the addition amount of a compound represented by formula (XI) is preferably $10^{-5}$ to $3\times10^{-1}$ mol, and most preferably, $2\times10^{-4}$ to $10^{-1}$ mol per mol of a silver halide.

Compounds represented by formulas (VII) to (XI) have a function of being selectively adsorbed to (111) faces, rather than (100) faces, and thereby stabilizing the (111) faces in a silver halide grain. Tabular grains of the present invention can be obtained since this crystal habit-controlling agent (having (111) face selectivity) is present during shell formation. A controlling agent used in the present invention need only have this (111) selective adsorptivity, so compounds used are not limited to the above formulas.

The (111) face selective crystal habit-controlling effect useful in the present invention can be easily found by the following test method. That is, when grain formation is performed at +90 mV by the controlled double-jet method by using common alkali-processed bone gelatin as a dispersion medium and using silver nitrate and potassium bromide with a silver electrode and a saturated calomel electrode as a reference electrode at 75° C., cubic silver bromide grains having (100) are obtained. When a (111) crystal habit-controlling agent is added during the grain formation, (111) faces start to appear in a cube to form a tetradecahedron (corners are sometimes rounded). This tetradecahedron changes into an octahedron in which all faces are (111). This clearly demonstrates the effect of the (111) crystal habit-controlling agent.

If the (111) selective crystal habit-controlling agent described above is absent, dislocation lines formed in the core/shell interface prevent a tabular grain from growing in a lateral direction. Hence, the tabular grain exclusively grows in the direction of thickness. Although the cause of this lateral growth inhibiting effect of dislocation lines is unknown, the projected area of a shell portion having dislocation lines inevitably decreases by this effect. If dislocation lines are produced while the core is small in order to increase the ratio of the shell portion, a tabular grain can no longer grow in a lateral direction from this portion where the dislocation lines are produced, so the grain uselessly grow in the direction of thickness. Consequently, the aspect ratio of the tabular grain lowers. This makes it impossible to well utilize the characteristics of a tabular grain. However, this problem can be solved by the technique disclosed in this specification. That is, after dislocation lines are produced in the core, the abovementioned crystal habit-controlling agent having (111) face adsorption selectivity is allowed to exist during shell formation. This permits a tabular grain to grow in a lateral direction even in the presence of dislocation lines. This is probably because the crystal habit-controlling agent is selectively adsorbed to the major surfaces of a tabular grain that are (111) surfaces to significantly suppress growth in the direction of thickness, and relatively the growth rate in the lateral direction becomes higher than that in the thickness direction. Accordingly, by the use of the technique disclosed in this specification it is possible to prepare dislocation-containing tabular grains in which the ratio of the projected area of shells containing dislocation lines is high, and which has a high aspect ratio.

Furthermore, in the present invention it is preferable to use at least three types of gelatins during grain formation. More specifically, low-molecular-weight oxidized gelatin is used in nucleation, modified gelatin such as phthalated gelatin or trimellitic gelatin is used in the initial stages of grain formation, and unmodified gelatin or high-molecular-weight gelatin is used in shell formation.

The addition of different types of gelatins to the core portion is generally known. However, it is surprising to find that the graininess greatly improves by the addition of gelatin during shell formation. The addition amount of each gelatin can be selected from the range of 0.1 to 50 g per g of silver.

Emulsions of the present invention and other photographic emulsions that can be used together with the emulsions of the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by the reaction of a soluble silver salt and a soluble halogen salt, any of the single-jet method, the double-jet method, and the combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which the crystal shape is regular and the grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994, the discloses of which are herein incorporated by reference. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, European Patents (hereinafter also referred to as EU) 273,429 and 273,430, and West German Patent 3,819,241, the disclosers of which are incorporated herein by reference. This method is an effective grain formation method. To convert into a silver salt that is more sparingly soluble, it is possible to add a solution of a soluble halogen or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent (hereinafter also referred to as GB) 1,469,480 and U.S. Pat. Nos. 3,650,757 and 4,242,445, the disclosures of which are incorporated herein by reference. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added, a plurality of soluble halogen salts of different solution compositions are to be added or a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364, the disclosures of which are incorporated herein by reference.

A silver halide solvent is useful for the purpose of accelerating ripening. As an example, it is known to make an excess of halogen ion exist in a reactor vessel in order to accelerate ripening. Another ripening agent can also be used.

The total amount of these ripening agents can be mixed in a dispersing medium placed in a reactor vessel before addition of a silver salt and a halide salt or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., four-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the formation of silver halide grains of the present invention, at least one of chalcogen sensitization including sulfur sensitization and selenium sensitization, and noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

It is preferable to perform reduction sensitization during grain formation, after grain formation but before chemical sensitization, or during chemical sensitization of the silver halide emulsion.

Reduction sensitization performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted. Known examples of the reduction sensitizer are stannous chloride, ascorbic acid and its derivatives, amines and polyamines, hydrazine derivatives, formamidinesulfinic acid, a silane compound, and a borane compound. In reduction sensitization of the present invention, it is possible to selectively use these reduction sensitizers or to use two or more types of compounds together. Preferable compounds as the reduction sensitizer are stannous chloride, thiourea dioxide, dimethylamineborane, and ascorbic acid and its derivatives. Although the addition amount of reduction sensitizers must be so selected as to meet the emulsion manufacturing conditions, a proper amount is $10^{-7}$ to $10^{-2}$ mol per mol of a silver halide.

The reduction sensitizer is, for example, added during grain formation by dissolving thereof to water, or organic solvents such as alcohols, glycols, ketones, esters, and amides. The reduction sensitizer can previously added to a reaction vessel, but it is preferable to add the reduction sensitize at a proper timing during grain growth. It is also possible to previously add the reduction sensitizer to a solution of a water-soluble silver salt or of an alkaline halide, thereby to precipitate silver halide grains using the solutions. It is also preferable to add a solution of the reduction sensitizer at several times separately during the grain growth or add the solution for a consecutive long period.

It is preferable to use an oxidizer for silver during the process of manufacturing emulsions of the present invention. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate.

An oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$ ), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. The combined use of the aforementioned reduction sensitizer and the oxidizer to silver is a preferable embodiment. The method of adding the oxidizer can be selected from the method of using the oxidizer followed by performing reduction sensitization, the vice versa thereof, or the method of making both of the oxidizer and the reduction sensitizer present at the same time. These methods can be performed at a grain formation step or a chemical sensitization step.

Photographic emulsions used in the present invention can contain various compounds in order to prevent fog during the manufacturing process, storage, or photographic processing of a sensitized material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes.

For example, compounds described in U.S. Pat. Nos. 3,954,474 and 3,982,947 and Jpn. Pat. Appln. KOKOKU Publication No. (hereinafter referred to as JP-B-) 52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The photographic emulsion of the present invention is preferably subjected to a spectral sensitization with at least one methine dye or the like, from the viewpoint that the effects desired in the present invention can be exerted. Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have at least one substituent on carbon atoms thereof.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, and GB 1,344,281 and 1,507,803, JP-B's-43-4936 and 53-12375 and JP-A's-52-110618 and 52-109925.

The emulsion of the present invention may be doped with a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and before the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization as described in JP-A-58-113928, and also, the spectral sensitizing dye can be added prior to the completion of silver halide grain precipitation to thereby initiate the spectral sensitization. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains, such as the method disclosed in U.S. Pat. No. 4,183,756 and other methods.

The addition amount of the spectral sensitizing dye can range from $4\times10^{-6}$ to $8\times10^{-3}$ mol per mol of the silver halide. In the case where a preferable silver halide grain size of 0.2 to 1.2 $\mu$m, the addition amount of about $5\times10^{-5}$ to $2\times10^{-3}$ is effective.

In the lightsensitive material of the present invention, it is only required that at least one silver halide emulsion layer be formed on a support. A typical example is a silver halide photographic lightsensitive material having, on its support, at least one lightsensitive layer constituted by a plurality of silver halide emulsion layers which are sensitive to essentially the same color but have different sensitivities. This lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color.

Various non lightsensitive layers such as an intermediate layer can be formed between the silver halide lightsensitive layers and as the uppermost layer and the lowermost layer. These intermediate layers may contain, e.g., couplers to be described later, DIR compounds and color-mixing inhibitors. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herein by reference, layers can be arranged from the farthest side from a support in the order of blue-sensitive layer/GH/RH/GL/RL. Furthermore, as described in JP-A's-56-25738 and 62-63936, the disclosures of which are incorporated herein by reference, layers can be arranged from the farthest side from a support in the order of blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

To improve the color reproducibility, as described in U.S. Pat. Nos. 4,663,271, 4,705,744, and 4,707,436, and JP-A's-

62-160448, and 63-89850, the disclosures of which are incorporated herein by reference, a donor layer (CL) with an interlayer effect, which has a different spectral sensitivity distribution from that of a main sensitive layer such as BL, GL, or RL, is preferably formed adjacent to, or close to, this main sensitive layer.

A silver halide used in the present invention is silver iodobromide, silver iodochloride, or silver bromochloroiodide containing about 30 mol % or less of silver iodide. A particularly preferable silver halide is silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having a projected area diameter of about 10 $\mu$m, and an emulsion can be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, "I. Emulsion preparation and types", and RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628 and 3,655,394, and GB1,413,748 are also preferable.

Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, and 4,439,520, and GB2,112,157.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17643, 18716, and 307105, and they are summarized in a table to be presented later.

In a lightsensitive material of the present invention, it is possible to mix, in a single layer, two or more types of emulsions different in at least one of characteristics of a photosensitive silver halide emulsion, i.e., a grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-imagewise) regardless of whether the location is a non-exposed portion or an exposed portion of the photosensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably, 0.05 to 0.6 $\mu$m. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a non-sensitive fine grain silver halide. The non-sensitive fine grain silver halide preferably consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 $\mu$m, and more preferably, 0.02 to 2 $\mu$m.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a lightsensitive material of the present invention is preferably 6.0 g/m$^2$ or less, and most preferably, 4.5 g/m$^2$ or less.

Photographic additives usable in the present invention are also described in RD's, the disclosures of which are incorporated herein by reference, and the relevant portions are summarized in the following table.

| | Additives | RD17643 | RD18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right column |
| 4. | Brighteners | page 24 | page 647, right column |
| 5. | Light absorbents, filter dyes, ultraviolet absorbents | pages 25–26 | page 649, right column to page 650, left column |
| 6. | Binders | page 26 | page 651, left column |
| 7. | Plasticizers, lubricants | page 27 | page 650, right column |
| 8. | Coating aids, surface active agents | pages 26–27 | page 650, right column |
| 9. | Antistatic agents | page 27 | page 650, right column |
| 10. | Matting agents | | |

| | Additives | RD307105 |
|---|---|---|
| 1. | Chemical sensitizers | page 866 |
| 2. | Sensitivity increasing agents | |
| 3. | Spectral sensitizers, super sensitizers | pages 866–868 |
| 4. | Brighteners | page 868 |
| 5. | Light absorbent, filter dye, ultraviolet absorbents | page 873 |
| 6. | Binder | pages 873–874 |
| 7. | Plasticizers, lubricants | page 876 |
| 8. | Coating aids, surface active agents | pages 875–876 |
| 9. | Antistatic agents | pages 876–877 |
| 10. | Matting agent | pages 878–879 |

Various dye forming couplers can be used in a lightsensitive material of the present invention, and the following couplers disclosed in the documents, the disclosures of which are incorporated herein by reference, are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385.

Polymer couplers: P-1 and P-5 (page 11) in JP-A-2-44345.

Couplers for forming a colored dye with a proper diffusibility are preferably those described in U.S. Pat. No. 4,366,237, GB2,125,570, EP96,873B, and DE3,234,533.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of W092/11575.

Examples of a compound (including a coupler) which reacts with an oxidized form of a developing agent and releases a photographically useful compound residue are as follows. Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator-releasing compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand- releasing compounds: compounds (particularly compounds in column 12, lines 21 to 41) represented by LIG-X described in claim 1 of U.S. Pat. No. 4,555,478; leuco dye-releasing compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent-releasing compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447.

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No.

4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-i, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324; dyes: a-i to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of W088/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A.

The present invention can be applied to various color lightsensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784.

A support which can be suitably used in the present invention is described in, e.g., RD. No. 17643, page 28, RD. No. 18716, page 647, right column to page 648, left column, and RD. No. 307105, page 879.

In a lightsensitive material of the present invention, the total film thickness of all hydrophilic colloid layers on the side having emulsion layers is preferably 28 μm or less, more preferably, 23 μm or less, most preferably, 18 μm or less, and particularly preferably, 16 μm or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. A film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness−film thickness)/film thickness.

In a lightsensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The swell ratio of the back layers is preferably 150 to 500%.

A lightsensitive material according to the present invention can be developed by conventional methods described in RD. No. 17643, pp. 28 and 29, RD. No. 18716, page 651, left to right columns, and RD No. 307105, pp. 880 and 881.

Color negative film processing solutions used in the present invention will be described below.

Compounds described in JP-A-4-121739, page 9, upper right column, line 1 to page 11, lower left column, line 4 can be used in a color developer of the present invention. As a color developing agent used when particularly rapid processing is to be performed, 2-methyl-4-[N-ethyl-N-(2-hydroxyethyl)amino]aniline, 2-methyl-4-[N-ethyl-N-(3-hydroxypropyl)amino]aniline, or 2-methyl-4-[N-ethyl-N-(4-hydroxybutyl)amino]aniline is preferable.

The use amount of any of these color developing agents is preferably 0.01 to 0.08 mol, more preferably, 0.015 to 0.06 mol, and most preferably, 0.02 to 0.05 mol per liter (to be referred to as "L" hereinafter) of a color developer. Also, a replenisher of a color developer preferably contains a color developing agent at a concentration 1.1 to 3 times, particularly 1.3 to 2.5 times the above concentration.

As a preservative of a color developer, hydroxylamine can be extensively used. If higher preservability is necessary, the use of a hydroxylamine derivative having a substituent such as an alkyl group, hydroxylalkyl group, sulfoalkyl group, or carboxyalkyl group is preferable. Examples are N,N-di(sulfoethyl)hydroxylamine, monomethylhydroxylamine, dimethylhydroxylamine, monoethylhydroxylamine, diethylhydroxylamine, and N,N-di(carboxylethyl) hydroxylamine. Of these derivatives, N,N-di(sulfoethyl) hydroxylamine is particularly preferable. Although these derivatives can be used together with hydroxylamine, it is preferable to use one or two types of these derivatives instead of hydroxylamine.

The use amount of a preservative is preferably 0.02 to 0.2 mol, more preferably, 0.03 to 0.15 mol, and most preferably, 0.04 to 0.1 mol per L. As in the case of a color developing agent, a replenisher preferably contains a preservative at a concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably, 0.02 to 0.04 mol per L. Sulfite is preferably used at a concentration 1.1 to 3 times the above concentration in a replenisher.

The pH of a color developer is preferably 9.8 to 11.0, and more preferably 10.0 to 10.5. In a replenisher, the pH is preferably set to be higher by 0.1 to 1.0 than these values. To stably maintain this pH, a known buffering agent such as carbonate, phosphate, sulfosalicylate, or borate is used.

The replenishment rate of a color developer is preferably 80 to 1,300 milliliters (to be also referred to as "mL" hereinafter) per $m^2$ of a lightsensitive material. However, the replenishment rate is preferably smaller in order to reduce environmental pollution. For example, the replenishment rate is preferably 80 to 600 mL, and more preferably, 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C takes a negative value, however, no bromide ions are preferably added to a replenisher.

$$C=A-W/V$$

where

C: a bromide ion concentration (mol/L) in a color developer replenisher

A: a target bromide ion concentration (mol/L) in a color developer

W: an amount (mol) of bromide ions dissolving into a color developer from 1 $m^2$ of a lightsensitive material when the sensitive material is color-developed V: a replenishment rate (L) of a color developer replenisher for 1 $m^2$ of a lightsensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6 can be applied to a processing solution having bleaching capacity in the present invention. This bleaching agent preferably has an oxidation-reduction potential of 150 mV or more. Preferable practical examples of the bleaching agent are described in JP-A's-5-72694 and 5-173312. In particular, 1,3-diaminopropane tetraacetic acid and ferric complex salt of a compound as practical example 1 in JP-A-5-173312, page 7 are preferable.

To improve the biodegradability of a bleaching agent, it is preferable to use compound ferric complex salts described in JP-A's-4-251845, and 4-268552, EP588,289, EP591,934, and JP-A-6-208213 as the bleaching agent. The concentration of any of these bleaching agents is preferably 0.05 to 0.3 mol per L of a solution having bleaching capacity. To reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably, 0.3 to 0.8 mol of a bromide is added per L.

A replenisher of the solution having bleaching capacity basically contains components at concentrations calculated by the following equation. This makes it possible to maintain the concentrations in a mother solution constant.

$$C_R=C_T\times(V_1+V_2)/V_1+C_p$$

where $C_R$: concentrations of components in a replenisher $C_T$: concentrations of components in a mother solution (processing tank solution)

$C_p$: concentrations of components consumed during processing $V_1$: a replenishment rate (mL) of a replenisher having bleaching capacity per $m^2$ of a lightsensitive material $V_2$: an amount (mL) carried over from a pre-bath per $m^2$ of a lightsensitive material Additionally, a bleaching solution preferably contains a pH buffering agent, and more preferably contains dicarboxylic acid with little odor such as succinic acid, maleic acid, malonic acid, glutaric acid, adipic acid and the like. Also, the use of known bleaching accelerators described in JP-A-53-95630, RD No. 17129, and U.S. Pat. No. 3,893,858 is preferable.

It is preferable to replenish 50 to 1,000 mL of a bleaching replenisher to a bleaching solution per $m^2$ of a lightsensitive material. The replenishment rate is more preferably 80 to 500 mL, and most preferably, 100 to 300 mL. Aeration of a bleaching solution is also preferable.

Compounds and processing conditions described in JP-A-4-125558, page 7, lower left column, line 10 to page 8, lower right column, line 19 can be applied to a processing solution with fixing capacity.

To improve the fixing rate and preservability, compounds represented by formulas (I) and (II) described in JP-A-6-301169 are preferably added singly or together to a processing solution with fixing capacity. To improve the preservability, the use of sulfinic acid such as p-toluenesulfinate described in JP-A-1-224762 is also preferable. To improve the desilvering characteristics, ammonium is preferably used as cation in a solution with bleaching capacity or a solution with fixing capacity. However, the amount of ammonium is preferably reduced, or zero, to reduce environmental pollution.

In the bleaching, bleach-fixing, and fixing steps, it is particularly preferable to perform jet stirring described in JP-A-1-309059.

The replenishment rate of a replenisher in the bleach-fixing or fixing step is preferably 100 to 1,000 mL, more preferably, 150 to 700 mL, and most preferably, 200 to 600 mL per $m^2$ of a lightsensitive material.

In the bleach-fixing or fixing step, an appropriate silver collecting apparatus is preferably installed either in-line or off-line to collect silver. When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the size of a processor, a two-tank cascade system is generally efficient. The processing time ratio of the front tank to the rear tank is preferably 0.5:1 to 1:0.5, and more preferably, 0.8:1 to 1:0.8.

In a bleach-fixing or fixing solution, the presence of free chelating agents which are not metal complexes is preferable to improve the preservability. As these chelating agents, the use of the biodegradable chelating agents previously described in connection to a bleaching solution is preferable.

Contents described in aforementioned JP-A-4-125558, page 12, lower right column, line 6 to page 13, lower right column, line 16 can be preferably applied to the washing and stabilization steps. To improve the safety of the work environment, it is preferable to use azolylmethylamines described in EP504,609 and EP519,190 or N-methylolazoles described in JP-A-4-362943 instead of formaldehyde in a stabilizer and to make a magenta coupler divalent to form a solution of surfactant containing no image stabilizing agent such as formaldehyde. To reduce adhesion of dust to a magnetic recording layer formed on a lightsensitive material, a stabilizer described in JP-A-6-289559 can be preferably used.

The replenishment rate of washing water and a stabilizer is preferably 80 to 1,000 mL, more preferably, 100 to 500 mL, and most preferably, 150 to 300 mL per $m^2$ of a lightsensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A's-3-46652, 3-53246, 3-55542, 3-121448, and 3-126030. A reverse permeable membrane used in this processing is preferably a low-pressure reverse permeable membrane.

In the processing of the present invention, it is particularly preferable to perform processing solution evaporation correction disclosed in Journal of Technical Disclosure No. 94-4992. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A's-4-19655 and 4-230748, granules containing a water-soluble polymer disclosed in JP-A-4-221951, tablets disclosed in JP-A's-51-61837 and 6-102628, and a paste disclosed in PCT KOHYO Publication No. 57-500485. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 $\mu$m and an oxygen permeability of 20 $mL/m^2 \cdot 24$ hrs·atm or less.

Color reversal film processing solutions used in the present invention will be described below. Processing for a color reversal film is described in detail in Aztech Ltd., Known Technology No. 6 (1991, April 1), page 1, line 5 to page 10, line 5 and page 15, line 8 to page 24, line 2, and any of the contents can be preferably applied. In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferable in terms of work environment, and N-methyloltriazole is particularly preferable as N-methylolazole. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color photosensitive film of the present invention is also suited as a film with lens such as Fuji Film FUJICOLOR UTSURUNDESU (Quick Snap) SUPER SLIM.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, the Fuji Film MINILABO CHAMPION SUPER FA-298, FA-278, FA-258, FA-238 are preferable. Examples of a film processor are the FP922AL, FP562B, FP562BL, FP362B, and FP3622BL, and a recommended processing chemical is the FUJICOLOR JUST-IT CN-16L. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

The magnetic recording layer for use in the present invention will be described below.

The magnetic recording layer is obtained by coating on a support with a water-base or organic solvent coating liquid having magnetic material grains dispersed in a binder.

Suitable magnetic material grains can be composed of any of ferromagnetic iron oxides such as $\gamma$ $Fe_2O_3$, Co coated $\gamma$ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma$ $Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$. The saturation magnetization ($\sigma s$) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyalcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 $\mu$m, preferably 0.2 to 5 $\mu$m, and more preferably from 0.3 to 3 $\mu$m. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259, and 5,215,874 and EP No. 466,130.

The polyester support for use in the present invention will be described below. Particulars thereof together with the below mentioned lightsensitive material, processing, cartridge and working examples are specified in Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The lightsensitive material of the invention may have a subbing layer on at least one of the emulsion layer side and the back side. The subbing layer may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, SiO2, TiO2, inorganic fine grains or polymethyl methacrylate copolymer fine grains (0.01 to 10 $\mu$m) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 $\mu$m or a composite oxide thereof (Sb, P, B, In, S, Si, C, etc.) and fine grains of sol form metal oxides or composite oxides thereof. The content thereof in the lightsensitive material is preferably in the range of 5 to 500 mg/m$2_1$ more preferably 10 to 350 mg/m$^2$. The ratio of amount of conductive crystalline oxide or composite oxide thereof to binder is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the light-sensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 $\mu$m. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 μm or less be simultaneously added, which include, for example, fine grains of polymethyl methacrylate (0.2 μm), poly(methyl methacrylate/methacrylic acid) (9/1 in molar ratio, 0.3 μm), polystyrene (0.25 μm) and colloidal silica (0.03 μm).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

EXAMPLES

Examples of the present invention will be set forth below, however the present invention is not limited to the examples.

Gelatin-1 to gelatin-5 used as dispersion media in emulsion preparations described below have the following attributes.

Gelatin-1: Common alkali-processed ossein gelatin made from beef bones. No —$NH_2$ groups in the gelatin were chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No —$NH_2$ groups in the gelatin were chemically modified.

Gelatin-5: Gelatin formed by allowing hydrogen peroxide water to act on gelatin-4 to oxidize a methionine moiety. The methionine content was 3.4 mol/g. The molecular weight was 15,000, the same as gelatin-4. No —$NH_2$ groups in the gelatin were chemically modified.

All of gelatin-1 to gelatin-5 described above were deionized and so adjusted that the pH of an aqueous 5% solution at 35° C. was 6.0.

Example 1

This example set forth the preparation, coating of raw emulsion, and evaluations of tabular grains having dislocation lines whose variation coefficient of distribution of the aspect ratio and thickness are varied.

Preparation of emulsion A-1

1,300 mL of an aqueous solution containing 1.0 g of KBr and 1.1 g of gelatin-4 described above was stirred at 35° C. (1st solution preparation). 18 mL of an aqueous solution Ag-1 (containing 4.9 g of $AgNO_3$ in 100 mL), 13.8 mL of an aqueous solution X-1 (containing 5.2 g of KBr in 100 mL), and 4 mL of an aqueous solution G-1 (containing 8.0 g of gelatin-4 described above in 100 mL) were added over 30 sec at fixed flow rates by the triple jet method (addition 1). After that, 6.5 g of KBr were added, and the temperature was raised to 75° C. After a ripening step was performed for 12 min, 300 mL of an aqueous solution G-2 (containing 12.7 g of gelatin-3 described above in 100 mL) were added. 2.1 g of 4,5-dihydroxy-1,3-disodium disulfonate-monohydrate and 0.002 g of thiourea dioxide were sequentially added at an interval of 1 min.

Next, 157 mL of an aqueous solution Ag-2 (containing 22.1 g of $AgNO_3$ in 100 mL) and an aqueous solution X-2 (containing 15.5 g of KBr in 100 mL) were added over 14 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30 (addition 2). Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 27 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 8.30 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate. The addition of the aqueous solution X-4 was so performed that the pAg of the bulk emulsion solution in the reaction vessel was held at 8.15 (addition 4).

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. 73.9 g of an AgI fine grain emulsion (containing 13.0 g of AgI fine grains having an average grain size of 0.047 μm in 100 g) were added. Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4 (addition 5). After that, desalting was performed by normal flocculation. Water, NaOH, and gelatin-1 described above were added under stirring, and the pH and the pAg were adjusted to 6.4 and 8.6, respectively, at 56° C.

The characteristic values of the thus obtained emulsion grains are set forth in Table 1 below.

Subsequently, the emulsion was optimally, chemically sensitized by sequentially adding a sensitizing dye Exs-1 presented below, potassium thiocyanate, chloroauric acid, sodium thiosulfate, and N,N-dimethylselenourea. This chemical sensitization was completed by adding water-soluble mercapto compounds MER-1 and MER-2 presented below at a ratio of 4:1 such that the total amount was $3.6\times10^{-4}$ mol per mol of a silver halide.

The sensitizing dye of the present invention was used as a fine solid dispersion formed by the method described in JP-A-11-52507.

For example, a fine solid dispersion of the sensitizing dye Exs-1 was formed as follows.

A fine solid dispersion of the sensitizing dye Exs-1 was obtained by dissolving 0.8 parts by weight of $NaNO_3$ and 3.2 parts by weight of $Na_2SO_4$ in 43 parts by weight of ion-exchanged water and dispersing the material at 60° C. for 20 min by using a dissolver blade at 2,000 rpm.

Exs-1

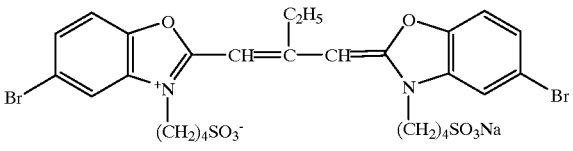

MER-1

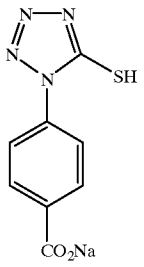

MER-2

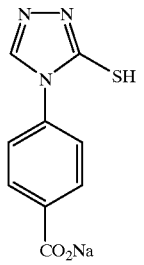

Preparation of emulsion 1-B

Emulsion 1-B was prepared by changing the preparation conditions of the emulsion 1-A as follows:

(i) The pAg of (addition 2) was held at 8.44, and (ii) The pAg of (addition 3) was held at 8.44.

The characteristic values of the thus obtained emulsion grains are set forth in Table 1 below.

This emulsion was also chemically sensitized similar to the emulsion 1-A.

Preparation of Emulsion 1-C

Emulsion 1-C was prepared by changing the preparation conditions of the emulsion 1-A as follows:

(i) The pAg of (addition 2) was held at 7.86, and (ii) The pAg of (addition 3) was held at 7.86.

The characteristic values of the thus obtained emulsion grains are set forth in Table 1 below.

This emulsion was also chemically sensitized similar to the emulsion 1-A.

Preparation of emulsion 1-D

Emulsion 1-D was prepared by changing the preparation conditions of the emulsion 1-A as follows:

(i) The addition solution in (addition 2) was added to a stirrer described in JP-A-10-43570, and a silver bromide ultrafine grain emulsion discharged from the stirrer was added to the reaction vessel. X-2 was added such that the pAg of the discharged silver bromide ultrafine emulsion was 7.86. Also, the aqueous solution X-1 was added to the reaction vessel to hold the pAg in the vessel at 7.50, and (ii) The addition solution in (addition 3) was added to the stirrer described above, and a silver bromide ultrafine grain emulsion discharged from the stirrer was added to the reaction vessel. X-2 was added such that the pAg of the discharged silver bromide ultrafine emulsion was 7.86. Also, the aqueous solution X-1 was added to the reaction vessel to hold the pAg in the vessel at 7.50.

The characteristic values of the thus obtained emulsion grains are set forth in Table 1 below.

This emulsion was also chemically sensitized similar to the emulsion 1-A.

Preparation of Emulsion 1-E

Emulsion 1-E was prepared by changing the preparation conditions of the emulsion 1-D as follows:

(i) The addition time of (addition) 1 was reduced to 5 sec by increasing the addition flow rate six times without changing the addition amount, and (ii) The time of the ripening step performed after the temperature was raised to 75° C. after the completion of (addition 1) was prolonged to 18 min.

The characteristic values of the thus obtained emulsion grains are set forth in Table 1 below.

This emulsion was also chemically sensitized similar to the emulsion 1-A.

Preparation of Emulsion 1-F

An emulsion 1-F was prepared by changing the preparation conditions of the emulsion 1-E as follows:

(i) The pAg in the reaction vessel during (addition 2) was held at 7.57, and (ii) The pAg in the reaction vessel during (addition 3) was held at 7.57.

The characteristic values of the thus obtained emulsion grains are set forth in Table 1 below.

This emulsion was also chemically sensitized similar to the emulsion 1-A.

Preparation of Emulsion 1-G

An emulsion 1-G was prepared by changing the preparation conditions of the emulsion 1-D as follows:

(i) The pAg in the reaction vessel during (addition 2) was held at 7.72, and (ii) The pAg in the reaction vessel during (addition 3) was held at 7.72.

The characteristic values of the thus obtained emulsion grains are set forth in Table 1 below.

This emulsion was also chemically sensitized similar to the emulsion 1-A.

Preparation of Emulsion 1-H

An emulsion 1-H was prepared by changing the preparation conditions of the emulsion 1-D as follows:

(i) The pAg in the reaction vessel during (addition 2) was held at 7.86, and (ii) The pAg in the reaction vessel during (addition 3) was held at 7.86.

The characteristic values of the thus obtained emulsion grains are set forth in Table 1 below.

This emulsion was also chemically sensitized similar to the emulsion 1-A.

TABLE 1

| Emulsion | COV of ECD (%) | Ratio (%) of grains having ECD of 3.5 μm or more and thickness of 0.25 μm or less | Ratio (%) of grains having a distance between twin planes of 0.016 μm or less (%) | Remarks |
|---|---|---|---|---|
| 1-A | 36 | 45 | 65 | Comparison |
| 1-B | 44 | 55 | 65 | Comparison |
| 1-C | 22 | 30 | 65 | Comparison |
| 1-D | 26 | 65 | 65 | Invention |
| 1-E | 19 | 65 | 65 | Invention |
| 1-F | 20 | 75 | 65 | Invention |
| 1-G | 22 | 85 | 65 | Invention |
| 1-H | 25 | 95 | 65 | Invention |

COV = coefficient of variation.
ECD = equivalent circular diameter.

Each of the emulsions 1-A to 1-H was observed at liquid nitrogen temperature by using a 400-kV transmission electron microscope. Consequently, ten or more dislocation lines were present in a fringe portion of any tabular grain. The comparison of the emulsion 1-D with the emulsion 1-E shows that the average amount of dislocation lines was slightly larger in the emulsion 1-E, and the inter-grain difference in dislocation line amount was smaller in the emulsion 1-E.

Note that the emulsions 1-A to 1-G were reduction-sensitized by adding disodium 4,5-dihydroxy-1,3-disulfonate monohydrate and thiourea dioxide immediately before (addition 2) in the aforementioned emulsion preparation process.

Note also that the emulsions 1-A to 1-H were spectrally sensitized by adding the sensitizing dye Exs-1 in the chemical sensitization step during the process of emulsion preparation. This made each of these emulsions a green-sensitive silver halide emulsion whose spectral sensitivity was a maximum at a wavelength of 550 nm.

A cellulose triacetate film support having an undercoat layer was coated with the emulsions 1-A to 1-H under the coating conditions as shown in Table 2, thereby forming samples 101 to 108.

TABLE 2

Emulsion coating conditions (1) Emulsion layer

Emulsions — Various emulsions (Silver $1.63 \times 10^{-2}$ mol/m$^2$)

Coupler ($2.26 \times 10^{-3}$ mol/m$^2$)

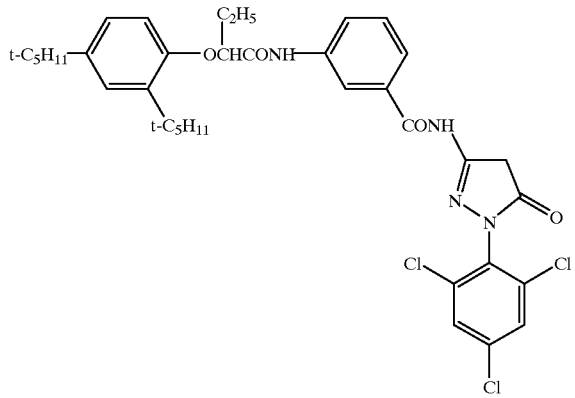

Tricresylphosphate (1.32 g/m$^2$)

Gelatin (3.24 g/m$^2$)

(2) Protective layer 2,4-dichloro-6-hydroxyl-2-triazine sodium solt (0.08 g/m$^2$)

Gelatine (1.80 g/m$^2$)

These samples were subjected to a film hardening process at 40° C. and a relative humidity of 70% for 14 hr. The resultant samples were exposed for 1/100 sec through the SC-50 gelatin filter, a long wave length light-transmitting filter having a cut off wave length of 500 nm, manufactured by Fuji Photo Film Co., Ltd. and a continuous wedge. The density of each sample developed as will be described later was measured through a green filter to evaluate the photographic properties.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | Temperature | Replenishment rate* |
|---|---|---|---|
| Color development | 2 min. 45 sec. | 38° C. | 45 mL |
| Bleaching | 1 min. 00 sec. | 38° C. | 20 mL |
| bleaching solution overflow was entirely supplied into bleach-fix tank | | | |
| Bleach-fix | 3 min. 15 sec. | 38° C. | 30 mL |
| Washing (1) | 40 sec. | 35° C. | counter flow piping |
| from (2) to (1) | | | |
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

| (Bleaching solution) common to tank solution and replenisher | (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Ammonia water (27%) | 15.0 mL |
| Water to make | 1.0 L |
| pH (adjusted by ammonia water and nitric acid) | 6.3 |

| (Bleach-fix bath) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

Washing Water

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |

-continued

| (Stabilizer) common to tank solution and replenisher | (g) |
|---|---|
| 1,4-bis(1,2,4-triazole-1-ylmethyl) piperazine | 0.75 |
| Water to make | 1.0 L |
| pH | 8.5 |

The results are shown in Table 3 below. The sensitivity is indicated by the relative value of the reciprocal of an exposure amount required to reach a density of fog density plus 0.2. Comparison among Samples 102, 104 and 105 reveals that it is important for increasing sensitivity to set the coefficient of variation of distribution of the equivalent-circle diameter to 40% or less. Also it is levealed that from the comparison between Samples 105 and 108, the higher the ratio of the grains having the equivalent-circle diameter of 3.5 μm or more and the thickness of 0.35 μm or less, the higher the sensitivity of the emulsion. The sensitivity of sample 101 is assumed to 100.

TABLE 3

| Sample No. | Sensitivity | Remarks |
|---|---|---|
| 101 | 100 | Comparison |
| 102 | 102 | Comparison |
| 103 | 79 | Comparison |
| 104 | 107 | Invention |
| 105 | 118 | Invention |
| 106 | 122 | Invention |
| 107 | 125 | Invention |
| 108 | 129 | Invention |

Example 2

This example set forth the preparation, raw emulsion coating, and evaluations of tabular emulsion having dislocation lines, whose distance between twin planes and the coefficient of variation of the distance between twin planes are varied.

Preparation of Emulsion 2-A

An emulsion 2-A was prepared by changing the preparation conditions of the emulsion 1-E in Example 1 as follows:

(i) The temperature of (1st solution) was held at 25° C., and (ii) The addition amounts of Ag-1, X-1, and G-1 were changed to 14.4, 10.9, and 3.2 mL, respectively, without changing the addition time of (addition 1).

The characteristic values of the thus obtained emulsion grains are set forth in Table 4.

This emulsion was also chemically sensitized similar to the emulsion 1-A.

Preparation of Emulsion 2-E

An emulsion 2-E was prepared by changing the preparation conditions of the emulsion 1-E in Example 1 as follows:

(i) The temperature of (1st solution) was held at 15° C., and (ii) The addition amounts of Ag-1, X-1, and G-1 were changed to 10.8, 8.2, and 2.4 mL, respectively, without changing the addition time of (addition 1).

The characteristic values of the emulsion grains are shown in Table 4.

This emulsion was also chemically sensitized similar to the emulsion 1-A.

Preparation of Emulsions 2-J and 2-K

Emulsion 2-J was prepared by changing the preparation conditions of the emulsion 1-E of Example 1 as follows:

(i) The temperature of (1st solution) was held at 55° C.

The characteristic values of the emulsion grains are shown in Table 4.

This emulsion was also chemically sensitized similar to the emulsion 1-A.

Emulsion 2-K was prepared by changing the preparation conditions of the emulsion 1-E of Example 1 as follows:

(i) The temperature of (1st solution) was held at 65° C.

The characteristic values of the emulsion grains are shown in Table 4 below.

This emulsion was also chemically sensitized similar to the emulsion 1-A.

TABLE 4

| Emulsion | COV of ECD (%) | Ratio (%) of grains having ECD of 3.5 μm or more and thickness of 0.25 μm or less | Ratio (%) of grains having a distance between twin planes of 0.016 μm or less | Remarks |
|---|---|---|---|---|
| 1-E | 19 | 65 | 65 | Invention |
| 2-A | 19 | 65 | 75 | Invention |
| 2-E | 19 | 65 | 90 | Invention |
| 2-J | 19 | 65 | 45 | Comparison |
| 2-K | 19 | 65 | 30 | Comparison |

COV = coefficient of variation.
ECD = equivalent circular diameter.

Each of the emulsions 2-A, E, J and K was observed at liquid nitrogen temperature by using a 400-kV transmission electron microscope. Consequently, ten or more dislocation lines were present in a fringe portion of any tabular grain. When compared to the emulsion 1-E, dislocation lines were observed at higher density in the emulsion 2-A, and dislocation lines were observed at still higher density in the emulsion 2-E.

Note that the emulsions 2-A, E, J and K were reduction-sensitized by adding disodium 4,5-dihydroxy-1,3-disulfonate monohydrate and thiourea dioxide immediately before (addition 2) in the aforementioned emulsion preparation process.

Note also that the emulsions 2-A, E, J and K were spectrally sensitized by adding the sensitizing dye Exs-1 in the chemical sensitization step during the process of emulsion preparation. This made each of these emulsions a green-sensitive silver halide emulsion whose spectral sensitivity was a maximum at a wavelength of 550 nm.

Following the same procedures as in Example 1, samples 201 to 205 were formed by coating a support with the emulsions 1-E and 2-A, E, J and K. Furthermore, the photographic properties were evaluated in the same manner as in Example 1. The results are shown in Table 5 below. The sensitivity is indicated by the relative value of the reciprocal of an exposure amount required to reach a density of fog density plus 0.2 (the sensitivity of sample 205 is assumed to be 100).

TABLE 5

| Sample No. | Sensitivity | Remarks |
|---|---|---|
| 201 | 135 | Invention |
| 202 | 145 | Invention |
| 203 | 165 | Invention |
| 204 | 105 | Comparison |
| 205 | 100 | Comparison |

It is revealed that when the ratio of grains having a distance between twin planes of 0.016 μm or less surpasses 50%, photographic sensitivity increases very remarkably.

Example 21

Preparation of Emulsion 21-A

Emulsion 21-A was prepared by changing the preparation conditions of Emulsion 1-D of Example 1 as follows:

(i) 0.3 g of KI was added to (1st solution), and (ii) The addition amounts of Ag-1, X-1 and G-1 of (addition-1) were properly decreased.

Preparation of Emulsion 21-B

Emulsion 21-B was prepared by changing the preparation conditions of emulsion 1-D of Example 1 as follows:

(i) Gelatin-4 used in (1st solution) was changed to Gelatin-5, and the addition amount was changed from 1.1 g to 2.5 g, and (ii) Gelatin-4 used in G-1 of (addition-1) was changed to Gelatin-5.

The characteristic values of the thus obtained emulsion grains are set forth in Table 6 below.

The similar chemical sensitization as Emulsion 1-A was performed to the emulsions.

TABLE 6

| Emulsion | COV of ECD (%) | Ratio (%) of grains having ECD of 3.5 μm or more and thickness of 0.25 μm or less | Ratio (%) of grains having a distance between twin planes of 0.016 μm or less (%) | COV of thickness (%) | COV of twin plane distance (%) | Remarks |
|---|---|---|---|---|---|---|
| 21-A | 26 | 65 | 65 | 47 | 49 | Invention |
| 1-D | 26 | 65 | 65 | 38 | 36 | Invention |
| 22-B | 26 | 65 | 65 | 28 | 26 | Invention |

COV = coefficient of variation.
ECD = equivalent circular diameter.

The above Emulsions 21-A and 21-B were made to green-sensitive silver halide emulsions each having a wavelength whose spectral sensitivity is maximum at 550 nm, by performing spectral sensitization with the addition of the spectral sensitizer Exs-1 at the chemical sisnsitization step during the aforementioned emulsion preparation.

Samples 2101 to 2103 were prepared by coating Emulsions 1-D, 21-A and 21-B in the similar manner as in Example 1. Further, evaluations of photographic properties were conducted in the similar manner as in Example 1. The results are set forth in Table 7. Each of the sensitivities is a reciprocal of exposure amount required to give fogging density plus 0.2, and expressed as a relative value assuming the sensitivity of Sample 2101 as 100.

TABLE 7

| Sample No. | Sensitivity | Remarks |
|---|---|---|
| 2101 | 100 | Invention |
| 2102 | 130 | Invention |
| 2103 | 140 | Invention |

As is apparent from Table 7, photographic sensitivity greatly increases by setting both of the coefficients of distribution of thickness and the coefficients of distribution of distance between twin planes to 40% or less.

Example 3

This example set forth the preparation, raw emulsion coating, and evaluations of tabular emulsion having dislocation lines using low-molecular-weight oxidized gelatin in a nucleation step thereof.

Preparation of Emulsion 3-A

An emulsion 3-A was prepared by changing the preparation conditions of the emulsion 1-H as follows:

(i) The pAg during (addition 2) was held at 8.44.

(ii) The pAg during (addition 3) was held at 8.44.

The obtained emulsion had an average grain thickness of 0.10 μm. Even when the pAg was increased, no reduction of the thickness was observed. The characteristic values of the emulsion grains are shown in Table 8 below.

This emulsions was also chemically sensitized similar to the emulsion 1-A.

Preparation of Emulsion 3-B

An emulsion 3-B was prepared by changing the preparation conditions of the emulsion 1-H as follows:

(i) Gelatin-4 in (1st solution) was replaced with gelatin-5, and the amount was changed from 1.1 g to 2.5 g.

(ii) Gelatin-4 in G-1 in (addition 1) was replaced with gelatin-5.

(iii) The ripening time after the temperature was raised to 75° C. was set to 3 min.

The tabular grains thus obtained had a thickness of 0.09 μm, so a reduction of the thickness was observed. The characteristic values of the emulsion grains are shown in Table 8.

This emulsion was also chemically sensitized similar to the emulsion 1-A.

TABLE 8

| | ECD | | Thickness | | Distance between twin planes | | |
|---|---|---|---|---|---|---|---|
| Emulsion No. | Average* (μm) | COV (%) | Average* (μm) | COV (%) | Average* (μm) | COV (%) | Remarks |
| 1-H | 4.45 | 25 | 0.10 | 31 | 0.012 | 25 | Invention |
| 3-A | 4.48 | 42 | 0.10 | 32 | 0.012 | 25 | Comparison |
| 3-B | 4.70 | 23 | 0.09 | 35 | 0.013 | 29 | Invention |

COV = coefficient of variation.
ECD = equivalent circular diameter.
*Average of grains occupying 50% or more in number of all the grains Each of the emulsions 3-A and 3-B was observed at liquid nitrogen temperature by using a 400-kV transmission electron microscope. Consequently, ten or more dislocation lines were present in a fringe portion of any tabular grain.

Note that the emulsions 3-A and 3-B were reduction-sensitized by adding disodium 4,5-dihydroxy-1,3-disulfonate monohydrate and thiourea dioxide immediately before (addition 2) in the aforementioned emulsion preparation process.

Note also that the emulsions 3-A and 3-B were spectrally sensitized by adding the sensitizing dye Exs-1 in the chemical sensitization step during the process of emulsion preparation. This made each of these emulsions a green-sensitive silver halide emulsion whose spectral sensitivity was a maximum at a wavelength of 550 nm.

Following the same procedures as in Example 1, samples 301 to 303 were formed by coating a support with the emulsions 1-H, 3-A, and 3-B. Furthermore, the photographic properties were evaluated in the same manner as in Example 1. The results are shown in Table 9. The sensitivity is indicated by the relative value of the reciprocal of an exposure amount required to reach a density of fog density plus 0.2 (the sensitivity of sample 301 is 100).

TABLE 9

| Sample No. | Sensitivity | Remarks |
|---|---|---|
| 301 | 100 | Invention |
| 302 | 87 | Comparison |
| 303 | 109 | Invention |

Although the pAg's of addition 2 and addition 3 of Emulsion 1-H are raised, the thickness of the grains did not become lower, and the emulsion became polydispersed (Emulsion 3-A). Thus, sensitivity decreased. On the contrary, by the use of the low molecular weight oxidation treated gelatin, grain thickness was successfully lowered, while maintaining the monodispersity, which results in the emulsion having high sensitivity.

Example 4

This example set forth preparation, raw emulsion coating, and evaluation of tabular emulsions having dislocation lines and differing in long edge/short edge ratio.

The long edge/short edge ratios of tabular grains of the emulsions 1-B and 1-C in Example 1 were measured and found to be 1.8 and 1.2, respectively.

Preparation of Emulsion 4-A

An emulsion 4-A was prepared by applying the changes in (addition 2) and (addition 3) of the emulsion 1-D to the preparation conditions of the emulsion 1-A in Example 1. The long edge/short edge ratio of the tabular grains was 1.2. The characteristic values of this emulsion are shown in Table 10.

Preparation of Emulsion 4-B

An emulsion 4-B was prepared by changing the preparation conditions of the emulsion 4-A as follows:

(i) The pAg during (addition 2) was held at 7.57, and (ii) The pAg during (addition 3) was held at 7.57.

The long edge/short edge ratio of the tabular grains thus obtained was 1.4.

The characteristic values of this emulsion are shown in Table 10.

This emulsion was also chemically sensitized similar to the emulsion 1-A.

TABLE 10

| Emulsion No. | ECD Average* (μm) | ECD COV (%) | Thickness Average* (μm) | Thickness COV (%) | Ratio of long side to short side | Remarks |
|---|---|---|---|---|---|---|
| 1-B | 3.43 | 44 | 0.17 | 48 | 1.8 | Comparison |
| 1-C | 2.73 | 22 | 0.27 | 31 | 1.2 | Comparison |
| 4-A | 3.41 | 22 | 0.17 | 35 | 1.2 | Invention |
| 4-B | 3.61 | 25 | 0.15 | 37 | 1.4 | Invention |

COV = coefficient of variation.
ECD = equivalent circular diameter.
*Average of grains occupying 50% or more in number of all the grains.

Each of the emulsions 4-A and 4-B was observed at liquid nitrogen temperature by using a 400-kV transmission electron microscope. Consequently, ten or more dislocation lines were present in a fringe portion of any tabular grain.

Note that the emulsions 4-A and 4-B were reduction-sensitized by adding disodium 4,5-dihydroxy-1,3-disulfonate monohydrate and thiourea dioxide immediately before (addition 2) in the aforementioned emulsion preparation process.

Note also that the emulsions 4-A and 4-B were spectrally sensitized by adding the sensitizing dye Exs-1 in the chemical sensitization step during the process of emulsion preparation. This made each of these emulsions a green-sensitive silver halide emulsion whose spectral sensitivity was a maximum at a wavelength of 550 nm.

Following the same procedures as in Example 1, samples 401 to 404 were formed by coating a support with the emulsions 1-B, 1-C, 4-A, and 4-B. Furthermore, the photographic properties were evaluated in the same manner as in Example 1. The results are shown in Table 11 below. It is apparent that the grains having the long edge/short edge ratio of nearer to 1 and also meeting the embodiments of the invention, have high sensitivity.

TABLE 11

| Sample No. | Sensitivity | Remarks |
|---|---|---|
| 401 | 100 | Comparison |
| 402 | 87 | Comparison |
| 403 | 118 | Invention |
| 404 | 116 | Invention |

Example 5

Silver halide emulsions H-5a, H-5b to H-5h were prepared by the following methods.

Manufacturing Method of Emulsion H-5a

In the preparation of the emulsion 1-A in Example 1, before chemical sensitization was performed a step of adding TAZ-1 was added, and the sensitizing dye initially added in chemical sensitization was changed to the combination of Exs-1, Exs-4, and Exs-5. An emulsion H-5a was prepared following substantially the same procedures as for the emulsion 1-A except the foregoing. The use amounts of the sensitizing dyes Exs-1, Exs-4, and Exs-5 were $5.50\times10^{-4}$, $1.30\times10^{-4}$, and $4.65\times10^{-5}$ mol, respectively, per mol of a silver halide.

TAZ-1

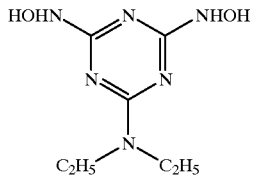

Exs-4

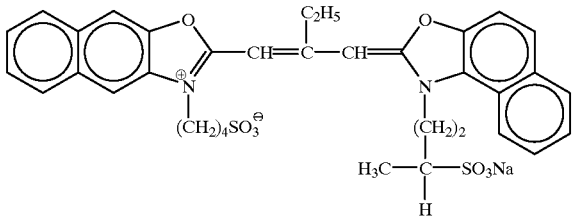

Exs-5

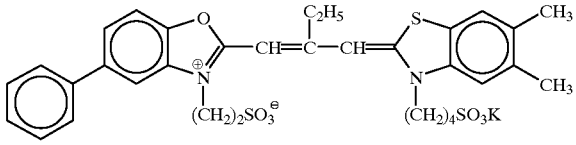

Manufacturing Method of Emulsions H-5b to H-5h

In the preparation of the emulsions 1-B to 1-H in Example 1, before chemical sensitization was performed a step of adding TAZ-1 was added, and the sensitizing dye initially added in chemical sensitization was changed to the combination of Exs-1, Exs-4, and Exs-5. Emulsions H-5b to H-5h were prepared following substantially the same procedures as for the emulsions 1-B to 1-H, respectively, except the foregoing. The use amounts of the sensitizing dyes were the same as for the emulsion H-5a.

Silver halide emulsions D to G, H-a, I-a, I-b and J to R were prepared in the following manner.

Manufacturing method of emulsion D 42.2L of an aqueous solution containing 31.7 g of low-molecular-weight gelatin phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-4 of Example 1 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 44.8 g of KBr were added. After that, the temperature was raised to 40° C. to ripen the material. After the ripening, 923 g of succinated gelatin-2 and 79.2 g of KBr were added, and 15,974 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the pAg of the bulk emulsion solution in the reaction vessel was held at 9.90.

After washing with water, gelatin-1 of Example 1 was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion.

1,211 mL of an aqueous solution containing 46 g of gelatin-2 of Example 1 and 1.7 g of KBr were vigorously stirred at 75° C. After 9.9 g of the seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added at an accelerated flow rate so that the silver iodide content was 27 mol %. At the same time, the pAg of the bulk emulsion solution in the reaction vessel was held at 8.60. 121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight.

Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80. After washing with water, gelatin-1of Example 1 was added, the pH and the pAg were adjusted to 5.8 and 8.7, respectively, at 40 C. After TAZ-1 was added, and the temperature was raised to 600C. After sensitizing dyes ExS-2 and ExS-3 were added, potassium thiocyanate, chloroauric acid, sodium thiosulfate, and N,N-dimethylselenourea were added to optimally perform chemical sensitization. At the end of this chemical sensitization, compounds 3 and 4 set forth below were added. "Optimal chemical sensitization" means that the addition amount of each of the sensitizing dyes and the compounds was $10^{-1}$ to $10^{-8}$ mol per mol of a silver halide.

TAZ-1

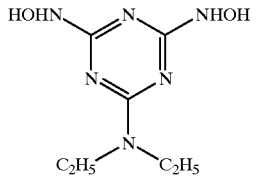

Exs-2

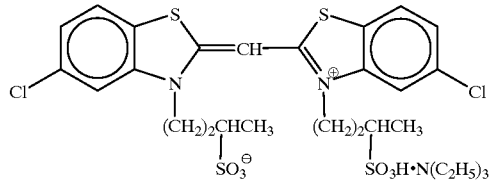

Exs-3

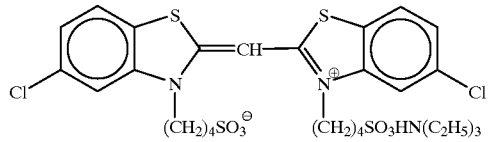

Compound 3

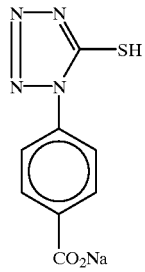

Compound 4

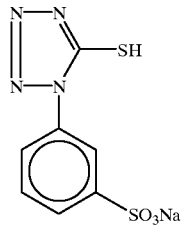

Manufacturing Method of Emulsion E 1,192 mL of an aqueous solution containing 0.96 g of gelatin-4 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of gelatin-3 of Example 1 were added, and the pH was adjusted to 7.6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion D was simultaneously added at an accelerated flow rate so that the silver iodide content was 15.8 mol %. At the same time, the pAg of the bulk emulsion solution in the reaction vessel was held at 7.85.

96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was raised to 55° C., an aqueous KBr solution was added to adjust the pAg of the bulk emulsion solution in the reaction vessel to 9.80. The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water and chemically sensitized in substantially the same manner as for the emulsion D.

Manufacturing method of emulsion F 1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion D was simultaneously added at an accelerated flow rate so that the silver iodide content was 2.3 mol %. At the same time, the pAg of the bulk emulsion solution in the reaction vessel was held at 8.50.

After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. The resultant emulsion was washed with water and chemically sensitized in substantially the same manner as for the emulsion D.

Manufacturing method of emulsion G

In the preparation of the emulsion F, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. An emulsiong was prepared following substantially the same procedures as for the emulsion F except the foregoing.

Manufacturing Method of Emulsion H-a

Emulsion H-a was prepared in almost the similar manner as for Emulsion G, except that the temperature at the nucleation was changed to 35° C.

Manufacturing method of emulsion I-a 1,200 mL of an aqueous solution containing 0.75 g of gelatin-4 of Example 1 and 0.9 g of KBr were held at 39° C. and stirred with violence at pH 1.8. An aqueous solution containing 1.85 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. After the pH was adjusted to 5.9, 2.9 g of KBr were added. 288 mL of an aqueous solution containing 27.4 g of $AgNO_3$ and an aqueous KBr solution were added over 53 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 25 min by the double jet method. The addition of the aqueous KBr solution was so adjusted that the pAg of the bulk emulsion solution in the reaction vessel was 8.15 at the end of the addition. The pH was adjusted to 7.3, and 1 mg of thiourea dioxide was added.

After KBr was added to adjust the pAg of the bulk emulsion solution in the reaction vessel to 9.50, the aforementioned AgI fine grain emulsion was added in an amount of 8.78 in terms of a KI weight. Immediately after the addition, 609 mL of an aqueous solution containing 63.3 g of $AgNO_3$ were added over 10 min. For the first 6 min of the addition, the pAg of the bulk emulsion solution in the reaction vessel was held at 9.50 by an aqueous KBr solution. After washing with water, gelatin-1 of Example 1 was added, and the pH and the pAg were adjusted to 6.5 and 8.2, respectively. The resultant emulsion was chemically sensitized in the same manner as for the emulsion H-a. Note that the use amounts of the sensitizing dyes ExS-1, ExS-4, and ExS-5 were $1.08\times10^{-3}$ mol, $2.56\times10^{-4}$ mol, and $9.16\times10^{-5}$ mol, respectively, per mol of a silver halide.

Manufacturing method of emulsion I-b

Emulsion I-b was prepared in almost the similar manner as for Emulsion I-a, except that the amount of the AgI fine grain emulsion that is added immediately before the addition of 609 mL of the final solution containing $AgNO_3$ was changed to 5.73 g in terms of KI weight, and the amount of $AgNO_3$ contained in that 609 mL final solution was changed to 66.4 g.

Manufacturing Method of Emulsion J 1,200 mL of an aqueous solution containing 0.70 g of gelatin-4 of Example 1, 0.9 g of KBr, 0.175 g of KI, and 0.2 g of the modified silicone oil used in the preparation of the emulsion D were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 $\mu$m was simultaneously added such that the silver iodide content was 4.1 mol %. This AgI fine grain emulsion was prepared, immediately before the addition, by mixing an aqueous solution of gelatin-4 of Example 1, an aqueous $AgNO_3$ solution, and an aqueous KI solution in another chamber having a magnetic coupling inductive stirrer described in JP-A-10-43570. At the same time, the pAg of the bulk emulsion solution in the reaction vessel was held at 9.15. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. At the same time, the pAg of the bulk emulsion solution in the reaction vessel was held at 9.30. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel as 7.90 at the end of the addition. After the temperature was raised to 78° C. and the pH was adjusted to 9.1, KBr was added to adjust the pAg of the bulk emulsion solution in the reaction vessel to 8.70. The AgI fine grain emulsion used in the preparation of the emulsion D was added in an amount of 5.73 g in terms of a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70. The resultant emulsion was washed with water and chemically sensitized in substantially the same manner as for the emulsion H-a. Note that the use amounts of the sensitizing dyes ExS-1, ExS-4, and ExS-5 were $1.25\times10^{-3}$ mol, $2.85\times10^{-4}$ mol, $3.29\times10^{-5}$ mol, respectively, per mol of a silver halide.

Manufacturing Method of Emulsion K

An aqueous solution containing 17.8 g of gelatin-1 of Example 1, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of gelatin-1 of Example 1 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate were added. After 14.4 g of KBr were added, the AgI fine grain emulsion used in the preparation of the emulsion D was added in an amount of 6.3 g as a KI weight. Immediately after the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. The resultant emulsion was washed with water and chemically sensitized substantially the same manner as for the emulsion H-a. Note that the use amounts of the sensitizing dyes ExS-1, ExS-4, and ExS-5 were $5.79\times10^{-4}$ mol, $1.32\times10^{-4}$ mol, $1.52\times10^{-5}$ mol, respectively, per mol of a silver halide.

Manufacturing Method of Emulsion L

An emulsion L was prepared following substantially the same procedures as for the emulsion K except that the nucleation temperature was changed to 35° C. Note that the use amounts of the sensitizing dyes ExS-1, ExS-4, and ExS-5 were $9.66\times10^{-4}$ mol, $2.20\times10^{-4}$ mol, and $2.54\times10^{-5}$ mol, respectively, per mol of a silver halide.

Manufacturing Method of Emulsion M 1,200 mL of an aqueous solution containing 0.75 g of gelatin-4 of Example 1 and 0.9 g of KBr were held at 39° C. and stirred with violence at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. The pH was adjusted to 5.9, and 2.9 g of KBr were added. After 3 mg of thiourea dioxide were added, and 288 mL of an aqueous solution containing 28.8 g of $AgNO_3$ and an aqueous KBr solution were added over 58 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the abovementioned AgI fine grain emulsion was simultaneously added such that the silver iodide content was 10.5 mol %. At the same time, the pAg of the bulk emulsion solution in the reaction vessel was held at 9.50.

132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition. After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 in terms of a KI weight. Immediately after the addition, 609 mL of an aqueous solution containing 66.4 g of $AgNO_3$ were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively, at 40° C. Then, TAZ-1 was added and the temperature was raised to 56° C. The sensitizing dyes ExS-1 and ExS-6 were added. After that, potassium thiocyanate, chloroauric acid, sodium thiosulfate, and N,N-dimethylselenourea were added to ripen and optimally chemically sensitize the emulsion. At the end of the chemical sensitization, MER-1 and MER-3 were added. Note that the use amounts of the sensitizing dyes ExS-1 and ExS-6 were $3.69\times10^{-4}$ mol and $8.19\times10^{-4}$ mol, respectively, per mol of a silver halide.

TAZ-1

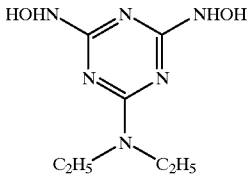

Exs-6

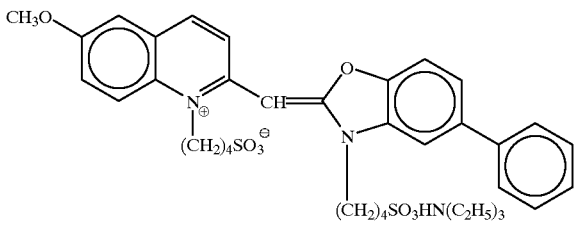

MER-1

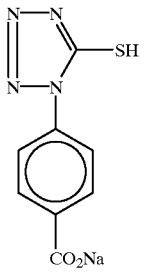

-continued

MER-3

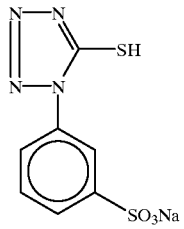

Manufacturing Method of Emulsion N 1,200 mL of an aqueous solution containing 0.38 g of gelatin-2 of Example 1 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion D was simultaneously added at an accelerated flow rate such that the silver iodide content was 6.5 mol %. At the same time, the pAg of the bulk emulsion solution in the reaction vessel was held at 9.05.

After 1.5 mg of thiourea dioxide were added, 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The abovementioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively. After TAZ-1 was added, the temperature was raised to 58° C. The sensitizing dyes ExS-7, ExS-8, and ExS-9 were added. After that, $K_2IrCl_6$, potassium thiocyanate, chloroauric acid, sodium thiosulfate, and N,N-dimethylselenourea were added to optimally perform chemical sensitization. At the end of the chemical sensitization, MER-1 and MER-3 were added.

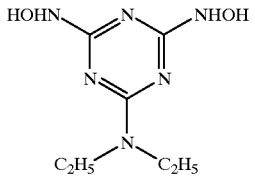

Exs-7

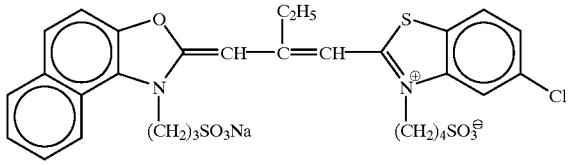

Exs-8

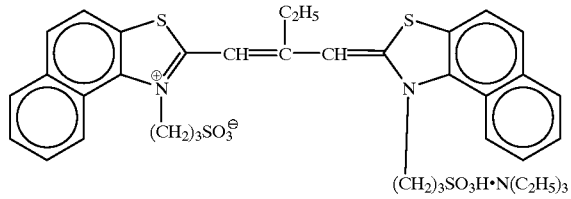

Exs-9

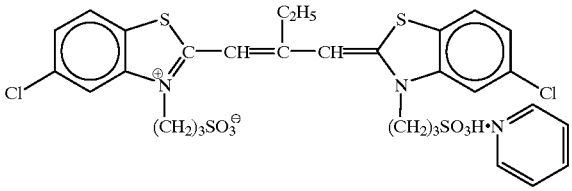

MER-1

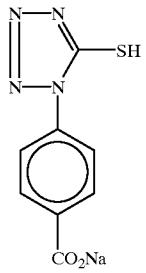

MER-3

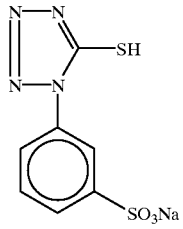

Manufacturing Method of Emulsion O

In the preparation of the emulsion N, the amounts of $AgNO_3$, KBr, and KI added during nucleation were changed to 1.96 g, 1.67 g, and 0.172 g, respectively. Also, the chemical sensitization temperature was changed from 58° C. to 61° C. An emulsion O was prepared following substantially the same procedures as for the emulsion N except the foregoing.

Manufacturing Method of Emulsion P 1,200 mL of an aqueous solution containing 4.9 g of gelatin-4 of Example 1 and 5.3 g of KBr were vigorously stirred at 40° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for the emulsion N.

Manufacturing Methods of Emulsions Q and R

Emulsions Q and R were prepared following substantially the same procedures as for the emulsions K and L, respectively, except that chemical sensitization was performed in substantially the same manner as for the emulsion O.

Characteristic values of the above silver halide emulsions are summarized in Table 12 below. The surface iodide content can be examined as follows by XPS. That is, a sample was cooled to −115° C. in a vacuum of $1.33\times10^{-6}$ Pa or less and irradiated with MgKα, as probe X-rays, at an X-ray source voltage of 8 kV and an X-ray current of 20 mA, thereby measuring Ag3d5/2, Br3d, and I3d5/2 electrons. The integral intensities of the measured peaks were corrected by a sensitivity factor, and the surface iodide content was calculated from these sensitivity ratios. Note that dislocation lines as described in JP-A-3-237450 were observed by a high-voltage electron microscope in silver halide grains of the emulsions G, H-a, I-a, I-b and J to R.

TABLE 12

| Emulsion | ECD*1 (μm) COV*2 (%) | Thickness (μm) COV (%) | Aspect ratio COV (%) | Tabularity | Twin planes distance (μm) COV (%) | Ratio of (111) tabular grains*3 | (100) face ratio*4 | AgI content (mol %) COV (%) | AgCl content (mol %) | Surface AgI content (mol %) |
|---|---|---|---|---|---|---|---|---|---|---|
| D | 1.98 | 0.198 | 10 | 51 | 0.014 | 92 | 23 | 15 | 0 | 4.3 |
| | 23 | 28 | 35 | | 32 | | | 17 | | |
| E | 1.30 | 0.108 | 12 | 111 | 0.013 | 93 | 22 | 11 | 0 | 3.6 |
| | 25 | 27 | 38 | | 30 | | | 16 | | |
| F | 1.00 | 0.083 | 12 | 145 | 0.012 | 93 | 18 | 4 | 1 | 1.8 |
| | 27 | 26 | 37 | | 30 | | | 8 | | |
| G | 0.75 | 0.075 | 10 | 133 | 0.010 | 91 | 33 | 4 | 2 | 1.9 |
| | 31 | 18 | 29 | | 27 | | | 8 | | |
| H-a | 2.01 | 0.161 | 12.5 | 78 | 0.011 | 99 | 23 | 3.9 | 0 | 6.1 |
| | 18 | 18 | 25 | | 23 | | | 5 | | |
| I-a | 1.54 | 0.077 | 20 | 260 | 0.013 | 99 | 23 | 8.4 | 0 | 6.2 |
| | 26 | 18 | 33 | | 26 | | | 8 | | |
| I-b | 1.54 | 0.077 | 20 | 260 | 0.013 | 99 | 23 | 7 | 0 | 2.5 |
| | 26 | 18 | 33 | | 26 | | | 7 | | |
| J | 1.08 | 0.072 | 15 | 208 | 0.008 | 97 | 23 | 6 | 0 | 2.0 |
| | 18 | 15 | 19 | | 22 | | | 5 | | |
| K | 0.44 | 0.220 | 2 | 9 | 0.013 | 90 | 38 | 3 | 2 | 1.0 |
| | 16 | 13 | 9 | | 18 | | | 6 | | |
| L | 0.33 | 0.165 | 2 | 12 | 0.013 | 88 | 42 | 3 | 2 | 1.0 |
| | 17 | 13 | 12 | | 18 | | | 6 | | |
| M | 2.25 | 0.107 | 21 | 197 | 0.013 | 99 | 20 | 7.2 | 0 | 2.4 |
| | 31 | 19 | 34 | | 33 | | | 7 | | |
| N | 2.38 | 0.138 | 17 | 125 | 0.013 | 98 | 23 | 5 | 1 | 1.6 |
| | 20 | 20 | 23 | | 19 | | | 6 | | |
| O | 1.83 | 0.122 | 15 | 123 | 0.012 | 98 | 23 | 5 | 1 | 1.8 |
| | 18 | 20 | 22 | | 19 | | | 6 | | |
| P | 0.84 | 0.120 | 7 | 58 | 0.013 | 99 | 25 | 3 | 0 | 2.7 |
| | 17 | 18 | 19 | | 16 | | | 7 | | |
| Q | 0.44 | 0.220 | 2 | 9 | 0.013 | 88 | 42 | 2 | 2 | 1.0 |
| | 17 | 13 | 12 | | 18 | | | 6 | | |
| R | 0.33 | 0.165 | 2 | 12 | 0.013 | 88 | 46 | 1 | 2 | 0.5 |
| | 17 | 13 | 12 | | 18 | | | 6 | | |

*1ECD = equivalent circular diameter.
*2COV = coefficient of variation.
*3Ratio (%) of tabular grains having main planes of (111) face to total projected area of all the grains.
*4Ratio (%) of (100) faces to the total side surface.

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, i-4, i-6, i-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·m, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-y-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m2 of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of DB of the magnetic recording layer measured by an X-light (blue filter) was about 0.1. The saturation magnetization moment, coercive force, and squareness ratio of the magnetic recording layer were 4.2 $Am^2/kg$, $7.3\times10^4$ A/m, and 65%, respectively.

3-3) Preparation of Slip Layer

The surface was then coated with diacetylcellulose (25 $mg/m^2$) and a mixture of $C_6H_{13}CH(OH)C_{10}H_{20}COOC_{40}H_{81}$ (compound a, 6 $mg/m^2$)/$C_{50}H_{101}O(CH_2CH_2O)_{16}H$ (compound b, 9 $mg/m^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 $mg/m^2$ of silica grains (0.3 μm) were added as a matting agent, and 15 $mg/m^2$ of aluminum oxide (0.15 μm) coated with 3-poly (polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface of the support on the side away from the back layers formed as above was coated with a plurality of layers having the following compositions to form a sample as a color negative sensitized material, thereby to prepare Sample 501.

Compositions of Sensitive Layers

The main ingredients used in the individual layers are classified as follows, however, the use thereof are not limited to those specified below.

ExC: Cyan coupler

ExM: Magenta coupler

ExY: Yellow coupler

UV: Ultraviolet absorbent

HBS: High-boiling organic solvent

H: Gelatin hardener (In the following description, practical compounds have numbers attached to their symbols. Formulas of these compounds will be presented later.) The number corresponding to each component indicates the coating amount in units of $g/m^2$. The coating amount of a silver halide is indicated by the amount of silver.

| 1st layer (1st antihalation layer) | | |
|---|---|---|
| Black colloidal silver | silver | 0.155 |
| Silver iodobromide emulsion T | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |

-continued

| 2nd layer (2nd antihalation layer) | | |
|---|---|---|
| Black colloidal silver | silver | 0.066 |
| Gelatin | | 0.407 |
| ExM-1 | | 0.050 |
| ExF-1 | | $2.0\times10^{-3}$ |
| HBS-1 | | 0.074 |
| Solid disperse dye ExF-2 | | 0.015 |
| Solid disperse dye ExF-3 | | 0.020 |
| 3rd layer (Interlayer) | | |
| Silver iodobromide emulsion S | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver iodobromide emulsion R | silver | 0.065 |
| Silver iodobromide emulsion Q | silver | 0.258 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion P | silver | 0.21 |
| Silver iodobromide emulsion O | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodochlorobromide emulsion N | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (layer for donating interimage effect to red-sensitive layer) | | |
| Silver iodobromide emulsion M | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion L | silver | 0.39 |
| Silver iodochlorobromide emulsion K | silver | 0.28 |
| Silver iodobromide emulsion J | silver | 0.35 |
| ExM-2 | | 0.36 |

-continued

| | | |
|---|---|---|
| ExM-3 | | 0.045 |
| ExG-1 | | 0.005 |
| Cpd-3 | | 0.010 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver iodobromide emulsion I-a | silver | 0.45 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Silver iodobromide emulsion I-a | silver | 0.30 |
| Silver iodobromide emulsion H-a | silver | 0.69 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.01 |
| Cpd-1 | | 0.16 |
| Solid disperse dye ExF-6 | | 0.153 |
| Oil-soluble dye ExF-5 | | 0.010 |
| HBS-1 | | 0.082 |
| Gelatin | | 1.057 |
| 13th layer (Low-speed blue-sensitive emulsion layer) | | |
| Silver iodobromide emulsion G | silver | 0.18 |
| Silver iodobromide emulsion E | silver | 0.20 |
| Silver iodochlorobromide emulsion F | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion D | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| Silver iodobromide emulsion S | silver | 0.30 |
| UV-1 | | 0.21 |
| UV-2 | | 0.13 |
| UV-3 | | 0.20 |
| UV-4 | | 0.025 |
| F-18 | | 0.009 |
| F-19 | | 0.005 |
| F-20 | | 0.005 |

-continued

| | |
|---|---|
| HBS-1 | 0.12 |
| HBS-4 | $5.0 \times 10^{-2}$ |
| Gelatin | 2.3 |
| 16th layer (2nd protective layer) | |
| H-1 | 0.40 |
| B-1 (diameter 1.7 $\mu$m) | $5.0 \times 10^{-2}$ |
| B-2 (diameter 1.7 $\mu$m) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively. Preparation of dispersions of organic solid disperse dyes ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K. K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.44 $\mu$m.

Following the same procedure as above, solid dispersions ExF-4 was obtained. The average grain sizes of the fine dye grains was 0.45. ExF-2 was dispersed by a microprecipitation dispersion method described in Example 1 of EP549, 489A. The average grain size was found to be 0.06 $\mu$m.

A solid dispersion ExF-6 was dispersed by the following method.

4.0 Kg of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Preparation of Solid Fine Dispersion of a Sensitizing Dye

The sensitizing dyes of the invention were used in a form of a solid fine dispersion that was prepared in the method of JP-A-11-52507.

For example, solid fine dispersion of Sensitizing dye ExC-1 was prepared as follows.

0.8 parts by weight of $NaNO_3$ and 3.2 parts by weight of $Na_2SO_4$ was dissolved into 43 parts by weight of ion-exchanged water. 13 parts by weight of the sensitizing dye ExC-1 was added thereto and dispersed by using a dissolver blade at 2000 rpm for 20 min under the condition of 60° C. to obtain a solid dispersion of sensitizing dye ExC-1.
Compounds used in the formation of each layer were as follows.
ExC-1
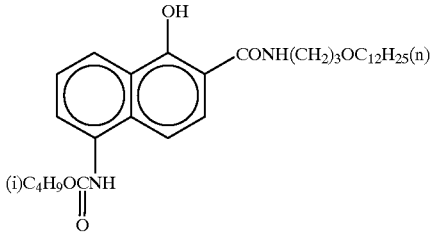
ExC-2
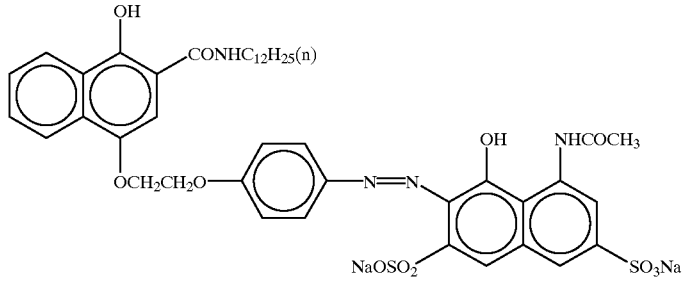
ExC-3
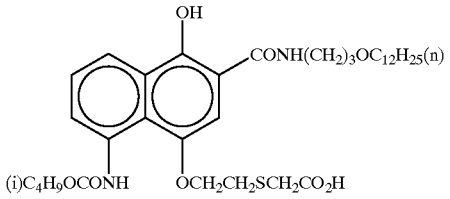
ExC-4
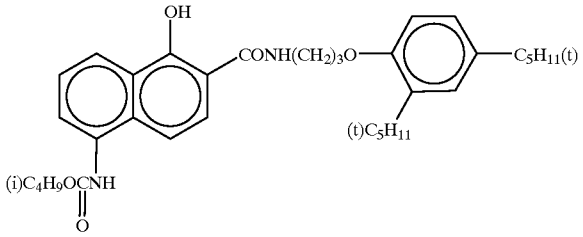
ExC-5
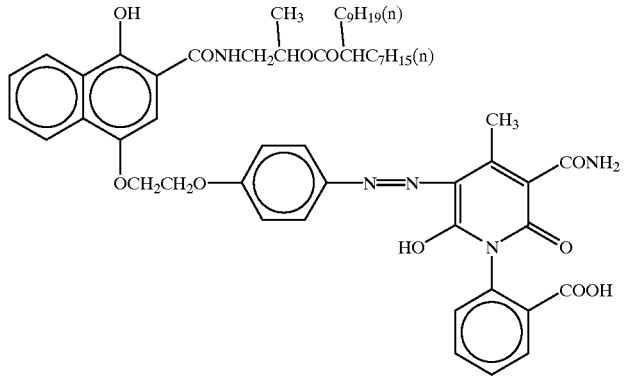

-continued
ExC-6
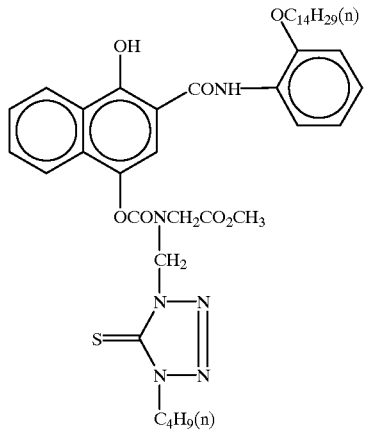
ExC-7
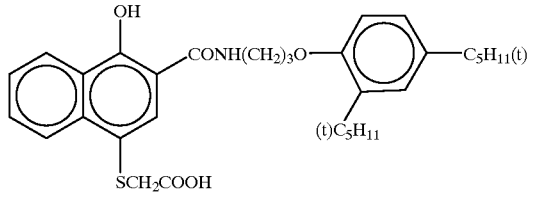
ExC-8
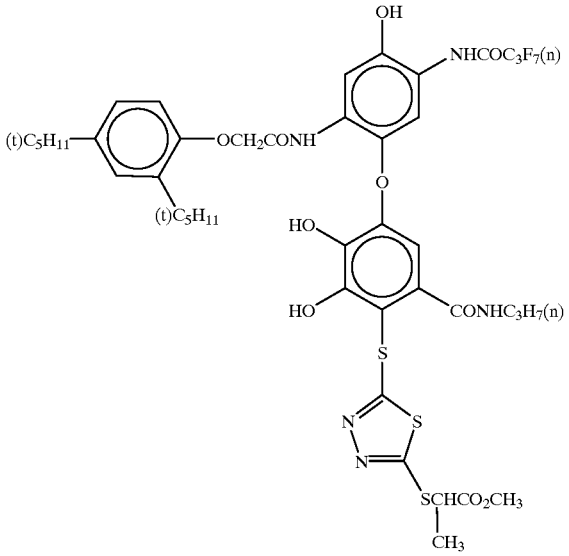
ExM-1
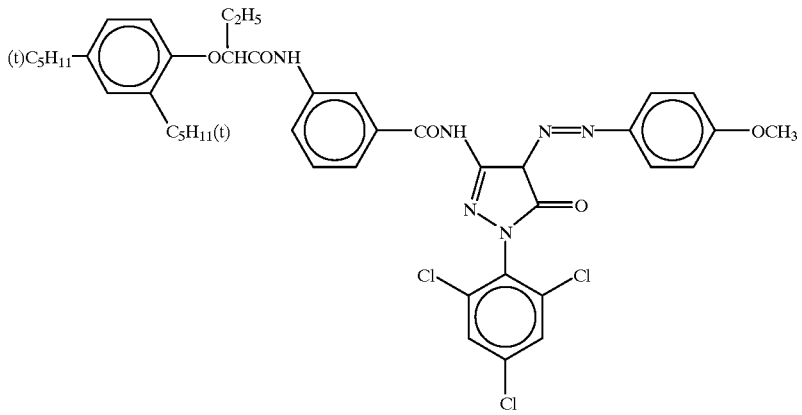

-continued
ExM-2
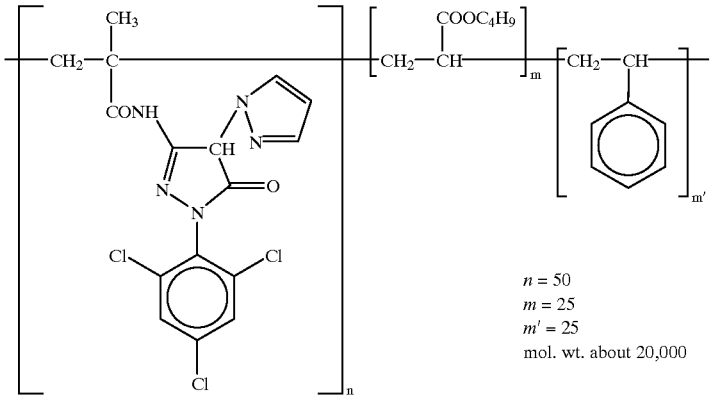
ExM-3
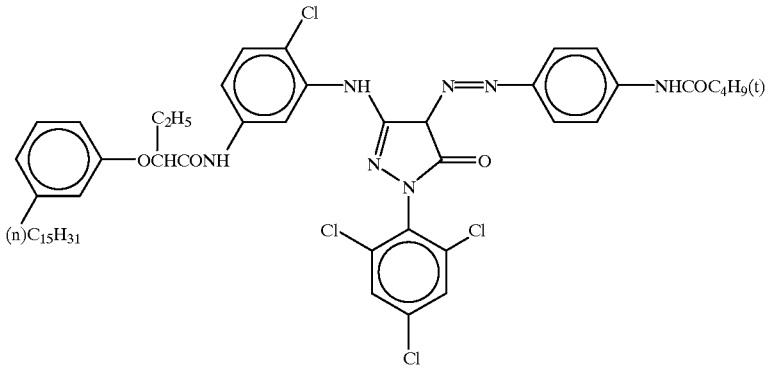
ExM-4
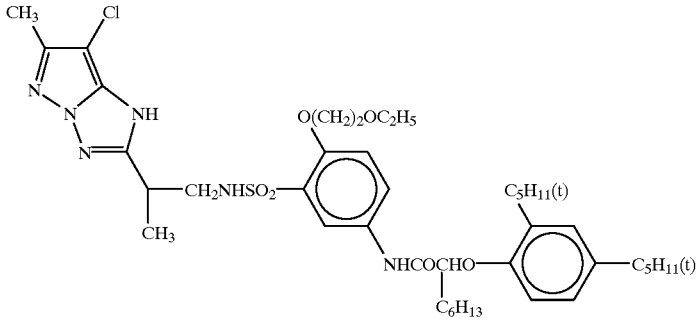
ExM-5
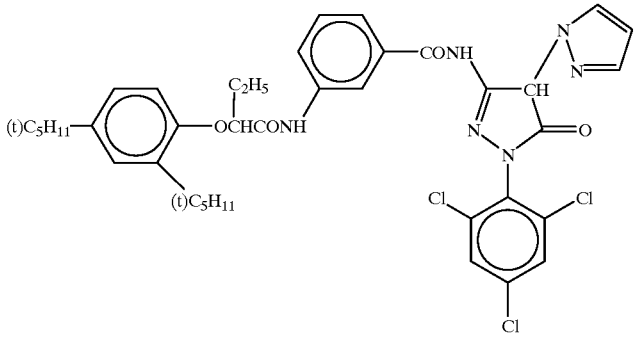

-continued
ExY-1
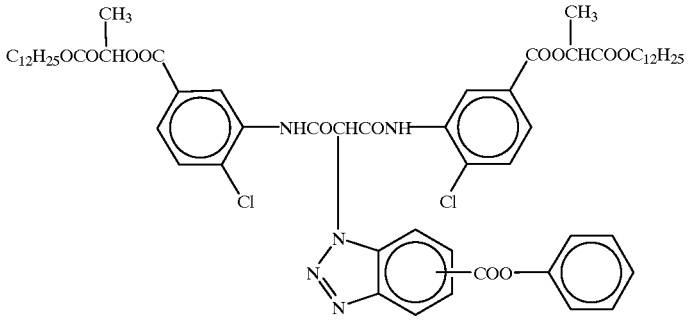
ExY-2
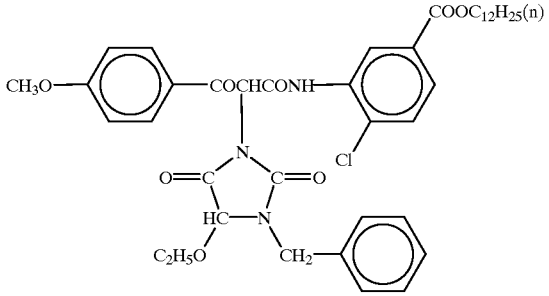
ExY-3
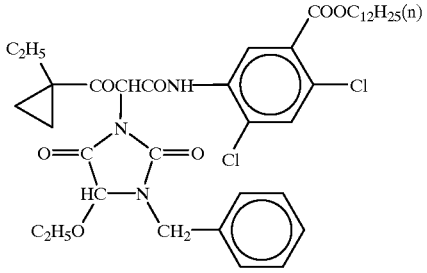
ExY-4
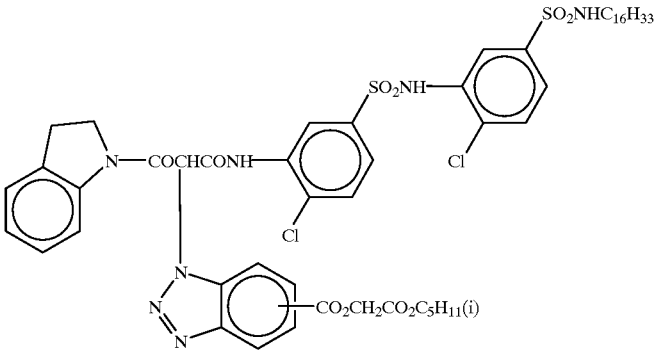

-continued
ExY-5
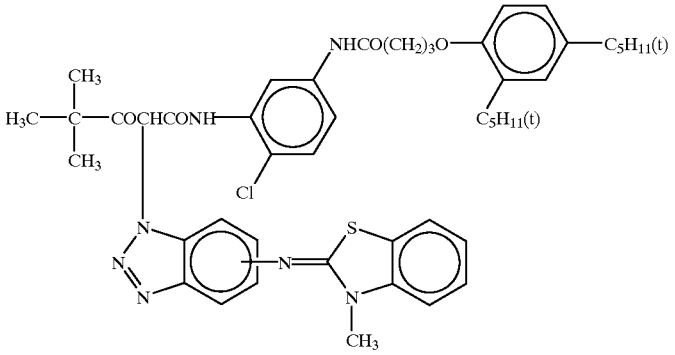
ExY-6
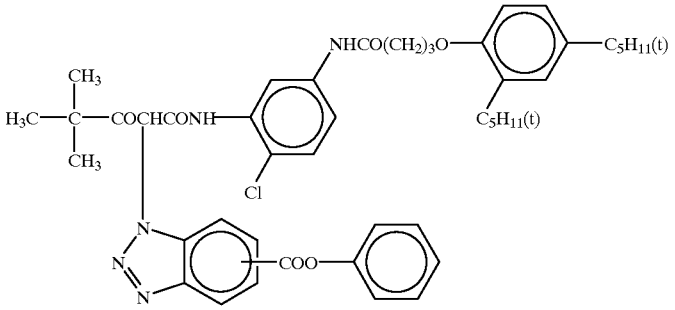
ExG-1
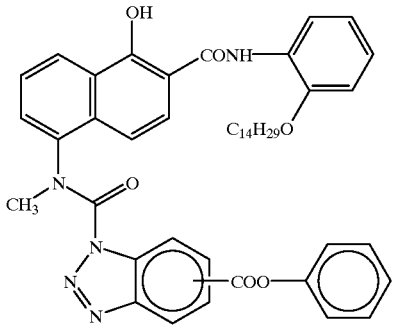
ExF-1
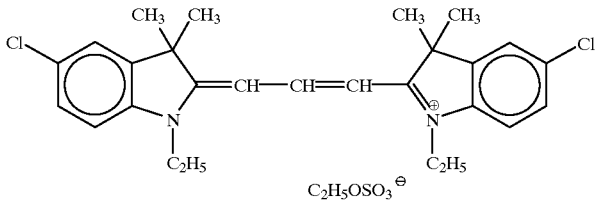
ExF-2
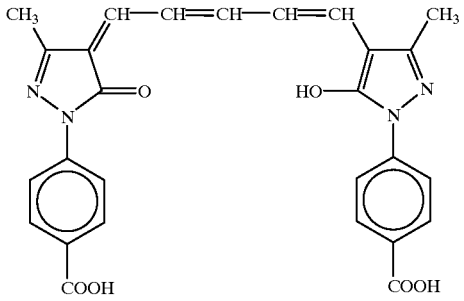

-continued
ExF-3
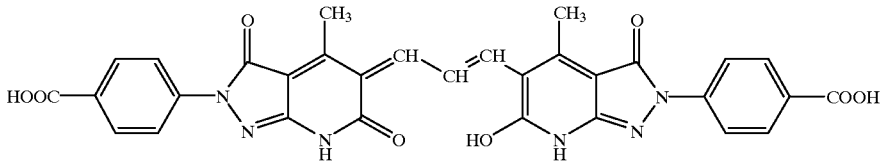
ExF-4
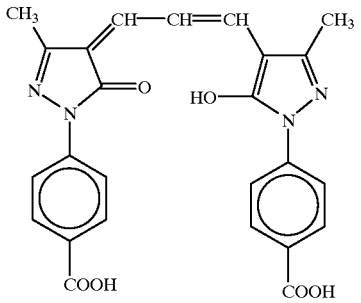
ExF-5
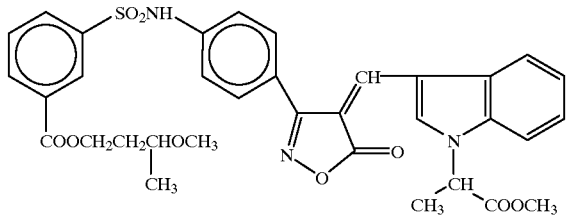
ExF-6
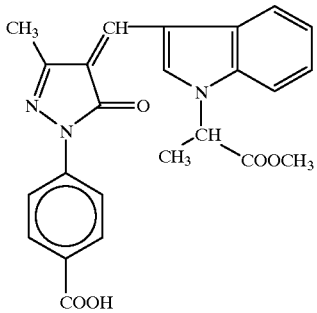
Cpd-1
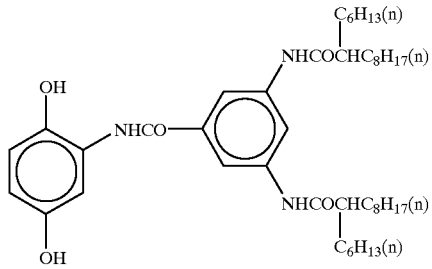
Cpd-2
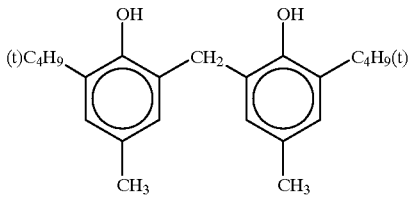

-continued
Cpd-3
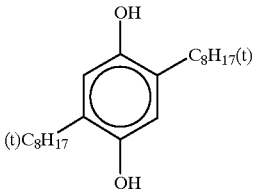
Cpd-4
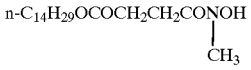
UV-1
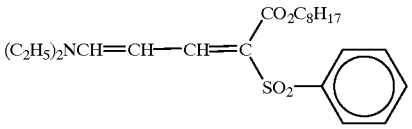
UV-2
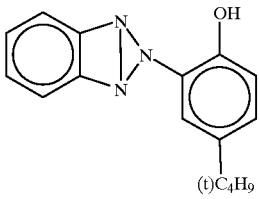
UV-3
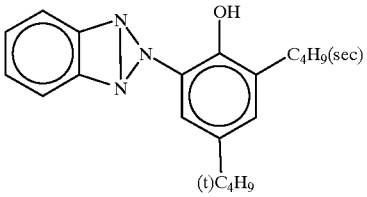
UV-4
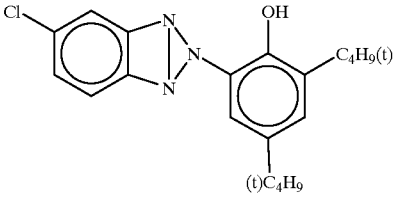
HBS-1
Tricresylphosphate
HBS-2
Di-n-butylphthalate
HBS-3
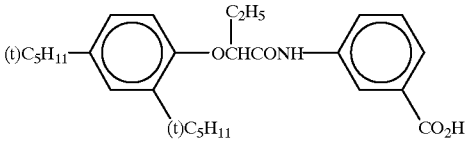
HBS-4
Tri(2-ethylhexyl)phosphate
H-1
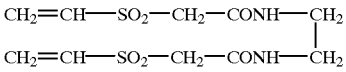
S-1
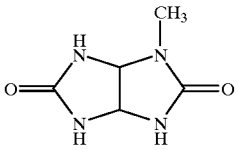
B-1
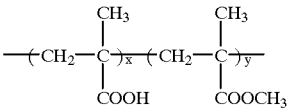
*x*/*y* = 10/90 (Weight ratio)
Average mol. wt. : about 35,000
B-2
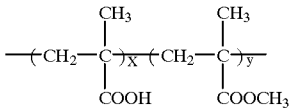
*x*/*y* = 40/60 (Weight ratio)
Average mol. wt. : about 20,000
B-3
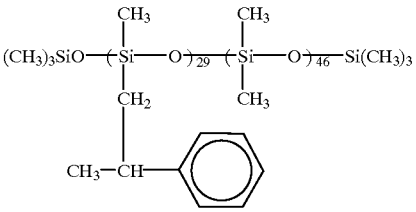
(Molar ratio)
Average mol. wt. : about 8,000
B-4
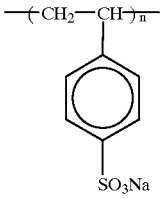
Average mol. wt. : about 750,000

-continued
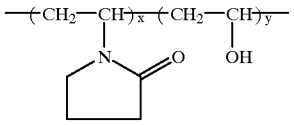
*x/y* = 70/30 (Weight ratio)
Average mol. wt. : about 17,000
B-5
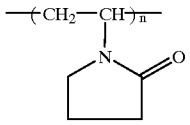
Average mol. wt. : about 10,000
B-6
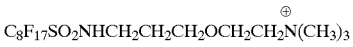
W-1
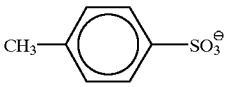
W-2
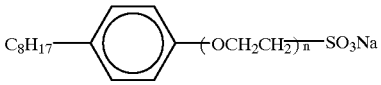
*n* = 2-4
W-3
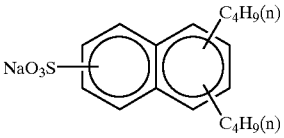
W-4
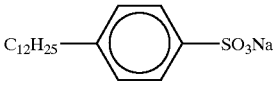
W-5
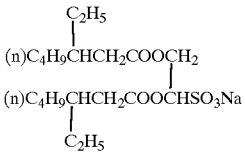
F-1
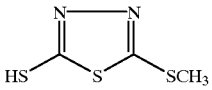
F-2
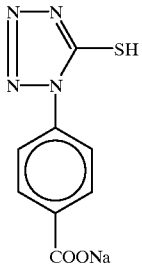
F-3
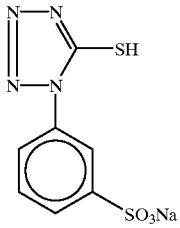
F-4
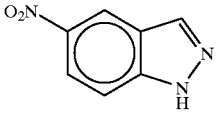
F-5
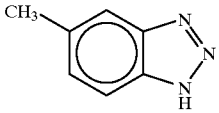
F-6
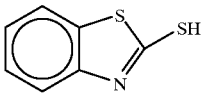
F-7
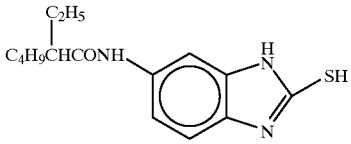
F-8
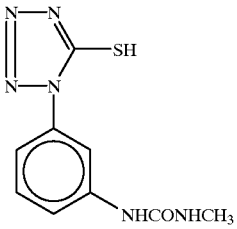
F-9
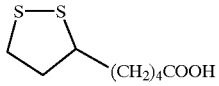

-continued

F-10

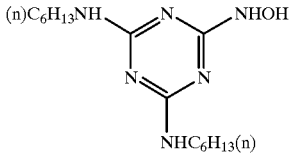

F-11

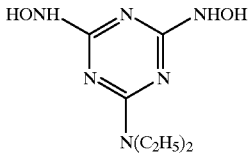

F-12

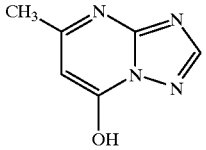

F-13

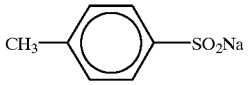

F-14

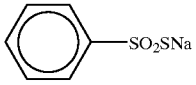

F-15

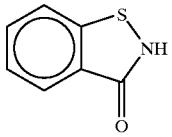

F-16

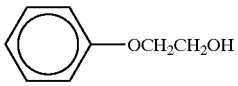

F-17

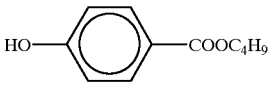

F-18

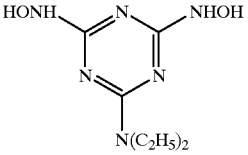

F-19

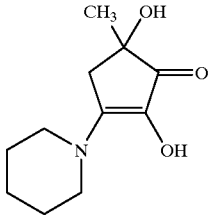

F-20

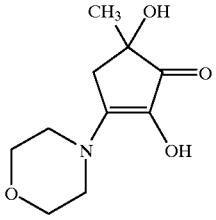

Preparation of Samples 502 to 509

Samples 502 to 509 were prepared by replacing Emulsions I-a and H-a in the 11th layer with Emulsions H-5a to H-5h.

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each cross-over time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | [Tank solution] (g) | [Replenisher] (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixer (1) Tank solution) | | |
| A 5:95 mixture (v/v) of the above bleaching tank solution and the below fixing tank solution pH 6.8 | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |

Washing Water

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The photographic performance of the thus processed samples were evaluated by measuring density with a green filter. The sensitivity is indicated by the relative value of the reciprocal of an exposure amount required to reach a magenta density of fog density plus 0.2. The results are set forth in Table 13. The advantages of the invention were demonstrated with multi-layered samples in the similar manner as in single layer samples.

TABLE 13

| Sample No. | Sensitivity | Remarks |
|---|---|---|
| 502 | 100 | Comparison |
| 503 | 101 | Comparison |
| 504 | 89 | Comparison |
| 505 | 103 | Invention |
| 506 | 109 | Invention |
| 507 | 110 | Invention |
| 508 | 112 | Invention |
| 509 | 115 | Invention |

Example 6

Manufacturing Method of Emulsion H-6A

In the preparation of the emulsion 2-A in Example 2, before chemical sensitization was performed a step of adding TAZ-1 was added, and the sensitizing dye initially added in chemical sensitization was changed to the combination of Exs-1, Exs-4, and Exs-5. An emulsion H-6A was prepared following substantially the same procedures as for the emulsion 2-A except the foregoing. The use amounts of the sensitizing dyes Exs-1, Exs-4, and Exs-5 were $5.50\times10^{-4}$, $1.30\times10^{-4}$, and $4.65\times10^{-5}$ mol, respectively, per mol of a silver halide.

Manufacturing Method of Emulsions H-6E, J and K

In the preparation of the emulsions 2-E, J and K in Example 2, before chemical sensitization was performed a step of adding TAZ-L was added, and the sensitizing dye initially added in chemical sensitization was changed to the combination of Exs-1, Exs-4, and Exs-5. The use amount of each sensitizing dye is the same as in above Emulsion H-6A.

Samples 601 to 605 were formed by replacing the emulsion H-5a in Example 5 with the emulsions H-5e and H-6A, E, J and K, and their photographic properties were evaluated following the same procedures as in Example 5. The results are shown in Table 14. The sensitivity is indicated by the relative value of the reciprocal of an exposure amount required to reach a density of fog density plus 0.2 (the sensitivity of sample 601 is 100). The similar results as in single layer samples were obtained.

TABLE 14

| Sample No. | Sensitivity | Remarks |
|---|---|---|
| 601 | 135 | Invention |
| 602 | 145 | Invention |
| 603 | 165 | Invention |
| 604 | 105 | Comparison |
| 605 | 100 | Comparison |

Example 7

Manufacturing Method of Emulsion H-7a

In the preparation of the emulsion 3-A in Example 3, before chemical sensitization was performed a step of adding TAZ-1 was added, and the sensitizing dye initially added in chemical sensitization was changed to the combination of Exs-1, Exs-4, and Exs-5. An emulsion H-7a was prepared following substantially the same procedures as for the emulsion 3-A except the foregoing. The use amounts of the sensitizing dyes Exs-1, Exs-4, and Exs-5 were $5.50\times10^{-4}$, $1.30\times10^{-4}$, and $4.65\times10^{-5}$ mol, respectively, per mol of a silver halide.

Manufacturing Method of Emulsion H-7b

In the preparation of the emulsion 3-B in Example 3, before chemical sensitization was performed a step of adding TAZ-1 was added, and the sensitizing dye initially added in chemical sensitization was changed to the combination of Exs-1, Exs-4, and Exs-5. An emulsion H-7b was prepared following substantially the same procedures as for the emulsion 3-B except the foregoing. The use amounts of the sensitizing dyes were the same as for the emulsion H-7a.

Samples 701 to 703 were formed by replacing the emulsion H-5a in Example 5 with the emulsions H-6K, H-7a, and H-7b, and their photographic properties were evaluated following the same procedures as in Example 5. The results are shown in Table 15. The sensitivity is indicated by the relative value of the reciprocal of an exposure amount required to reach a density of fog density plus 0.2 (the sensitivity of sample 701 is 100).

TABLE 15

| Sample No. | Sensitivity | Remarks |
|---|---|---|
| 701 | 100 | Comparison |
| 702 | 92 | Comparison |
| 703 | 105 | Invention |

Example 8

Manufacturing Method of Emulsion H-8a

In the preparation of the emulsion 4-A in Example 4, before chemical sensitization was performed a step of adding TAZ-1 was added, and the sensitizing dye initially added in chemical sensitization was changed to the combination of Exs-1, Exs-4, and Exs-5. An emulsion H-8a was prepared following substantially the same procedures as for the emulsion 4-A except the foregoing. The use amounts of the sensitizing dyes Exs-1, Exs-4, and Exs-5 were $5.50\times10^{-4}$, $1.30\times10^{-4}$, and $4.65\times10^{-5}$ mol, respectively, per mol of a silver halide.

Manufacturing Method of Emulsion H-8b

In the preparation of the emulsion 4-B in Example 4, before chemical sensitization was performed a step of adding TAZ-1 was added, and the sensitizing dye initially added in chemical sensitization was changed to the combination of Exs-1, Exs-4, and Exs-5. An emulsion H-8b was prepared following substantially the same procedures as for the emulsion 4-B except the foregoing. The use amounts of the sensitizing dyes were the same as for the emulsion H-8a.

Samples 801 to 804 were formed by replacing the emulsion H-5a in Example 5 with the emulsions H-5b, H-5c, H-8a, and H-8b, and their photographic properties were evaluated following the same procedures as in Example 5. The results are shown in Table 16. The sensitivity is indicated by the relative value of the reciprocal of an exposure amount required to reach a density of fog density plus 0.2 (the sensitivity of sample 801 is 100).

TABLE 16

| Sample No. | Sensitivity | Remarks |
|---|---|---|
| 801 | 100 | Comparison |
| 802 | 94 | Comparison |
| 803 | 109 | Invention |
| 804 | 107 | Invention |

In each of the above examples, samples to be compared were equal in granularity. Accordingly, each sample having high sensitivity was superior in sensitivity/graininess ratio.

Example 9

Preparation of Emulsions

Emulsion 9-A 1,300 mL of an aqueous solution containing 0.5 g of KBr and 1.1 g of gelatin-4 described above was stirred at 35° C. (1st solution preparation). 35 mL of an aqueous solution Ag-1 (containing 4.9 g of $AgNO_3$ in 100 mL), 27 mL of an aqueous solution X-1 (containing 5.2 g of kBr in 100 mL), and 8.5 mL of an aqueous solution G-1 (containing 8.0 g of gelatin-4 in 100 mL) were added over 30 sec at fixed flow rates by the triple-jet method (addition 1). After that, 6.5 g of KBr were added, and the temperature was raised to 75° C. After the temperature was raised, a ripening step was performed for 20 min, and 300 mL of an aqueous solution G-2 (containing 12.7 g of gelatin-3 described above in 100 mL) were added.

Subsequently, 157 mL of an aqueous solution Ag-2 (containing 22.1 g of $AgNO_3$ in 100 mL) and an aqueous solution x-2 (containing 15.5 g of KBr in 100 mL) were added over 14 min by the double-jet method. During the addition, the flow rate of the aqueous solution Ag-2 was accelerated such that the final flow rate was 3.4 times the initial flow rate. The addition of the aqueous solution X-2 was so performed that the pAg of the bulk emulsion solution in a reaction vessel was held at 8.1 (addition 2). 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 27 min by the double-jet method. During the addition, the flow rate of the aqueous solution Ag-3 was accelerated such that the final flow rate was 1.6 times the initial flow rate. The addition of the aqueous solution X-3 was so performed that the pAg of the bulk emulsion solution in the reaction vessel was held at 8.0 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double-jet method. The addition of the aqueous solution Ag-4 was performed at a fixed flow rate. The addition of the aqueous solution X-4 was so performed that the pAg of the bulk emulsion solution in the reaction vessel was held at 7.7 (addition 4). After that, 125 mL of an aqueous solution G-3 (containing 12.0 g of gelatin-1 described above in 100 mL) were added.

Subsequently, the temperature was lowered to 55° C., and 160 mL of an aqueous 0.3 M KI solution were added over 2 min (addition 5). One minute after that, sodium benzenethiosulfonate and $K_2IrCl_6$ were added, in the form of solutions, in amounts of $2\times10^{-6}$ mol/mol silver and $5\times10^{-9}$ mol/mol silver, respectively, with respect to the total silver amount of grains. One minute after that, 249 mL of the aqueous solution Ag-4 and an aqueous solution X-5 (containing 22.4 g of KBr and $1\times10^{-5}$ mol of $[Ru(trz)_6]^{4-}$ (trz=1,2,4-triazole) in 100 mL) were added over 9 min by the double-jet method. The addition of the aqueous solution Ag-4 was performed at a fixed flow rate. The addition of the aqueous solution X-5 was so performed that the pAg of the bulk emulsion solution in the reaction vessel was held at 8.0, and the pAg was finally adjusted to 7.8 (addition 6). After that, the emulsion was desalted by a common flocculation method. Water, NaOH, and the above mentioned gelatin-1 were added to the emulsion under stirring, and the pH and the pAg were adjusted to 6.4 and 8.6, respectively, at 56° C.

In the obtained emulsion, 99% or more of the projected are of all the grains were accounted for by tabular silver iodobromide grains having (111) faces as major surfaces.

Subsequently, the emulsion was optimally, chemically sensitized by sequentially adding sensitizing dyes Exs-1 to Exs-3 presented below, potassium thiocyanate, chloroauric acid, sodium thiosulfate, and N,N-dimethylselenourea. This chemical sensitization was completed by adding water-soluble mercapto compounds MER-1 and MER-2 presented below at a ratio of 4:1 such that the total amount was $3.6\times10^{-4}$ mol per mol of a silver halide. Optimal chemical sensitization means that the sensitivity is highest when 1/100-sec exposure is performed.

Sensitizing dye for green-sensitive emulsion Exs-1

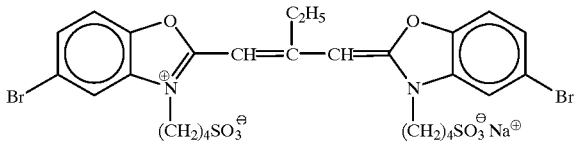

Sensitizing dye for green-sensitive emulsion Exs-2

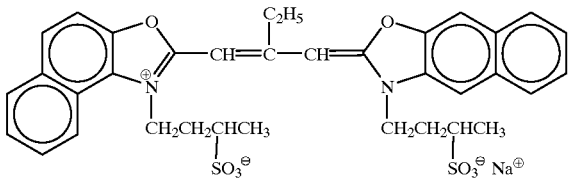

Sensitizing dye for green-sensitive emulsion Exs-3

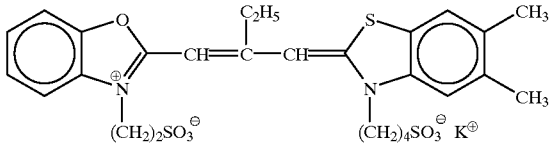

Sensitizing dyes for green-sensitive emulsion:

A mixture in a molar ratio of Exs-1: Exs-2: Exs-3=77:20:3

MER-1

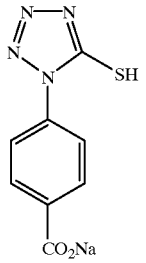

MER-2

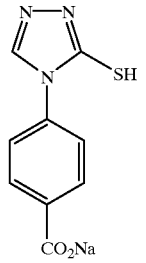

Emulsion 9-B

An emulsion 9-B was prepared following the same procedures as for the emulsion 9-A except that (addition 5) was changed as follows. That is, instead of 160 mL of the aqueous 0.3 M KI solution being added over 2 min, an emulsion containing 0.048 mol of AgI (AgI grain size =0.05 μm) was added, and the resultant material was ripened for 10 min.

Emulsion 9-C

An emulsion 9-C was prepared following the same procedures as for the emulsion 9-A except that (addition 5) was changed as follows. That is, instead of 160 mL of the aqueous 0.3 M KI solution being added over 2 min after the temperature was lowered to 55° C., the temperature was lowered to 40° C., and then an aqueous solution containing 0.048 mol of sodium p-iodoacetamidobenzenesulfonate as an iodide ion-releasing agent was added. After that, 60 mL of an aqueous 0.8 M sodium sulfite solution were added at a fixed flow rate over 1 min. While the pH was controlled to 9.0, iodide ions were produced. Two minutes after that, the temperature was raised to 55° C. over 15 min, and the pH was lowered to 5.5.

Emulsions 9-D to 9-S

Substrate grain emulsions different in the equivalent-circle diameter and thickness were prepared by changing the grain formation conditions (the pAg, addition rate, gelatin type and amount, and supply of silver and halide by continuous addition of ultrafine silver halide grains simultaneously prepared in another stirring mixer outside the reaction vessel) in (1st solution preparation) and (addition 1) to (addition 4). After that, the procedure from (addition 5) was performed as follows to prepare tabular grain emulsions 9-D to 9-S.

For the emulsions 9-D, 9-H, 9-L, and 9-P, the procedure from (addition 5) was performed in the same manner as for the emulsion 9-A.

For the emulsions 9-E and 9-I, the procedure from (addition 5) was performed in the same manner as for the emulsion 9-B.

For the emulsions 9-F, 9-J, 9-M, and 9-Q, the procedure from (addition 5) was performed in the same way as for the emulsion 9-C.

For the emulsions 9-G and 9-K, the procedure from (addition 5) was performed in the same way as for the emulsion 9-B except that in (addition 6) the pAg was held at 8.9 instead of 8.0.

For the emulsions 9-N and 9-R, the procedure from (addition 5) was performed in the same way as for the emulsion 9-C except that in (addition 6) the pAg was held at 7.4 instead of 8.0.

For the emulsions 9-O and 9-S, the procedure from (addition 5) was performed in the same manner as for the emulsion 9-C except that grains were grown by adding $HO(CH_2CH_2O)_m(CH(CH_3)CH_2O)_{19.8}(CH_2CH_2O_n)H$ (m+n=9.77) before (addition 2), and after that the pAg was held at 7.4, instead of 8.0, in (addition 6).

In the preparation of these emulsions, the addition rates of the aqueous silver nitrate solution and the aqueous halide salt solution were properly controlled to correspond to the critical growth rate of silver halide grains and prevent renucleation or polydispersion by Ostwald ripening.

Table 17 shows the grain characteristics of the obtained emulsions 9-A to 9-S. In these emulsions, the variation coefficient of the equivalent-circle diameters of all grains was 35%, and the variation coefficient of the thicknesses of all grains was 34%. Also, grains having a twin plane spacing of 0.016 μm or less accounted for 70% of all grains.

The shapes of grains in the emulsions were obtained by measuring 1,000 grains by taking transmission electron micrographs by the replica method. Additionally, the silver iodide content distributions in 20 grains of each emulsion were measured at an electron-beam spot spacing of 50 nm by a method of using an analytical electron microscope described in JP-A-7-219102. Consequently, the region of a grain fringe portion was about 0.10 to 0.25 μm. In any of these emulsions, the average silver iodide content of a grain fringe portion was higher by 2.0 mol % or more than the average silver iodide content of a grain central portion.

Furthermore, the positions, density, and distribution of dislocation lines were observed by measuring 200 grains in each emulsion by a high-voltage (acceleration voltage 400 kV) electron microscope in accordance with the method described in this specification (each grain was observed at five sample inclination angles of −10°, −5°, 0°, +5°, and +10°).

The silver iodide content distribution between grains was obtained by measuring 200 grains by the method using EPMA described in EP147,868 (I=average silver iodide content).

The ratio of {100} faces in side faces of a tabular grain was calculated by the method described in JP-A-8-334850 and this specification. (The characteristics of emulsion grains in examples described later were measured by similar methods.)

TABLE 17

| Emulsion | ECD[1)] of tabular grains: Dc | Thickness (μm) of tabular grains: th | Shape of grains[2)] | Ratio (%) of grains having 10 or more dislocation lines at fringe portion |
|---|---|---|---|---|
| 9-A | 3.30 | 0.206 | Other than grains having Dc > 3.5 μm and th < 0.25 μm | 76 |
| 9-B | 3.30 | 0.206 | Other than grains having Dc > 3.5 μm and th < 0.25 μm | 91 |
| 9-C | 3.30 | 0.206 | Other than grains having Dc > 3.5 μm and th < 0.25 μm | 100 |
| 9-D | 3.47 | 0.187 | Grains having Dc > 3.5 μm and th < 0.25 μm | 49 |
| 9-E | 3.47 | 0.187 | Grains having Dc > 3.5 μm and th < 0.25 μm | 85 |
| 9-F | 3.47 | 0.187 | Grains having Dc > 3.5 μm and th < 0.25 μm | 100 |
| 9-G | 3.47 | 0.187 | Grains having Dc > 3.5 μm and th < 0.25 μm | 61 |
| 9-H | 3.93 | 0.146 | Grains having Dc > 3.5 μm and th < 0.15 μm | 38 |
| 9-I | 3.93 | 0.146 | Grains having Dc > 3.5 μm and th < 0.15 μm | 67 |
| 9-J | 3.93 | 0.146 | Grains having Dc > 3.5 μm and th < 0.15 μm | 92 |
| 9-K | 3.93 | 0.146 | Grains having Dc > 3.5 μm and th < 0.15 μm | 60 |

TABLE 17-continued

| | | | | |
|---|---|---|---|---|
| 9-L | 4.14 | 0.131 | Grains having Dc > 4.0 μm and th < 0.15 μm | 33 |
| 9-M | 4.14 | 0.131 | Grains having Dc > 4.0 μm and th < 0.15 μm | 58 |
| 9-N | 4.14 | 0.131 | Grains having Dc > 4.0 μm and th < 0.15 μm | 81 |
| 9-O | 4.14 | 0.131 | Grains having Dc > 4.0 μm and th < 0.15 μm | 95 |
| 9-P | 4.75 | 0.100 | Grains having Dc > 4.0 μm and th < 0.10 μm | 19 |
| 9-Q | 4.75 | 0.100 | Grains having Dc > 4.0 μm and th < 0.10 μm | 50 |
| 9-R | 4.75 | 0.100 | Grains having Dc > 4.0 μm and th < 0.10 μm | 70 |
| 9-S | 4.75 | 0.100 | Grains having Dc > 4.0 μm and th < 0.10 μm | 86 |

| Emulsion | Ratio (%) of grains having 30 or more dislocation lines at fringe portion | Ratio (%) of grains having dislocation lines localized substantially at only fringe portion | Ratio of grains having silver iodide content of 0.7I to 1.3I[3)] | Ratio of grains having silver iodide content of 0.8I to 1.2I[3)] | Ratio of (100) face to total side surfaces |
|---|---|---|---|---|---|
| 9-A | 61 | 50 | 57 | 43 | 31 |
| 9-B | 70 | 73 | 93 | 79 | 31 |
| 9-C | 100 | 95 | 98 | 89 | 31 |
| 9-D | 31 | 32 | 56 | 42 | 28 |
| 9-E | 67 | 61 | 90 | 77 | 28 |
| 9-F | 95 | 93 | 94 | 85 | 28 |
| 9-G | 42 | 44 | 89 | 82 | 21 |
| 9-H | 22 | 27 | 53 | 40 | 25 |
| 9-I | 53 | 49 | 86 | 73 | 25 |
| 9-J | 84 | 83 | 92 | 83 | 25 |
| 9-K | 36 | 43 | 82 | 74 | 20 |
| 9-L | 19 | 22 | 49 | 37 | 20 |
| 9-M | 33 | 41 | 85 | 72 | 20 |
| 9-N | 62 | 71 | 92 | 82 | 25 |
| 9-O | 83 | 85 | 92 | 81 | 40 |
| 9-P | 8 | 7 | 41 | 33 | 18 |
| 9-Q | 26 | 31 | 80 | 70 | 18 |
| 9-R | 51 | 59 | 90 | 80 | 25 |
| 9-S | 71 | 81 | 91 | 80 | 40 |

[1)]ECD = Equivalent circular diameter (μm) = DC
[2)]Shape of grains occupying 50% or more of all the grains
[3)]"I" represents an average iodide content Formation and Evaluation of Coated samples Coated samples were formed and evaluated following the same procedures as in Example 1.

The results of photographic properties are shown in Table 18 below. The sensitivity is represented by the relative value of the reciprocal of an exposure amount necessary to reach a density of fog density plus 0.2 (the sensitivity of sample 901 is 100).

The resistance to pressure was measured by a forced test by bending an unexposed film sample from a certain portion, as a fulcrum, of the sample in the opposite direction to the emulsion surface through an angle of 120° with a fixed pressure for 3 sec. After development, pressure marks and pressure desensitization produced in the bent portion of the sample were visually evaluated (on the basis of sample 901).

Comparing sample 901 with samples 902 to 919 shows that emulsions having high sensitivity and improved resistance to pressure can be obtained by limitedly introducing dislocation lines at high density to grain fringe portions of tabular grains having a large equivalent-circle diameter and a small thickness according to the present invention, by uniformizing the silver iodide content distribution between the grains, and by improving the (100) face area ratio in side faces of the grains.

TABLE 18

| Sample No. | Emulsion | Relative sensitivity | Pressure fogging | Pressure desensitization | Remarks |
|---|---|---|---|---|---|
| 901 | 9-A | 100 | Δ | Δ | Comparison |
| 902 | 9-B | 105 | ○ | ○ | Comparison |
| 903 | 9-C | 110 | ◎ | ◎ | Comparison |
| 904 | 9-D | 110 | x | x | Invention |
| 905 | 9-E | 129 | ○ | Δ | Invention |
| 906 | 9-F | 135 | ◎ | ◎ | Invention |
| 907 | 9-G | 117 | Δ | x | Invention |
| 908 | 9-H | 120 | xx | x | Invention |
| 909 | 9-I | 151 | ○ | ○ | Invention |
| 910 | 9-J | 166 | ◎ | ○ | Invention |
| 911 | 9-K | 123 | ○ | x | Invention |
| 912 | 9-L | 120 | xx | xx | Invention |
| 913 | 9-M | 132 | x | x | Invention |
| 914 | 9-N | 182 | ○ | Δ | Invention |
| 915 | 9-O | 191 | ◎ | ○ | Invention |
| 916 | 9-P | 117 | xx | xx | Invention |
| 917 | 9-Q | 132 | Δ | x | Invention |

TABLE 18-continued

| Sample No. | Emulsion | Relative sensitivity | Pressure fogging | Pressure desensitization | Remarks |
|---|---|---|---|---|---|
| 918 | 9-R | 209 | ◎ | Δ | Invention |
| 919 | 9-S | 224 | ◎ | ○ | Invention |

Evaluation by visual observation of pressure fogging and pressure desensitization (expressed in relative values)
good ← ◎, ○, Δ, x, xx → poor

Example 10

Preparation and Evaluation of Emulsions 10-A to 10-O

Emulsions 10-A to 10-C differing in the relationship between the average silver iodide content in a grain central portion and the average silver iodide content in a grain fringe portion were prepared by controlling the amount of iodide ions added in (addition 3), the amounts of the iodide ion-releasing agent and sodium sulfite used in (addition 5), and the pAg held during (addition 6) of the emulsion 9-C described above.

Emulsions 10-D to 10-F, 10-G to 10-I, 10-J to 10-L, and 10-M to 10-O differing in the relationship between the average silver iodide content in a grain central portion and the average silver iodide content in a grain fringe portion were prepared by similarly controlling the grain formation conditions of the emulsions 9-F, 9-J, 9-O, and 9-S.

In each of these emulsions, 50% or more of all grains were accounted for by tabular grains having a silver iodide content of 0.7 I to 1.3 I where I is the average silver iodide content (mol %), containing 10 or more dislocation lines per grain only in substantially a grain fringe portion, and having a (100) face ratio in grain side faces of 25% or more. Also, the variation coefficient of the distribution of the equivalent-circle diameters of all grains was 40% or less.

Table 19 shows the grain characteristics of these emulsions. Coated samples 1001 to 1015 were formed using these emulsions and evaluated following the same procedures as in Example 1. The results are also shown in Table 19.

TABLE 19

| Sample No. | Emulsion | Shape of grains occupying 50% or more of all the grains | Difference of average silver iodide contents of fringe portion of grain from central portion of grain | Relative sensitivity | Pressure fogging | Pressure desensitization |
|---|---|---|---|---|---|---|
| 1001 | 10-A | Grains having Dc < 3.5 μm and th > 0.25 μm | Higher by 1.8 mol % or more | 100 | x | Δ |
| 1002 | 10-B | Grains having Dc < 3.5 μm and th > 0.25 μm | Higher by 2.2 mol % or more | 105 | ○ | Δ |
| 1003 | 10-C | Grains having Dc < 3.5 μm and th > 0.25 μm | Higher by 4.0 mol % or more | 110 | ◎ | ◎ |
| 1004 | 10-D | Grains having Dc > 3.5 μm and th < 0.25 μm | Higher by 1.8 mol % or more | 110 | x | x |
| 1005 | 10-E | Grains having Dc > 3.5 μm and th < 0.25 μm | Higher by 2.2 mol % or more | 132 | ◎ | ○ |
| 1006 | 10-F | Grains having Dc > 3.5 μm and th < 0.25 μm | Higher by 4.0 mol % or more | 138 | ◎ | ○ |
| 1007 | 10-G | Grains having Dc > 3.5 μm and th < 0.15 μm | Higher by 1.8 mol % or more | 132 | x | x |
| 1008 | 10-H | Grains having Dc > 3.5 μm and th < 0.15 μm | Higher by 2.2 mol % or more | 166 | ◎ | ○ |
| 1009 | 10-I | Grains having Dc > 3.5 μm and th < 0.15 μm | Higher by 4.0 mol % or more | 182 | ◎ | ○ |
| 1010 | 10-J | Grains having Dc > 4.0 μm and th < 0.15 μm | Higher by 1.8 mol % or more | 145 | xx | xx |
| 1011 | 10-K | Grains having Dc > 4.0 μm and th < 0.15 μm | Higher by 2.2 mol % or more | 191 | ○ | Δ |
| 1012 | 10-L | Grains having Dc > 4.0 μm and th < 0.15 μm | Higher by 4.0 mol % or more | 209 | ◎ | Δ |
| 1013 | 10-M | Grains having Dc > 4.0 μm and th < 0.10 μm | Higher by 1.8 mol % or more | 162 | xx | xx |
| 1014 | 10-N | Grains having Dc > 4.0 μm and th < 0.10 μm | Higher by 2.2 mol % or more | 224 | ○ | Δ |

TABLE 19-continued

| Sample No. | Emulsion | Shape of grains occupying 50% or more of all the grains | Difference of average silver iodide contents of fringe portion of grain from central portion of grain | Relative sensitivity | Pressure fogging | Pressure desensitization |
|---|---|---|---|---|---|---|
| 1015 | 10-O | Grains having Dc > 4.0 μm and th < 0.10 μm | Higher by 4.0 mol % or more | 234 | ⊙ | Δ |

Dc = Equivalent circular diameter
th = Thickness
Evaluation by visual observation of pressure fogging and pressure desensitization (expressed in relative values)
good ← ⊙, ○, Δ, x, xx → poor As shown in Table 19, the sensitivity and the resistance to pressure remarkably improved in an emulsion in which the average silver iodide content in a grain fringe portion of tabular grains, having a large equivalent-circle diameter and a small thickness according to the present invention, was higher by 2 mol % or more than the average silver iodide content in a grain central portion.

Example 11

Preparation and Evaluation of Emulsions 11-A to 11-O

Emulsions 11-A to 11-O differing in the variation coefficient of the distribution of the equivalent-circle diameters of all grains were prepared by controlling the grain formation conditions of the emulsions 9-C, 9-F, 9-J, 9-O, and 9-S described above.

In each of these emulsions, tabular grains having a silver iodide content of 0.7 I to 1.3 I, where I is the average silver iodide content (mol %), and containing 10 or more dislocation lines per grain only in substantially a grain fringe portion account for 50% or more in number of all the grains, the (100) face ratio in side faces of the tabular grains was 25% or more, and the average silver iodide content in a grain fringe portion was higher by 2 mol % or more than the average silver iodide content in a grain central portion.

Table 20 shows the grain characteristics of these emulsions. Coated samples 1101 to 1115 were formed using these emulsions and evaluated following the same procedures as in Example 1. The results are also shown in Table 20.

TABLE 20

| Sample No. | Emulsion | Shape of grains occupying 50% or more of all the grains | COV of distribution of ECD of all the grains | Relative sensitivity | Pressure fogging | Pressure desensitization | Remarks |
|---|---|---|---|---|---|---|---|
| 1101 | 11-A | Grains having Dc < 3.5 μm and th > 0.25 μm | 35 | 100 | Δ | Δ | Comparison |
| 1102 | 11-B | Grains having Dc < 3.5 μm and th > 0.25 μm | 45 | 98 | x | x | Comparison |
| 1103 | 11-C | Grains having Dc < 3.5 μm and th > 0.25 μm | 20 | 102 | ○ | ○ | Comparison |
| 1104 | 11-D | Grains having Dc > 3.5 μm and th < 0.25 μm | 35 | 129 | ○ | ○ | Invention |
| 1105 | 11-E | Grains having Dc > 3.5 μm and th < 0.25 μm | 45 | 117 | Δ | x | Comparison |
| 1106 | 11-F | Grains having Dc > 3.5 μm and th < 0.25 μm | 20 | 138 | ⊙ | ⊙ | Invention |
| 1107 | 11-G | Grains having Dc > 3.5 μm and th < 0.15 μm | 35 | 162 | ○ | ○ | Invention |
| 1108 | 11-H | Grains having Dc > 3.5 μm and th < 0.15 μm | 45 | 148 | Δ | x | Comparison |
| 1109 | 11-I | Grains having Dc > 3.5 μm and th < 0.15 μm | 20 | 174 | ⊙ | ⊙ | Invention |
| 1110 | 11-J | Grains having Dc > 4.0 μm and th < 0.15 μm | 35 | 186 | ○ | Δ | Invention |
| 1111 | 11-K | Grains having Dc > 4.0 μm and th < 0.15 μm | 45 | 166 | x | xx | Comparison |

TABLE 20-continued

| Sample No. | Emulsion | Shape of grains occupying 50% or more of all the grains | COV of distribution of ECD of all the grains | Relative sensitivity | Pressure fogging | Pressure desensitization | Remarks |
|---|---|---|---|---|---|---|---|
| 1112 | 11-L | Grains having Dc > 4.0 μm and th < 0.15 μm | 20 | 204 | ⊙ | ○ | Invention |
| 1113 | 11-M | Grains having Dc > 4.0 μm and th < 0.10 μm | 35 | 219 | ○ | Δ | Invention |
| 1114 | 11-N | Grains having Dc > 4.0 μm and th < 0.10 μm | 45 | 195 | x | xx | Comparison |
| 1115 | 11-O | Grains having Dc > 4.0 μm and th < 0.10 μm | 20 | 229 | ⊙ | ○ | Invention |

COV = coefficient of variation (%)
ECD = equivalent circular diameter (μm) = Dc
Evaluation by visual observation of pressure fogging and pressure desensitization (expressed in relative values).
good ← ⊙, ○, Δ, x, xx → poor As shown in Table 20, the sensitivity and the resistance to pressure remarkably improved in an emulsion in which the variation coefficient of the distribution of the equivalent-circle diameters of all tabular grains, having a large equivalent-circle diameter and a small thickness according to the present invention, was 40% or less.

Example 12

Samples 1201 to 1205 were formed by changing the emulsion in the 11th layer of sample 501 in Example 5 to the emulsions 9-A, 9-F, 9-J, 9-O, and 9-S in Example 9.

These samples were exposed and processed following the same procedures as in Example 5.

The density of each processed sample was measured through a green filter to evaluate its photographic properties. The sensitivity was evaluated by the relative value of the reciprocal of an exposure amount necessary for the magenta density to reach a density of fog density plus 0.15. The resistance to pressure was evaluated by conducting a test in the same manner as in Example 9 to evaluate a magenta density portion.

The results are shown in Table 21.

Similar to the results shown in Example 9, the advantage of the present invention was remarkable even in color negative multiple layers.

Also, other emulsions prepared in Example 9 were similarly evaluated, and the relative relationship was found to be the same as in Example 9 even in color negative multiple layers.

TABLE 21

| Sample No. | Emulsion | Relative sensitivity | Pressure fogging | Pressure desensitization | Remarks |
|---|---|---|---|---|---|
| 1201 | 9-A | 100 | x | Δ | Comparison |
| 1202 | 9-F | 132 | ○ | ○ | Invention |
| 1203 | 9-J | 158 | ○ | ○ | Invention |
| 1204 | 9-O | 178 | ○ | ○ | Invention |
| 1205 | 9-S | 204 | ○ | Δ | Invention |

Evaluation by visual observation of pressure fogging and pressure desensitization (expressed in relative values) good ← ○, Δ, x → poor

Example 13

The following samples were formed from sample 1201 in Example 12.

(Sample 1301) The same as sample 1201 except the following changes.

1) The emulsion in the high-speed green-sensitive emulsion layer was changed to the emulsion 9-A in Example 9.

2) The emulsion in the high-speed red-sensitive emulsion layer was changed to the emulsion 9-A (in which the sensitizing dyes were changed to a mixture (40:2:58) of Exs-7, Exs-8, and Exs-9) in Example 9.

(Sample 1302) The same as sample 1201 except the following changes.

1) The emulsion in the high-speed green-sensitive emulsion layer was changed to the emulsion 9-S in Example 9.

2) The emulsion in the high-speed red-sensitive emulsion layer was changed to the emulsion 9-S (in which the sensitizing dyes were changed to a mixture (40:2:58) of Exs-7, Exs-8, and Exs-9) in Example 9.

(Sample 1303) The same as sample 1302 except the following changes.

1) The high-speed red-sensitive emulsion layer was moved to a position between the high-speed green-sensitive layer and the medium-speed green-sensitive layer.

2) Interlayers (containing no dyes) were inserted between the high-speed red-sensitive emulsion layer moved in 1) and its upper and lower adjacent layers.

The photographic properties of these samples 1301 to 1303 were evaluated by processing these samples following the same procedures as in Example 12. (Note that the density of cyan was measured through a red filter, and the sensitivity was evaluated by the relative value of the reciprocal of an exposure amount necessary for the cyan density to reach a density of fog density plus 0.15.)

The results are summarized in Table 22. As can be seen from Table 22, in the layer arrangement of sample 1301 in which tabular grain emulsions having a small grain thickness were used in both the high-speed green-sensitive emulsion layer and the high-speed red-sensitive emulsion layer, a rise of the emulsion sensitivity in the high-speed red-sensitive emulsion layer was unsatisfactory. By contrast, in a preferable layer arrangement of the present invention (in which at least one of the red-sensitive silver halide emulsion layers was formed farther from the support than at least one of the green-sensitive silver halide emulsion layers), the emulsion sensitivity rose to enhance the advantage of the present invention.

Also, images photographed by a negative of sample 1303 were loaded by scanning the negative by using a Fuji Photo Film digital laboratory system "FRONTIER". These images were subjected to digital image processing by a work station (the graininess was eliminated and the sharpness was emphasized by the color reproduction of a Fuji Photo Film color negative "SUPER 400"), and output by a laser printer. Consequently, photographs having very high image quality were obtained.

TABLE 22

| Sample No. | Sensitivity (cyan) | Relative Sensitivity (magenta) | Pressure fogging cyan | Pressure fogging magenta | Pressure desensitization cyan | Pressure desensitization magenta | Remarks |
|---|---|---|---|---|---|---|---|
| 1301 | 100 | 100 | Δ | x | x | Δ | Comparison |
| 1302 | 138 | 204 | ○ | ○ | x | ○ | Invention |
| 1303 | 204 | 182 | ○ | ○ | ○ | ○ | Invention |

Sensitivities of cyan and magenta are relative values assuming the sensitivities of cyan and magenta of Sample 501 are 100, respectively
Evaluation by visual observation of pressure fogging and pressure desensitization (expressed in relative values) good ← ○, Δ, x → poor

Example 14

Preparation of Emulsion (A-1

1,300 mL of an aqueous solution containing 0.5 g of KBr and 1.1 g of gelatin-4 described above was stirred at 35° C. (1st solution preparation). 38 mL of an aqueous solution Ag-1 (containing 4.9 g of $AgNO_3$ in 100 mL), 29 mL of an aqueous solution X-1 (containing 5.2 g of KBr in 100 mL), and 8.5 mL of an aqueous solution G-1 (containing 8.0 g of gelatin-4 in 100 mL) were added over 30 sec at fixed flow rates by the triple-jet method (addition 1). After that, 6.5 g of KBr were added, and the temperature was raised to 75° C. After the temperature was raised, a ripening step was performed for 12 min, and 300 mL of an aqueous solution G-2 (containing 12.7 g of gelatin-3 described above in 100 mL) were added. Subsequently, 2.1 g of disodium 4,5-dihydroxy-1,3-disulfonate monohydrate and 0.002 g of thiourea dioxide were sequentially added at an interval of 1 min.

157 mL of an aqueous solution Ag-2 (containing 22.1 g of $AgNO_3$ in 100 mL) and an aqueous solution X-2 (containing 15.5 g of KBr in 100 mL) were added over 14 min by the double-jet method. During the addition, the flow rate of the aqueous solution Ag-2 was accelerated such that the final flow rate was 3.4 times the initial flow rate. The addition of the aqueous solution X-2 was so performed that the pAg of the bulk emulsion solution in a reaction vessel was held at 8.3 (addition 2). 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 27 min by the double-jet method. During the addition, the flow rate of the aqueous solution Ag-3 was accelerated such that the final flow rate was 1.6 times the initial flow rate. The addition of the aqueous solution X-3 was so performed that the pAg of the bulk emulsion solution in the reaction vessel was held at 8.3 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double-jet method. The addition of the aqueous solution Ag-4 was performed at a fixed flow rate. The addition of the aqueous solution X-4 was so performed that the pAg of the bulk emulsion solution in the reaction vessel was held at 8.3 (addition 4).

After that, 0.0025 g of sodium benzenethiosulfonate and 125 mL of an aqueous solution G-3 (containing 12.0 g of gelatin-1 described above in 100 mL) were sequentially added at an interval of 1 min. Subsequently, 43.7 g of KBr were added to set the pAg of the bulk emulsion solution in the reaction vessel to 9.00, 73.9 g of an AgI fine grain emulsion (containing 13.0 g of fine AgI grains having an average grain size of 0.047 μm in 100 g) were added. Two minutes after that, 249 mL of the aqueous solution Ag-4 and the aqueous solution X-4 were added by the double-jet method. The addition of the aqueous solution Ag-4 was performed at a fixed flow rate over 9 min. The aqueous solution x-4 was added only for the first 3.3 min such that the pAg of the bulk emulsion solution in the reaction vessel was held at 9.00 and was not added for the remaining 5.7 min, so that the pAg of the bulk emulsion solution in the reaction vessel was finally adjusted to 7.8 (addition 5). After that, the emulsion was desalted by a common flocculation method. Water, NaOH, and the above mentioned gelatin-1 were added to the emulsion under stirring, and the pH and the pAg were adjusted to 6.4 and 8.6, respectively, at 56° C.

In the obtained emulsion, 50% or more of the total number of grains were accounted for by tabular silver halide grains having an equivalent-circle diameter of 3.5 μm or more, a grain thickness of 0.25 μm or less, and an average AgI content of 3.94 mol %, and containing (111) faces as parallel major surfaces. The AgI content on the surface of a silver halide grain measured by XPS was 2.1 mol %. The variation coefficient of the equivalent-circle diameters of all grains was 24%, and the variation coefficient of the thicknesses of all grains was 33%. Grains having a twin plane spacing of 0.016 μm or less accounted for 50% or more. Also, letting I be the average silver iodide content, tabular grains accounting for 80% of all grains fell within the range of 0.8 I to 1.2 I.

Subsequently, the emulsion was optimally, chemically sensitized by sequentially adding sensitizing dyes Exs-1 to Exs-3 presented below, potassium thiocyanate, chloroauric acid, sodium thiosulfate, and N,N-dimethylselenourea. This chemical sensitization was completed by adding water-soluble mercapto compounds MER-1 and MER-2 presented below at a ratio of 4:1 such that the total amount was $3.6\times10^{-4}$ mol per mol of a silver halide. This emulsion (A-1) was optimally, chemically sensitized when the addition amount of Exs-1 was $5.3\times10^{-4}$ mol per mol of a silver halide.

Exs-1

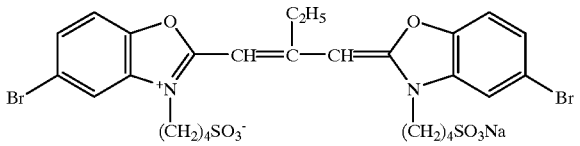

MER-1

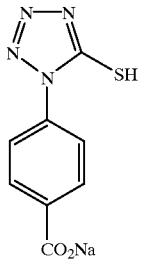

MER-2

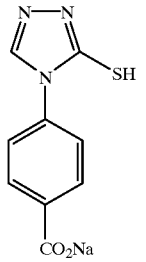

transmission electron microscope. Consequently, 10 or more dislocation lines were present in a fringe portion of any tabular grain. Also, the average length of dislocation lines with respect to the equivalent-circle diameter was 0.06. Furthermore, dislocation lines substantially localized only to a fringe portion.

Note that the emulsions (A-1) to (A-6) were reduction-sensitized by adding disodium 4,5-dihydroxy-1,3-disulfonate monohydrate and thiourea dioxide immediately before (addition 2) in the abovementioned emulsion preparation process.

Note also that the emulsions (A-1) to (A-6) were spectrally sensitized by adding the sensitizing dye Exs-1 in the chemical sensitization step during the process of emulsion preparation. This made each of these emulsions a green-sensitive silver halide emulsion whose spectral sensitivity was a maximum at a wavelength of 550 nm. These emulsions were coated and processed following the same procedures as in Example 1.

The results of photographic properties are shown in Table 23 below. The sensitivity is indicated by the relative value of the reciprocal of an exposure amount necessary to reach a density of fog density plus 0.2. (The sensitivity of sample 1401 is 100.)

TABLE 23

| Sample No. | Emulsion | ECD/μm * | Thickness/μm * | Concentration of electron-triggering center (mol/mol local Ag)** | Sensitivity | Remarks |
|---|---|---|---|---|---|---|
| 1401 | A-1 | 3.7 | 0.23 | 0 | 100 | Comparison |
| 1402 | A-2 | 3.7 | 0.23 | $1 \times 10^{-6}$ | 105 | Comparison |
| 1403 | A-3 | 3.7 | 0.23 | $5 \times 10^{-5}$ | 110 | Invention |
| 1404 | A-4 | 3.7 | 0.23 | $1 \times 10^{-4}$ | 140 | Invention |
| 1405 | A-5 | 3.7 | 0.23 | $5 \times 10^{-4}$ | 140 | Invention |
| 1406 | A-6 | 3.7 | 0.23 | $5 \times 10^{-3}$ | 110 | Invention |

ECD = Equivalent circular diameter.
*A value of grains occupying 50% or more in number of all the grains.
**Concentration of the electron-triggering center in the region where the electron-triggering center is present.

Preparation of Emulsions (A-2) to (A-6)

Preparation of Emulsion (A-2)

During the grain formation of grains from 90% to 95% of the total silver amount were consumed in addition 5 of the emulsion (A-1), an aqueous solution of yellow prussiate of potash was added in an amount of $1\times10^{-6}$ mol/mol silver with respect to the silver amount at that point. During the addition, the pAg was held at 7.3. An emulsion (A-2) was prepared following the same procedures as for the emulsion (A-1) except the foregoing.

Preparation of Emulsions (A-3) to (A-6)

Emulsions (A-3) to (A-6) shown in Table 23 were prepared by changing the addition amount of the aqueous solution of yellow prussiate of potash from that of the emulsion (A-2).

The emulsions (A-1) to (A-6) described above were observed at a liquid nitrogen temperature by using a 400-kV The comparison of sample 1401 with samples 1402 to 1406 shows that a high-speed emulsion can be obtained by forming the electron-capturing zone of the present invention. However, the electron-capturing center concentration dependence makes it important to choose an appropriate electron-capturing center concentration in order to obtain high sensitivity.

Example 15

Preparation of (Emulsions B-1a to B-11b and Emulsions B-21a to B-31b)

Emulsions were prepared by changing the surface iodide content by changing the addition amount of the AgI fine grain emulsion added two minutes before (addition 5) of the emulsions (A-1) and (A-4). Also, emulsions different in the equivalent-circle diameter and the thickness were prepared by changing the grain growth conditions. In the obtained emulsions, 50% or more of the total number of grains had an equivalent-circle diameter of 3.5μm or more and a grain thickness of 0.25 μm or less. The emulsions met the limitations of Embodiment 1 of the invention. The characteristics of these emulsions are shown in Tables 24 and 25. These samples were evaluated following the same procedures as in Example 1. The results are also shown in Tables 24 and 25.

TABLE 24

| Sample No. | Emulsion | ECD/μm* | Thickness/ μm* | Concentration of electron-triggering center (mol/mol local Ag)** | Surface iodide content (mol %) | Sensitivity*** | Remarks |
|---|---|---|---|---|---|---|---|
| 1501 a | B-1 a | 4.8 | 0.23 | 0 | 2.4 | 100 | Invention |
| 1501 b | B-1 b | 4.8 | 0.23 | $1 \times 10^{-4}$ | 2.4 | 160 | Invention |
| 1502 a | B-2 a | 4.3 | 0.23 | 0 | 2.4 | 100 | Invention |
| 1502 b | B-2 b | 4.3 | 0.23 | $1 \times 10^{-4}$ | 2.4 | 155 | Invention |
| 1503 a | B-3 a | 3.7 | 0.23 | 0 | 2.4 | 100 | Invention |
| 1503 b | B-3 b | 3.7 | 0.23 | $1 \times 10^{-4}$ | 2.4 | 150 | Invention |
| 1504 a | B-4 a | 3.2 | 0.23 | 0 | 2.4 | 100 | Comparison |
| 1504 b | B-4 b | 3.2 | 0.23 | $1 \times 10^{-4}$ | 2.4 | 110 | Comparison |
| 1505 a | B-5 a | 2.8 | 0.23 | 0 | 2.4 | 100 | Comparison |
| 1505 b | B-5 b | 2.8 | 0.23 | $1 \times 10^{-4}$ | 2.4 | 110 | Comparison |
| 1506 a | B-6 a | 3.7 | 0.33 | 0 | 2.4 | 100 | Comparison |
| 1506 b | B-6 b | 3.7 | 0.33 | $1 \times 10^{-4}$ | 2.4 | 110 | Comparison |
| 1507 a | B-7 a | 3.7 | 0.28 | 0 | 2.4 | 100 | Comparison |
| 1507 b | B-7 b | 3.7 | 0.28 | $1 \times 10^{-4}$ | 2.4 | 115 | Comparison |
| 1508 a | B-8 a | 3.7 | 0.23 | 0 | 2.4 | 100 | Invention |
| 1508 b | B-8 b | 3.7 | 0.23 | $1 \times 10^{-4}$ | 2.4 | 150 | Invention |
| 1509 a | B-9 a | 3.7 | 0.18 | 0 | 2.4 | 100 | Invention |
| 1509 b | B-9 b | 3.7 | 0.18 | $1 \times 10^{-4}$ | 2.4 | 160 | Invention |
| 1510 a | B-10 a | 3.7 | 0.13 | 0 | 2.4 | 100 | Invention |
| 1510 b | B-10 b | 3.7 | 0.13 | $1 \times 10^{-4}$ | 2.4 | 165 | Invention |
| 1511 a | B-11 a | 3.7 | 0.08 | 0 | 2.4 | 100 | Invention |
| 1511 b | B-11 b | 3.7 | 0.08 | $1 \times 10^{-4}$ | 2.4 | 170 | Invention |

ECD = Equivalent circular diameter.
*A value of grains occupying 50% or more in number of all the grains.
**Concentration of the electron-triggering center in the region where the electron-triggering center is present.
***Sensitivity of each Sample b having electron-triggering zone is a relative value assuming the sensitivity of each Sample a having no electron-triggering zone, is 100.

TABLE 25

| Sample No. | Emulsion | ECD/μm* | Thickness/ μm* | Concentration of electron-triggering center (mol/mol local Ag)** | Surface iodide content (mol %) | Sensitivity*** | Remarks |
|---|---|---|---|---|---|---|---|
| 1521 a | B-21 a | 4.8 | 0.23 | 0 | 6.1 | 100 | Invention |
| 1521 b | B-21 b | 4.8 | 0.23 | $1 \times 10^{-4}$ | 6.1 | 130 | Invention |
| 1522 a | B-22 a | 4.3 | 0.23 | 0 | 6.1 | 100 | Invention |
| 1522 b | B-22 b | 4.3 | 0.23 | $1 \times 10^{-4}$ | 6.1 | 127 | Invention |
| 1523 a | B-23 a | 3.7 | 0.23 | 0 | 6.1 | 100 | Invention |
| 1523 b | B-23 b | 3.7 | 0.23 | $1 \times 10^{-4}$ | 6.1 | 125 | Invention |
| 1524 a | B-24 a | 3.2 | 0.23 | 0 | 6.1 | 100 | Comparison |
| 1524 b | B-24 b | 3.2 | 0.23 | $1 \times 10^{-4}$ | 6.1 | 105 | Comparison |
| 1525 a | B-25 a | 2.7 | 0.23 | 0 | 6.1 | 100 | Comparison |
| 1525 b | B-25 b | 2.7 | 0.23 | $1 \times 10^{-4}$ | 6.1 | 105 | Comparison |
| 1526 a | B-26 a | 3.7 | 0.33 | 0 | 6.1 | 100 | Comparison |
| 1526 b | B-26 b | 3.7 | 0.33 | $1 \times 10^{-4}$ | 6.1 | 105 | Comparison |
| 1527 a | B-27 a | 3.7 | 0.28 | 0 | 6.1 | 100 | Comparison |
| 1527 b | B-27 b | 3.7 | 0.28 | $1 \times 10^{-4}$ | 6.1 | 105 | Comparison |
| 1528 a | B-28 a | 3.7 | 0.23 | 0 | 6.1 | 100 | Invention |
| 1528 b | B-28 b | 3.7 | 0.23 | $1 \times 10^{-4}$ | 6.1 | 125 | Invention |
| 1529 a | B-29 a | 3.7 | 0.18 | 0 | 6.1 | 100 | Invention |
| 1529 b | B-29 b | 3.7 | 0.18 | $1 \times 10^{-4}$ | 6.1 | 130 | Invention |
| 1530 a | B-30 a | 3.7 | 0.13 | 0 | 6.1 | 100 | Invention |
| 1530 b | B-30 b | 3.7 | 0.13 | $1 \times 10^{-4}$ | 6.1 | 132 | Invention |
| 1531 a | B-31 a | 3.7 | 0.08 | 0 | 6.1 | 100 | Invention |
| 1531 b | B-31 b | 3.7 | 0.08 | $1 \times 10^{-4}$ | 6.1 | 135 | Invention |

ECD = Equivalent circular diameter.
*A value of grains occupying 50% or more in number of all the grains.
**Concentration of the electron-triggering center in the region where the electron-triggering center is present.
***Sensitivity of each Sample b having electron-triggering zone is a relative value assuming the sensitivity of each Sample a having no electron-triggering zone, is 100.

First, samples 1501 to 1511 prepared by using emulsions having a low surface iodide content (2.4 mol %) will be described below.

A shown in Table 24, when the equivalent-circle diameter was 3.2 μm or less that was outside the region of the present invention (samples 1504 and 1505), the advantage of increasing the sensitivity by introduction of the electron-capturing zone was small although the effect was observed. However, when the equivalent-circle diameter was 3.7 μm or more that was inside the region of the present invention (samples 1501 to 1503), the advantage of increasing the sensitivity by introduction of the electron-capturing zone was very large. This is also true of the grain thickness. That is, the advantage was small outside the region of the present invention (samples 1506 and 1507) but was particularly large in the region of the present invention (samples 1508 and 1511) in which the thickness was 0.25 μm or less.

On the other hand, as shown in Table 25, in samples 1521 to 1531 tested following the same procedures as above by using emulsions having a surface iodide content of 6.1 mol %, the effect of the electron-capturing zone particularly greatly appeared in the region of the present invention, as in the case of samples 1501 to 1511. However, the degree of this effect of increasing the sensitivity was smaller than in samples 1501 to 1511. Hence, in a large-size tabular region as in the present invention, it is probably very important to suppress the surface iodide content to 5 mol % or less.

Example 16

An emulsion C-1 was prepared following the same procedures as for the emulsion (A-4) except that a crystal habit-control agent presented below was added one minute before (addition 5) of the emulsion (A-4). Also, emulsions C-2 to C-4 were prepared by adding the crystal habit-controlling agent in the middle of (addition 5).

Furthermore, emulsions differing in the equivalent-circle diameter and thickness were prepared by changing the grain growth conditions. In these emulsions, the equivalent-circle diameter variation coefficient was 40% or less, and grains having an equivalent-circle diameter of 3.5 μm or more and a thickness of 0.25 μm or less accounted for 50% or more of the total number of grains. These emulsions were optimally post-ripened, and their photographic properties were evaluated following the same procedures as in Example 1. The results are shown in Table 26.

TABLE 26

| Sample No. | Emulsion | ECD/μm* | Thickness/ μm* | Concentration of electron-triggering center (mol/mol local Ag)** | Surface iodide content (mol %) | Length of dislocation lines | Sensitivity*** | Remarks |
|---|---|---|---|---|---|---|---|---|
| 1601 | C-1 | 4.8 | 0.23 | $1 \times 10^{-4}$ | 2.4 | 0.01 | 100 | Invention |
| 1602 | C-2 | | | | | 0.03 | 100 | Invention |
| 1603 | C-3 | | | | | 0.05 | 150 | Invention |
| 1604 | C-4 | | | | | 0.10 | 170 | Invention |
| 1605 | C-5 | | | | | 0.15 | 170 | Invention |
| 1611 | C-6 | 3.7 | 0.23 | $1 \times 10^{-4}$ | 2.4 | 0.01 | 100 | Invention |
| 1612 | C-7 | | | | | 0.03 | 100 | Invention |
| 1613 | C-8 | | | | | 0.05 | 145 | Invention |
| 1614 | C-9 | | | | | 0.10 | 165 | Invention |
| 1615 | C-10 | | | | | 0.15 | 165 | Invention |
| 1621 | C-11 | 3.2 | 0.23 | $1 \times 10^{-4}$ | 2.4 | 0.01 | 130 | Comparison |
| 1622 | C-12 | | | | | 0.03 | 100 | Comparison |
| 1623 | C-13 | | | | | 0.05 | 110 | Comparison |
| 1624 | C-14 | | | | | 0.10 | 120 | Comparison |
| 1625 | C-15 | | | | | 0.15 | 120 | Comparison |
| 1631 | C-16 | 2.7 | 0.23 | $1 \times 10^{-4}$ | 2.4 | 0.01 | 100 | Comparison |
| 1632 | C-17 | | | | | 0.03 | 105 | Comparison |
| 1633 | C-18 | | | | | 0.05 | 110 | Comparison |
| 1634 | C-19 | | | | | 0.10 | 110 | Comparison |
| 1635 | C-20 | | | | | 0.15 | 110 | Comparison |

ECD = Equivalent circular diameter
*A value of grains occupying 50% or more in number of all the grains
**Concentration of the electron-triggering center in the region where the electron-triggering center is present
***Sensitivities in the group of Sample Nos. 1601 to 1605 are relative values assuming the sensitivity of Sample No. 1601 is 100. Similarly, sensitivities in the group of Sample Nos. 1611 to 1615 are relative values assuming the sensitivity of Sample No. 1611 is 100. Sensitivities in the group of Sample Nos. 1621 to 1625 are relative values assuming the sensitivity of Sample No. 1621 is 100. Similarly, sensitivities in the group of Sample Nos. 1631 to 1635 are relative values assuming the sensitivity of Sample No. 1631 is 100.

The comparison of samples 1601 to 1605, or samples 1611 to 1615, shows that the photographic properties greatly improved when the dislocation line length was 0.05 or more with respect to the equivalent-circle diameter. By contrast, in samples 1621 to 1625 and samples 1631 to 1635 containing grains outside the region of the present invention, changes in properties due to the dislocation line length were small. That is, improvements of the photographic sensitivity obtained by increasing the dislocation line length were uniquely large within the region of the present invention in which the equivalent-circle diameter was 3.7 μm or more.

Example 17

Emulsions different in the equivalent-circle diameter variation coefficient as shown in Table 27 were prepared by changing the grain formation conditions of the emulsion A-4. The photographic properties were evaluated following the same procedures as in Example 1. The results are shown in Table 27.

TABLE 27

| Sample No. | Emulsion | ECD (μm)* | COV of ECD (%) | Thickness (μm)* | Concentration of electron-triggering center (mol/mol local Ag)** | Surface iodide content (mol %) | Length of dislocation lines | Sensitivity*** | Remarks |
|---|---|---|---|---|---|---|---|---|---|
| 1701 | D-1 | 3.7 | 55 | 0.23 | $1 \times 10^{-4}$ | 2.4 | 0.07 | 100 | Comparison |
| 1702 | D-2 | | 45 | | | | | 102 | Comparison |
| 1703 | D-3 | | 38 | | | | | 145 | Invention |
| 1704 | D-4 | | 30 | | | | | 150 | Invention |
| 1705 | D-5 | | 24 | | | | | 160 | Invention |
| 1706 | D-6 | | 19 | | | | | 165 | Invention |
| 1711 | D-7 | 3.2 | 55 | 0.23 | $1 \times 10^{-4}$ | 2.4 | 0.07 | 100 | Comparison |
| 1712 | D-8 | | 45 | | | | | 101 | Comparison |
| 1713 | D-9 | | 38 | | | | | 103 | Comparison |
| 1714 | D-10 | | 30 | | | | | 103 | Comparison |
| 1715 | D-11 | | 24 | | | | | 104 | Comparison |
| 1716 | D-12 | | 19 | | | | | 104 | Comparison |
| 1721 | D-13 | 2.7 | 55 | 0.23 | $1 \times 10^{-4}$ | 2.4 | 0.07 | 100 | Comparison |
| 1722 | D-14 | | 45 | | | | | 102 | Comparison |
| 1723 | D-15 | | 38 | | | | | 103 | Comparison |
| 1724 | D-16 | | 30 | | | | | 103 | Comparison |
| 1725 | D-17 | | 24 | | | | | 104 | Comparison |
| 1726 | D-18 | | 19 | | | | | 105 | Comparison |

ECD = Equivalent circular diameter
COV = coefficient of variation.
*A value of grains occupying 50% or more in number of all the grains
**Concentration of the electron-triggering center in the region where the electron-triggering center is present
***Sensitivities in the group of Sample Nos. 1701 to 1706 are relative values assuming the sensitivity of Sample No. 1701 is 100.
Similarly, sensitivities in the group of Sample Nos. 1711 to 1716 are relative values assuming the sensitivity of Sample No. 1711 is 100.
Sensitivities in the group of Sample Nos. 1721 to 1726 are relative values assuming the sensitivity of Sample No. 1721 is 100.

In samples 1711 to 1716 and samples 1721 to 1726 in which the equivalent-circle diameter was outside the scope of the present invention, changes in properties were small even when the equivalent-circle diameter variation coefficient was changed. However, in samples 1701 to 1706 in which the equivalent-circle diameter was inside the region of the present invention, the advantage of the present invention significantly appeared when the equivalent-circle diameter variation coefficient was 40% or less.

Example 18

Formation of Samples 1802 to 1807

Samples 1802 to 1807 were formed using the emulsions (A-1) to (A-6) prepared in Example 14, instead of emulsions I-a and H-a in the 11th layer. The emulsion met the limitations of Embodiment 1 of the invention.

These samples were evaluated following the same procedures as in Example 5.

The density of each processed sample was measured through a green filter to evaluate its photographic properties. The sensitivity wave evaluated by the relative value of the reciprocal of an exposure amount necessary for the magenta density to reach a density of fog density plus 0.2. The results are shown in Table 28.

TABLE 28

| Sample No. | Emulsion | ECD/μm* | Thickness/μm* | Concentration of electron-triggering center (mol/mol local Ag)** | Sensitivity | Remarks |
|---|---|---|---|---|---|---|
| 1802 | A-1 | 3.7 | 0.23 | 0 | 100 | Comparison |
| 1803 | A-2 | 3.7 | 0.23 | $1 \times 10^{-6}$ | 105 | Comparison |
| 1804 | A-3 | 3.7 | 0.23 | $5 \times 10^{-5}$ | 110 | Invention |
| 1805 | A-4 | 3.7 | 0.23 | $1 \times 10^{-4}$ | 140 | Invention |
| 1806 | A-5 | 3.7 | 0.23 | $5 \times 10^{-4}$ | 140 | Invention |
| 1807 | A-6 | 3.7 | 0.23 | $5 \times 10^{-3}$ | 120 | Invention |

ECD = Equivalent circular diameter
*A value of grains occupying 50% or more in number of all the grains
**Concentration of the electron-triggering center in the region where the electron-triggering center is present Similar to the results shown in Example 14, the advantage of the present invention was remarkable even in color negative multiple layers.

Also, other emulsions prepared in Example 14 were similarly evaluated, and the relative relationship was found to be the same even in color negative multiple layers.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion containing grains wherein a variation coefficient of distribution of an equivalent-circle diameter of all the grains is 40% or less, and 50% or more in number of all the grains satisfy requirements (i) to (iii) below:

(i) silver iodobromide or silver bromochloroiodide tabular grains having (111) faces as major surfaces, (ii) the equivalent-circle diameter is 3.5 μm or more and a thickness is 0.25 μm or less, and (iii) a distance between twin planes of the tabular grain is 0.016 μm or less.

2. The emulsion according to claim 1, wherein a variation coefficient of distribution of the thickness of all the grains is 40% or less, and a variation coefficient of distribution of the distance between twin planes of all the grains is 40% or less.

3. The emulsion according to claim 1, wherein the tabular grains further satisfy requirements (iv) and (v) below:

(iv) a silver iodide content is in a range from 0.7 I to 1.3 I, wherein I represents a specific silver iodide content (mol %) and $0.3<I<20$, and (v) ten or more dislocation lines per grain are present at a fringe portion.

4. The emulsion according to claim 3, wherein the range of the requirement (iv) is 0.8 I to 1.2 I.

5. The emulsion according to claim 3, wherein the tabular grains further satisfies requirements (vi) below:

(vi) the dislocation lines are substantially localized only at a fringe portion of the grain.

6. The emulsion according to claim 5, wherein the tabular grains further satisfy requirement (vii) below:

(vii) an electron-capturing zone is present.

7. The emulsion according to claim 6, wherein an average surface iodide content of all the grains is 5 mol % or less.

8. The emulsion according to claim 6, wherein the tabular grains have 10 or more dislocation lines per grain, each having a length of 0.05D or more, wherein D represents the equivalent-circle diameter.

9. The emulsion according to claim 1, wherein a coefficient of distribution of the distance between twin planes of all the grains is 40% or less, and the emulsion was prepared by using a low molecular, oxidation treated gelatin during a step of nucleation.

10. The emulsion according to claim 3, wherein the tabular grains further satisfy requirement (viii) below:

(viii) an average value of long edge/short edge ratios of all the grains is 1.4 or less.

11. The emulsion according to claim 3, wherein the number of the dislocation lines of the requirement (v) is 30 or more per grain, and 80% or more in number of all the grains are occupied by tabular grains having dislocation lines substantially localized only at a fringe portion thereof, and an area ratio of (100) faces in the side faces is 40% or more.

12. The emulsion according to claim 3, wherein the tabular gains further satisfy requirement (ix) below:

(ix) an average silver iodide content of the fringe portion is higher by 2 mol % or more than an average silver iodide content of the central portion.

13. The emulsion according to claim 6, wherein the emulsion was prepared by using at least three kinds of gelatin at a time of grain formation.

14. The emulsion according to claim 6, wherein the emulsion was prepared by adding a crystal habit-controlling agent during grain formation.

15. The emulsion according to claim 6, wherein the coefficient of distribution of the equivalent-circle diameter of all the grains is 25% or less.

16. The emulsion according to claim 6, wherein the equivalent-circle diameter and the thickness of the requirement (ii) are 3.5 μm or more and 0.15 μm or less, respectively.

17. The emulsion according to claim 6, wherein the equivalent-circle diameter and the thickness of the requirement (ii) are 4.0 μm or more and 0.15 μm or less, respectively.

18. The emulsion according to claim 6, wherein the equivalent-circle diameter and the thickness of the requirement (ii) are 4.0 μm or more and 0.10 μm or less, respectively.

19. A silver halide photosensitive material having a photosensitive emulsion layer containing the silver halide photosensitive emulsion according to claim 6, on a support.

20. The material according to claim 19, wherein the material contains at least one blue-sensitive silver halide emulsion layer, at least one green-sensitive silver halide emulsion layer and at least one red-sensitive silver halide emulsion layer on a support, and at least one of the at least one red-sensitive silver halide emulsion layer is arranged further from the support than at least one of the at least one green-sensitive silver halide emulsion layer.

* * * * *